US007412734B2

(12) United States Patent
Stryker et al.

(10) Patent No.: US 7,412,734 B2
(45) Date of Patent: Aug. 19, 2008

(54) BED SIDERAIL

(75) Inventors: Martin W. Stryker, Kalamazoo, MI (US); Jeffrey L. Lewandowski, Delton, MI (US)

(73) Assignee: Stryker Corporation, Kalamazoo, MI (US)

( * ) Notice: Subject to any disclaimer, the term of this patent is extended or adjusted under 35 U.S.C. 154(b) by 198 days.

(21) Appl. No.: 11/249,799

(22) Filed: Oct. 13, 2005

(65) Prior Publication Data

US 2006/0090260 A1 May 4, 2006

Related U.S. Application Data

(60) Provisional application No. 60/619,628, filed on Oct. 18, 2004.

(51) Int. Cl.
*A47C 21/08* (2006.01)

(52) U.S. Cl. ..... 5/430; 5/425

(58) Field of Classification Search ..... 5/430, 5/425, 428

See application file for complete search history.

(56) References Cited

U.S. PATENT DOCUMENTS 3,932,903 A 1/1976 Adams et al.
4,612,679 A 9/1986 Mitchell
4,993,089 A 2/1991 Solomon et al.
5,173,975 A 12/1992 Peterson
5,187,824 A * 2/1993 Stryker ..... 5/430
5,604,942 A 2/1997 Allevato et al.
5,678,267 A 10/1997 Kinder
5,742,959 A 4/1998 Froelich
5,781,945 A 7/1998 Scherer et al.
6,058,531 A 5/2000 Carroll
6,253,397 B1 7/2001 Bartow et al.

OTHER PUBLICATIONS

Norton, Robert L. Machine Design An Integrated Approach. Upper Saddle River, N.J.: Prentice-Hall Inc., 1996.*

* cited by examiner

*Primary Examiner*—Patricia Engle
*Assistant Examiner*—William Kelleher
(74) *Attorney, Agent, or Firm*—Van Dyke, Gardner, Linn & Burkhart, LLP

(57) ABSTRACT

A bed siderail has a vertical siderail extension, a horizontal siderail extension, or both. A bed siderail has dual vertical siderail extensions. A bed has gap fillers pivotally mounted to the headboard and/or footboard, either in the manner of a hinge, or by means of a dual axis pivot, to fill gaps between the headboard/footboard and a siderail. A bed siderail has pivotally mounted gap fillers directed toward the headboard, footboard, or an adjacent siderail. A bed has slidably mounted gap fillers. A bed siderail has pivotally mounted gap fillers, to fill a gap between the siderail and a mattress, the gap fillers being either gravity- or cam-activated, or being integrally formed in the siderail support arms. A bed siderail is rotatable from a deployed to a stowed position, and is simultaneously stowed close-into or underneath the bed frame.

24 Claims, 65 Drawing Sheets

RAIL UP

RAIL IN MIDDLE

RAIL DOWN

RAIL UP

RAIL IN MIDDLE

RAIL DOWN

RAIL UP

RAIL IN MIDDLE

RAIL DOWN

3 POSITION

TELESCOPING

SIDERAIL

SIDERAIL UP

SIDERAIL IN MIDDLE

SIDERAIL DOWN

HINGED GAP FILLERS

DOORS CLOSED

DOORS OPEN

ROTATING GAP FILLER

PIVOT AT TOP OF FILLER

CORNER VIEW

ROTATING GAP FILLER

PIVOT IN MIDDLE OF FILLER

SIDERAIL MOUNTED "HINGED DOOR"

Friction Wedge Block
Side Rail

Gear Drive Side Rail

RAIL UP

RAIL IN MIDDLE

As the side rail is pushed backwards the gears rotate the side rail under the bed.

RAIL DOWN

BED SIDERAIL

CROSS-REFERENCE TO RELATED APPLICATIONS

This application claims the benefit of U.S. Provisional Application Ser. No. 60/619,628, filed Oct. 18, 2004.

BACKGROUND OF THE INVENTION

1. Field of the Invention

The invention relates to a bed siderail. In one of its aspects, the invention relates to a bed siderail with vertical and/or horizontal extensions or gap fillers. In another aspect, the invention relates to a siderail retractable underneath a bed support frame. In another of its aspects, the invention relates to a siderail deployed to a position closely abutting a bed mattress.

2. Description of Related Art

Hospital beds are provided siderails to prevent a patient from falling out. Additional safeguards are sometimes desirable, providing siderails with greater coverage of the bedside, thereby reducing gaps between the siderails or the siderails and the headboard or footboard.

It would be advantageous to provide a siderail or bed and siderail assembly that reduces gaps, and increases safety.

BRIEF SUMMARY OF THE INVENTION

A bed siderail has a vertical siderail extension, a horizontal siderail extension, or both. A bed siderail has dual vertical siderail extensions. A bed has gap fillers pivotally mounted to the headboard and/or footboard, either in the manner of a hinge, or by means of a dual axis pivot, to fill gaps between the headboard/footboard and a siderail. A bed siderail has pivotally mounted gap fillers directed toward the headboard, footboard, or an adjacent siderail. A bed has slidably mounted gap fillers. A bed siderail has pivotally mounted gap fillers, to fill a gap between the siderail and a mattress, the gap fillers being either gravity- or cam-activated, or being integrally formed in the siderail support arms. A bed siderail is rotatable from a deployed to a stowed position, and is simultaneously stowed close-into or underneath the bed frame.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE PREFERRED EMBODIMENT

Figure 1:
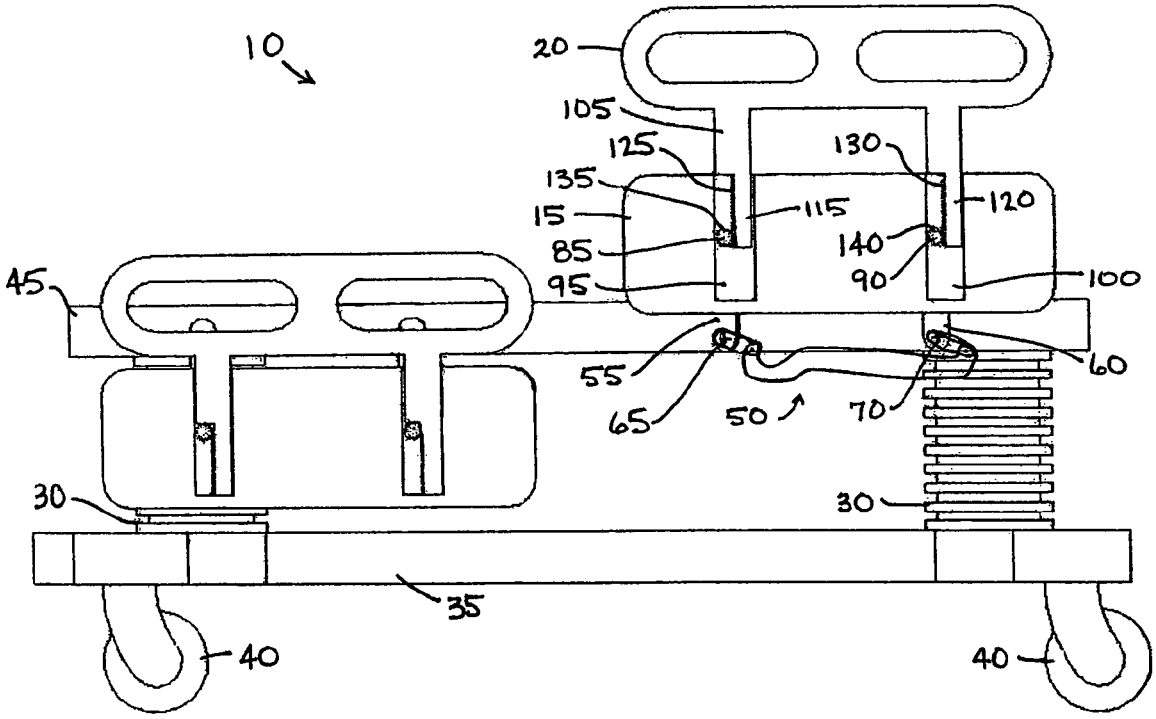
FIG. 1 is a side view of a bed with a vertically expanding siderail according to the invention.

Certain terminology will be used in the following description for convenience in reference only and will not be limiting. The words "up", "down", "right", "left", "clockwise" or "counterclockwise" will designate directions in the drawings to which reference is made. The words "in" and "out" will refer to directions toward and away from, respectively, the geometric center of the device and designated parts thereof. The words "proximal", "distal", "transverse" or "longitudinal" will refer to the orientation of an element with respect to the patient support apparatus. Such terminology will include derivatives and words of similar import.

Referring to FIG. 1, a bed 10 having a siderail 15 with a siderail vertical extension 20 is illustrated. The bed 10 includes a bed frame 25 supported by a pair of telescoping stanchions 30 mounted to a base frame 35. The base frame 35 is supported on a floor surface by a plurality of wheels or casters 40.

The bed frame 25 includes a bed frame side rail 45. A siderail support mechanism 50 mounts the siderail 15 to the bed frame side rail 45.

The siderail support mechanism 50 includes a pair of upstanding support arms 55, 60. The support arms 55, 60 are pivotally connected at the bed frame side rail 45 by lower pivot shafts 65, 70 and pivotally connected at upper pivot shafts 75, 80 to the siderail 15. The support arms 55, 60 further each include a pinion gear 85, 90 mounted on the upper pivot shafts 75, 80 to rotate therewith.

The pinion gear 85, 90 is positioned within a vertical recess 95, 100 within the siderail 15. Each recess 95, 100 is configured to receive one of a pair of support stanchions 105, 110 for the siderail vertical extension 20. Each of the support stanchions 105, 110 for the siderail vertical extension 20 include a rack section 115, 120 having a plurality of teeth 125, 130 configured to mesh with teeth 135, 140 of the respective pinion gear 85, 90 within the recess 95, 100 of the siderail 15.

Figure 2:
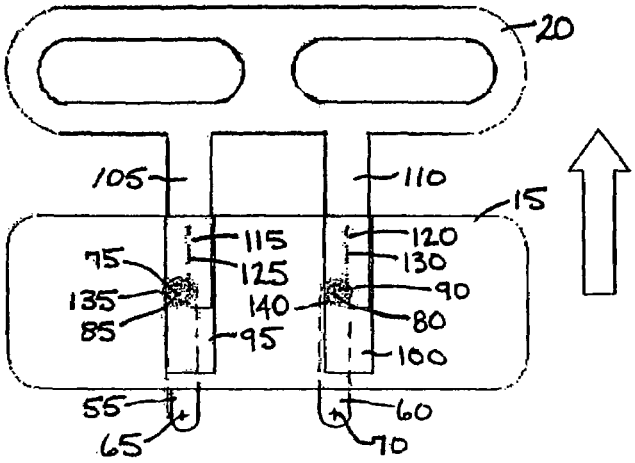
FIG. 2 is a partial cut-away side view of the vertically expanding siderail of FIG. 1 in the deployed, use position.
Figure 3:
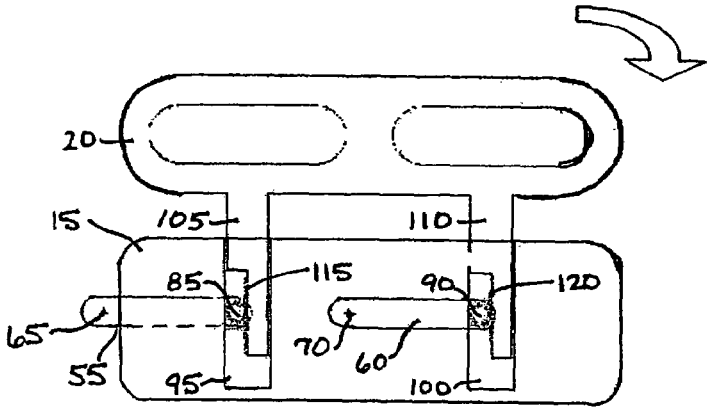
FIG. 3 is a partial cut-away side view of the vertically expanding siderail of FIGS. 1-2 in a partially stowed position.
Figure 4:
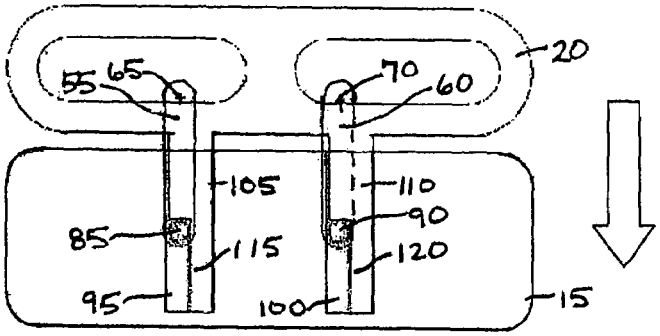
FIG. 4 is a partial cut-away side view of the vertically expanding siderail of FIGS. 1-3 in a stowed position.
Figure 5:
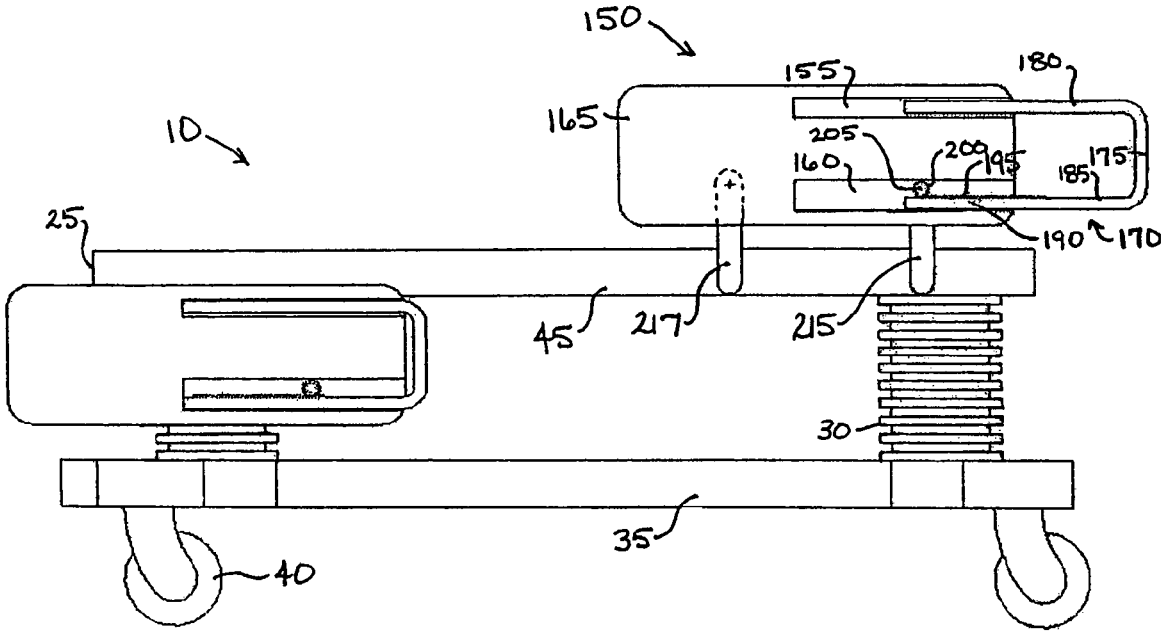
FIG. 5 is a side view of a bed with a horizontally expanding siderail according to a further embodiment of the invention.

Referring to FIGS. 2-4, as the siderail 15 is moved from a deployed, use position as shown in FIG. 2 to a stowed position, as shown in FIG. 4, the support arms 55, 60 rotate clockwise relative to the siderail 15, causing the pinion gears 85, 90 to also rotate clockwise. As each pinion gear 85, 90 rotates relative to the siderail 15, the siderail vertical extension 20 is drawn into the siderail 15 by the meshing of the rack section 115, 120 and the pinion gear 85, 90 within each recess 95, 100 of the siderail 15. When the siderail 15 is raised from the stowed position of FIG. 4 to the deployed, use position of FIG. 2, the converse occurs, raising the siderail vertical extension 20.

FIGS. 5-8 illustrate a further embodiment of an expanding siderail mechanism 150 according to the invention. In this embodiment, a pair of recesses 155, 160 are oriented laterally in a siderail 165. A U-shaped siderail lateral extension 170 is provided, having a bight portion 175 and a pair of legs 180, 185 extending laterally to be received within the recesses 155, 160. The lateral extension 170 further includes a rack section 190 having a plurality of teeth 195 configured to mesh with a plurality of teeth 200 of a pinion gear 205 secured to an upper pivot shaft 210 of a support arm 215 of the siderail 165. The siderail 165 is pivotally supported on the bed frame side rail 45 by the support arm 215 and a second support arm 217.

Figure 6:
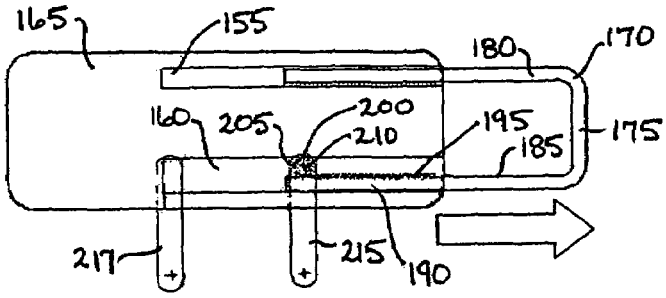
FIG. 6 is a partial cut-away side view of the horizontally expanding siderail of FIG. 5 in an upright, use position.
Figure 7:
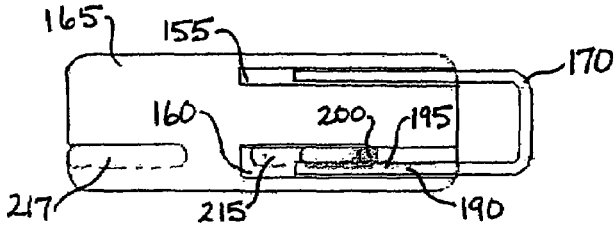
FIG. 7 is a partial cut-away side view of the horizontally expanding siderail of FIGS. 5-6 in a partially stowed position.
Figure 8:
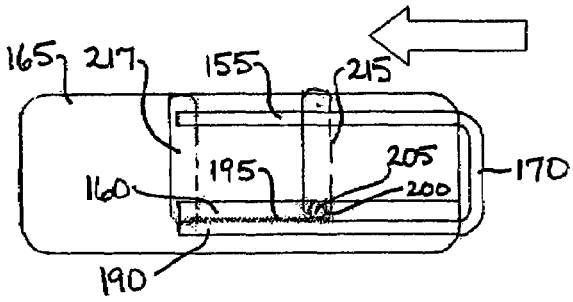
FIG. 8 is a partial cut-away side view of the horizontally expanding siderail of FIGS. 5-7 in a stowed position.

As shown in FIGS. 6-8, as the siderail 165 is lowered from the deployed, use position of FIG. 6 to the stowed position of FIG. 8, the pinion gear 205 rotates clockwise, engaging the rack 190 of the lateral extension 170 to draw the lateral extension 170 into the recesses 155, 160 within the siderail 165.

Figure 9:
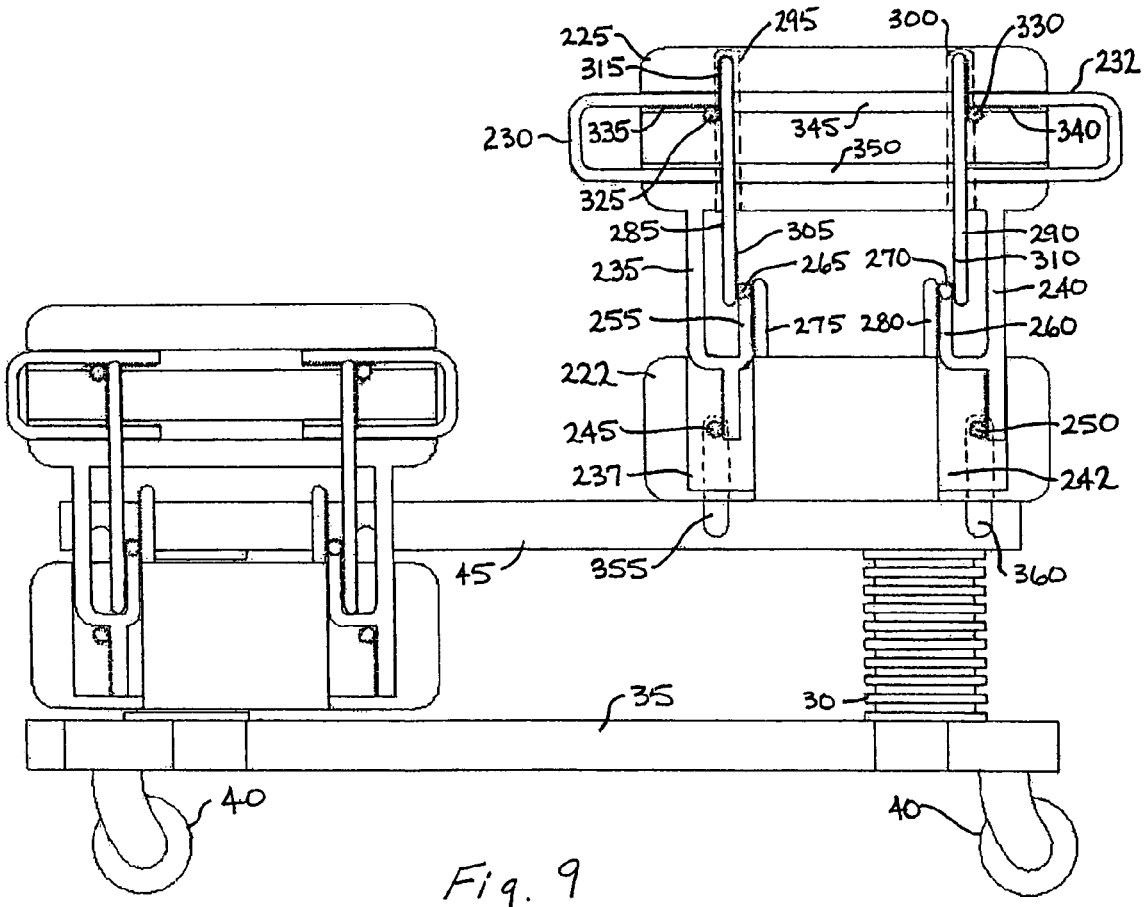
FIG. 9 is a side view of a bed with a vertical and horizontal expanding siderail according to a further embodiment of the invention.

FIGS. 9-12 illustrate a siderail mechanism 220 having a siderail 222 with a combination of a vertical siderail extension 225 and lateral siderail extensions 230, 232 according to a further embodiment of the invention. As shown in FIG. 9, a pair of support stanchions 235, 240 of the vertical siderail extension 225 are received in recesses 237, 242 of the siderail 222 and are driven by a first pair of pinion gears 245, 250 after the manner of the first embodiment. Each stanchion 235, 240 includes a second vertical portion 255, 260, each carrying a second pinion gear 265, 270. The second pinion gears 265, 270 are configured to ride on one of a pair of fixed tracks 275, 280 mounted on the siderail 222. Each second pinion gear 265, 270 drives a connection rod 285, 290 through a respective recess 295, 300 in the vertical siderail extension 225. The connection rods 285, 290 include a first rack section 305, 310 for engaging the second pinion gears 265, 270 and a second rack section 315, 320 for engaging a third pinion gear 325, 330 rotatably mounted within the vertical siderail extension 225.

The third pinion gears 325, 330 in the vertical siderail extension 225 further engage a rack section 335, 340 on the lateral extensions 230, 232. The lateral extensions 230, 232 are received within lateral recesses 345, 350 of the vertical siderail extension 225.

Figure 10:
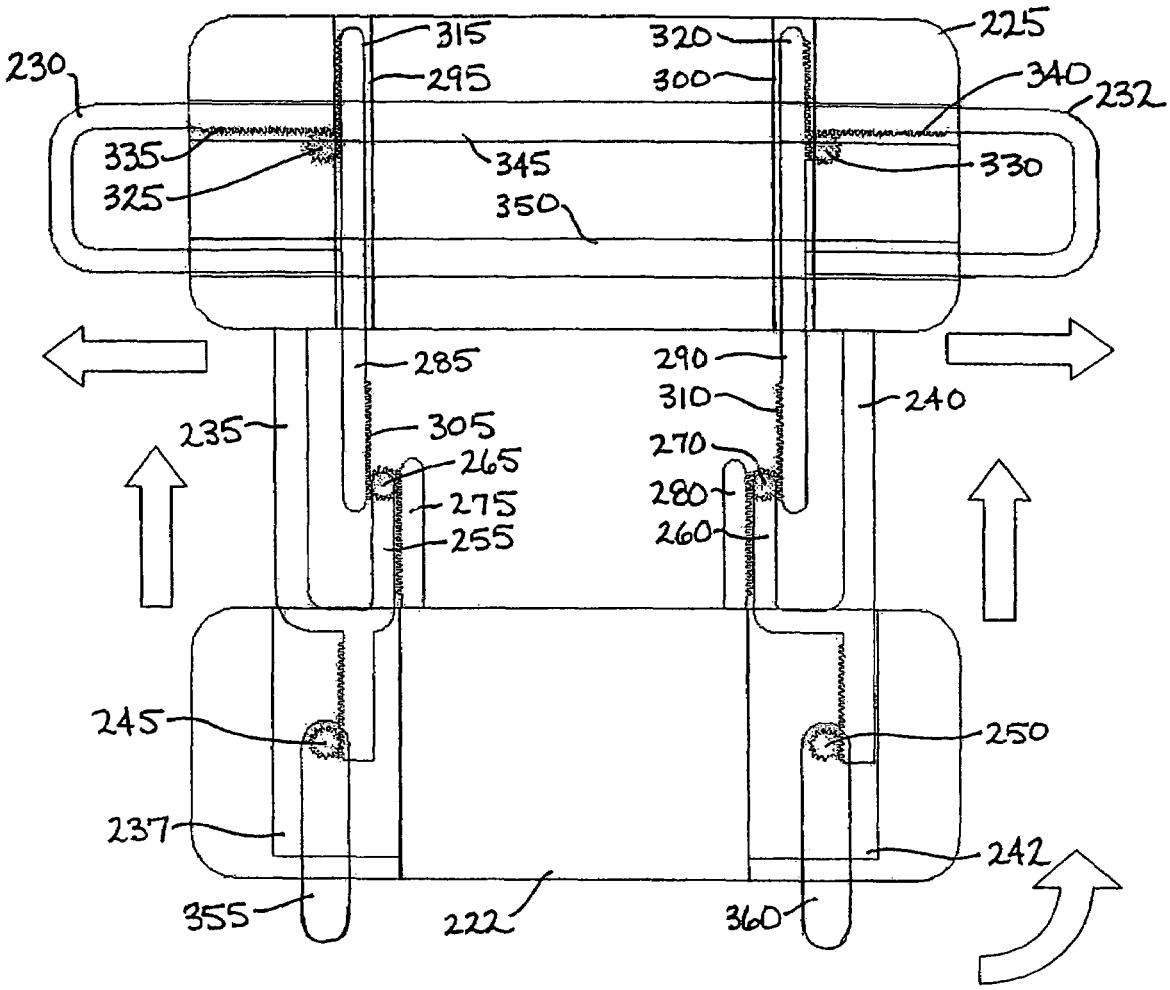
FIG. 10 is a partial cut-away side view of the vertically and horizontally expanding siderail of FIG. 9 in a deployed, use position.
Figure 11:
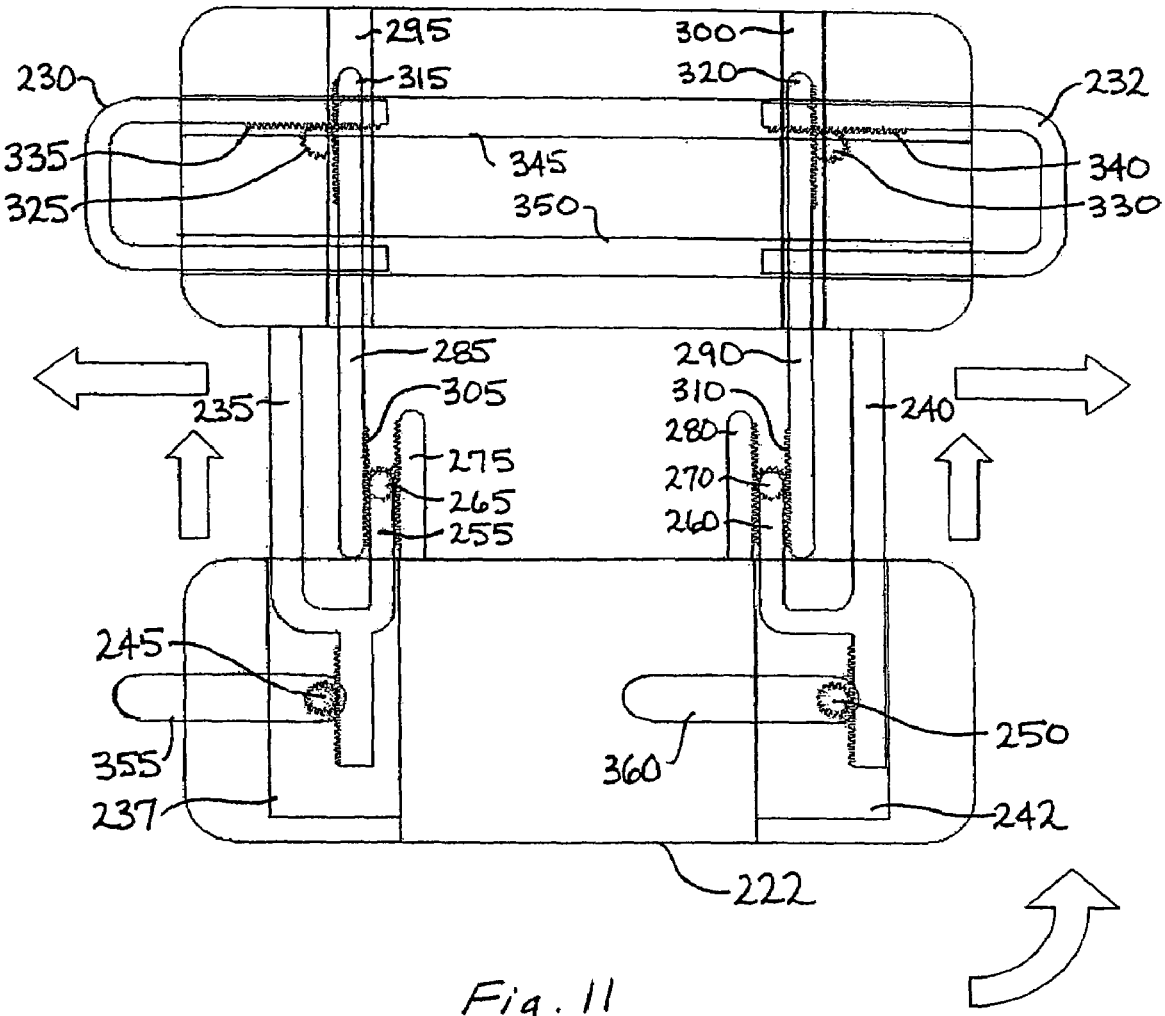
FIG. 11 is a partial cut-away side view of the vertically and horizontally expanding siderail of FIGS. 9-10 in a partially stowed position.
Figure 12:
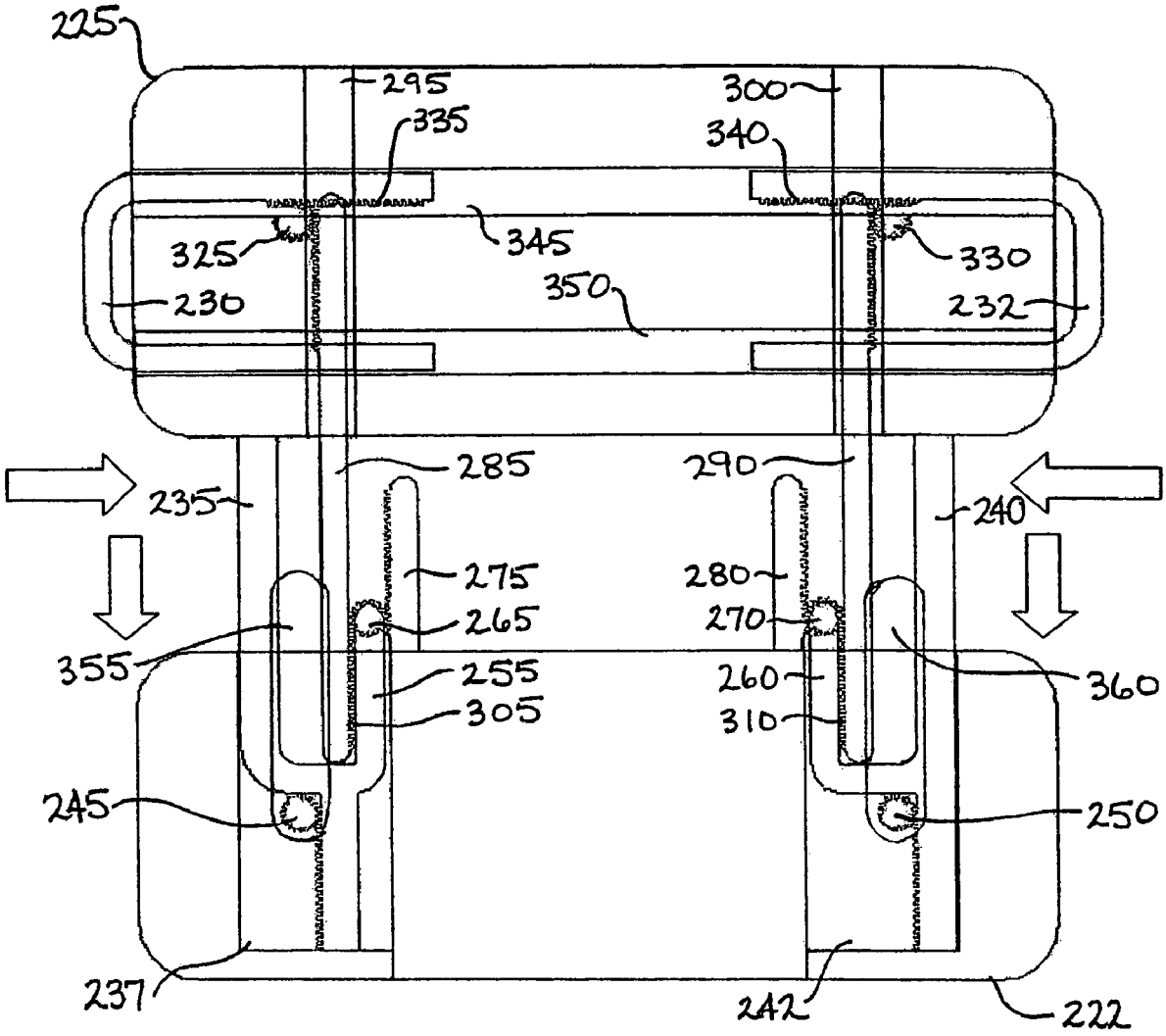
FIG. 12 is a partial cut-away side view of the vertically and horizontally expanding siderail of FIGS. 9-11 in a stowed position.
Figure 13:
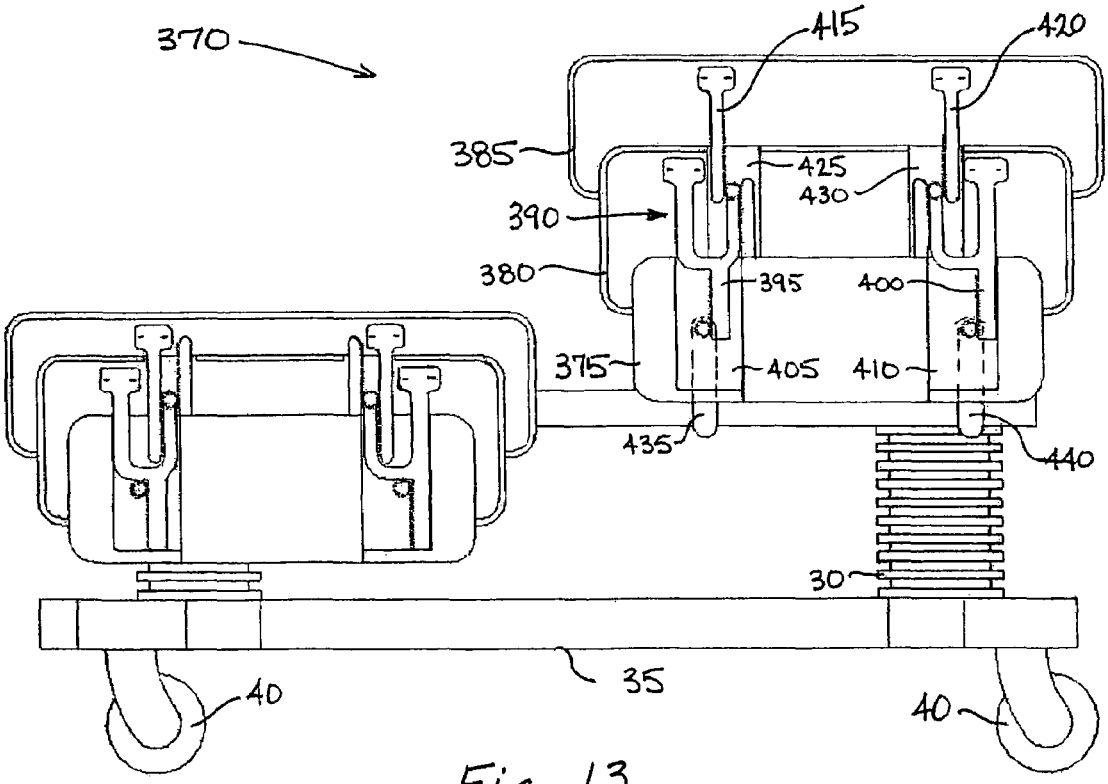
FIG. 13 is a side view of a bed with a compound vertically expanding siderail according to a further embodiment of the invention.
Figure 14:
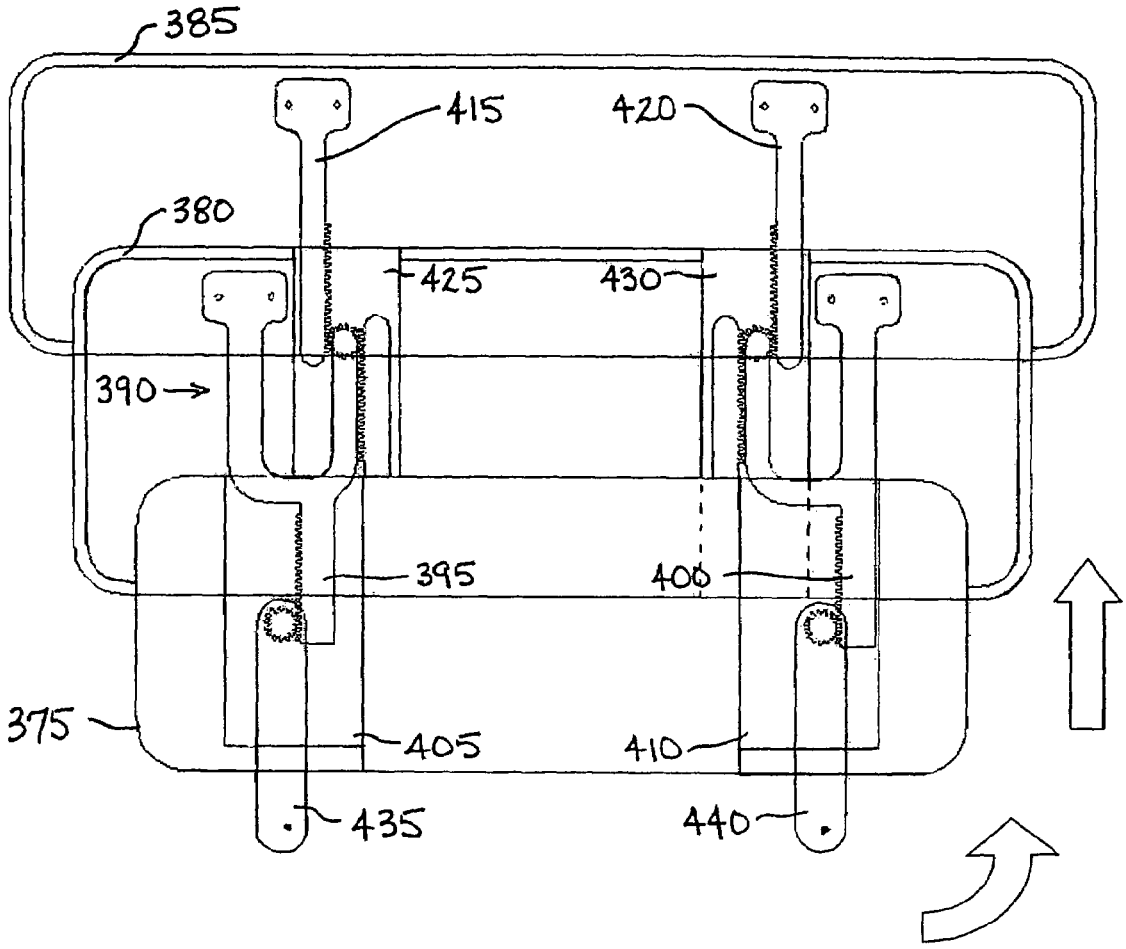
FIG. 14 is a partial cut-away side view of the compound vertically expanding siderail of FIG. 13 in a deployed, use position.
Figure 15:
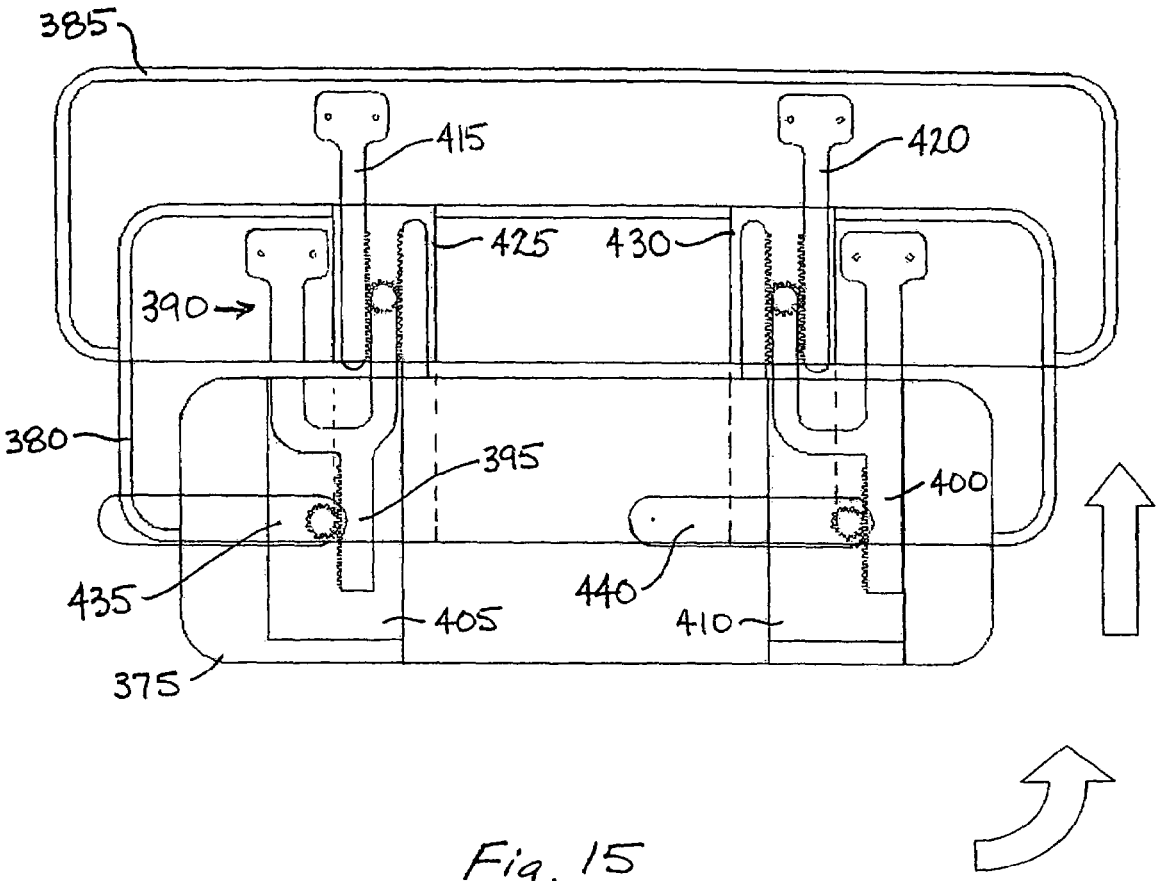
FIG. 15 is a partial cut-away side view of the compound vertically expanding siderail of FIGS. 13-14 in a partially stowed position.
Figure 16:
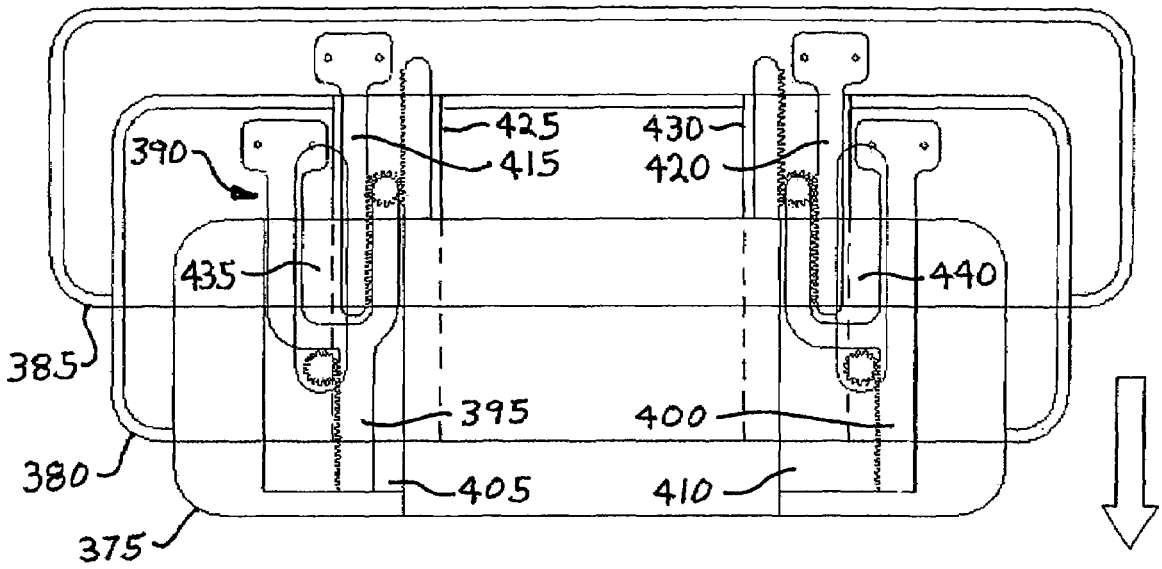
FIG. 16 is a partial cut-away side view of the compound vertically expanding siderail of FIGS. 13-15 in a stowed position.

Referring sequentially to FIGS. 10-12, it can be seen that as a pair of support arms 355, 360 supporting the siderail 222 move from a deployed, use position (FIG. 10) to a stowed position (FIG. 12), the various rack and pinion systems work in concert to retract the siderail vertical extension 225 and the siderail lateral extensions 230, 232 simultaneously. By way of example, as the siderail 222 is rotated from the deployed, use position, the support arm 360 rotates in a clockwise direction, as does the pinion gear 250. As the pinion gear 250 rotates in a clockwise direction, the support stanchion 240 is drawn downwardly into the recess 242. As the support stanchion 240 travels downwardly, the second pinion gear 270 rides on the fixed track 280, rotating in a clockwise direction. The clockwise rotation of the second pinion gear 270 draws the connection rod 290 downwardly, imparting a counterclockwise rotation in the third pinion gear 330. The counterclockwise rotation of the third pinion gear 330 engaging the rack section 340 draws the lateral extension 232 leftward and into the recesses 345, 350.

Referring to FIGS. 13-16, a siderail mechanism 370 includes a siderail 375. A first vertical extension 380 and a second vertical extension 385 are provided slidably received on the siderail 375. A dual rack and pinion system 390 similar to the embodiment of FIGS. 9-12 is employed. Support stanchions 395, 400 support the first vertical extension 380 and are slidably received in recesses 405, 410 in the siderail 375. Interconnecting rods 415, 420 are fixed to the second vertical extension 385 and are slidably received in a pair of recesses 425, 430 in the first vertical extension 380. As the support arms 435, 440 of the siderail 375 pivot, moving the siderail 375 from the deployed, use position of FIG. 14 to the stowed position of FIG. 16, the first and second vertical extensions 380, 385 are simultaneously retracted.

Figure 17:
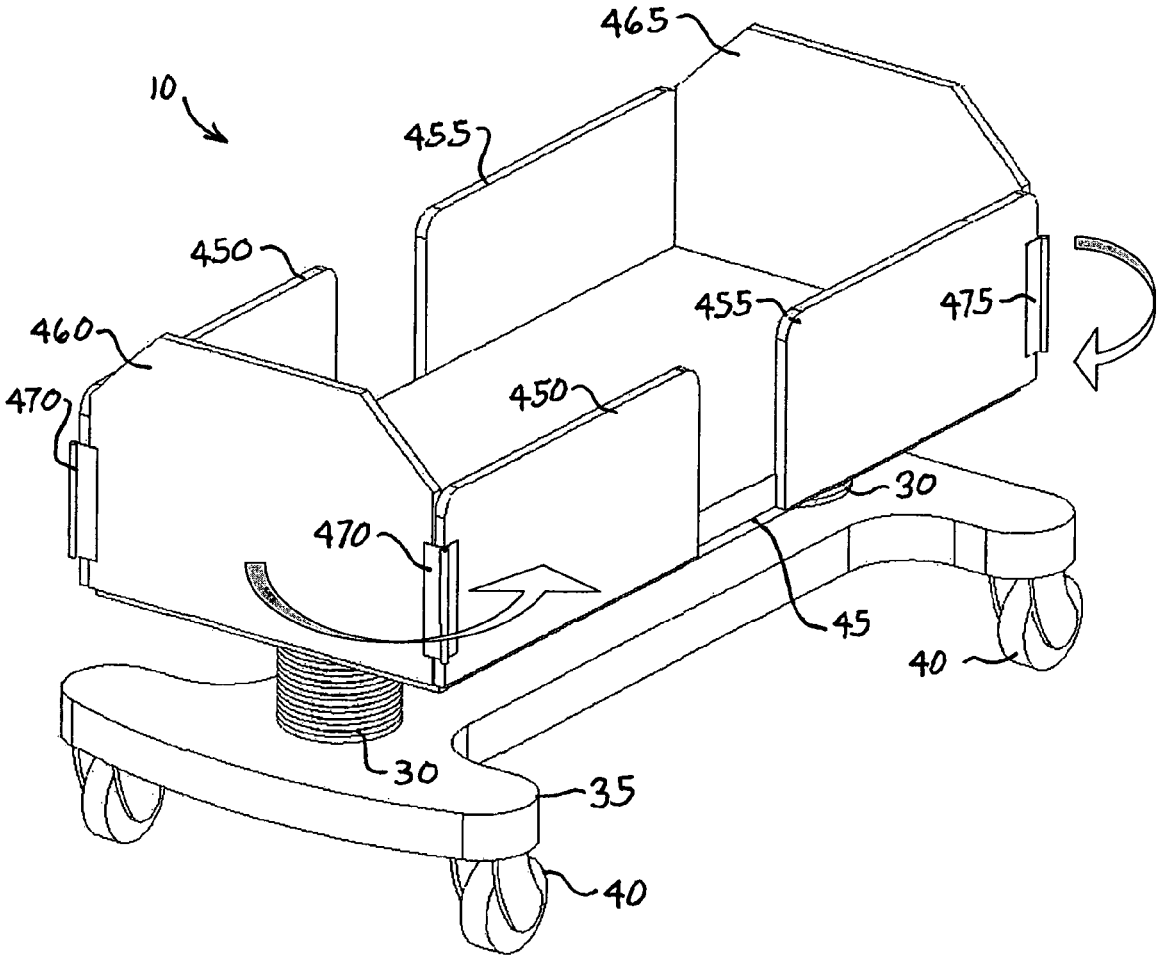
FIG. 17 is a perspective view of a bed with headboard- and footboard-mounted gap fillers according to a further embodiment of the invention.
Figure 18:
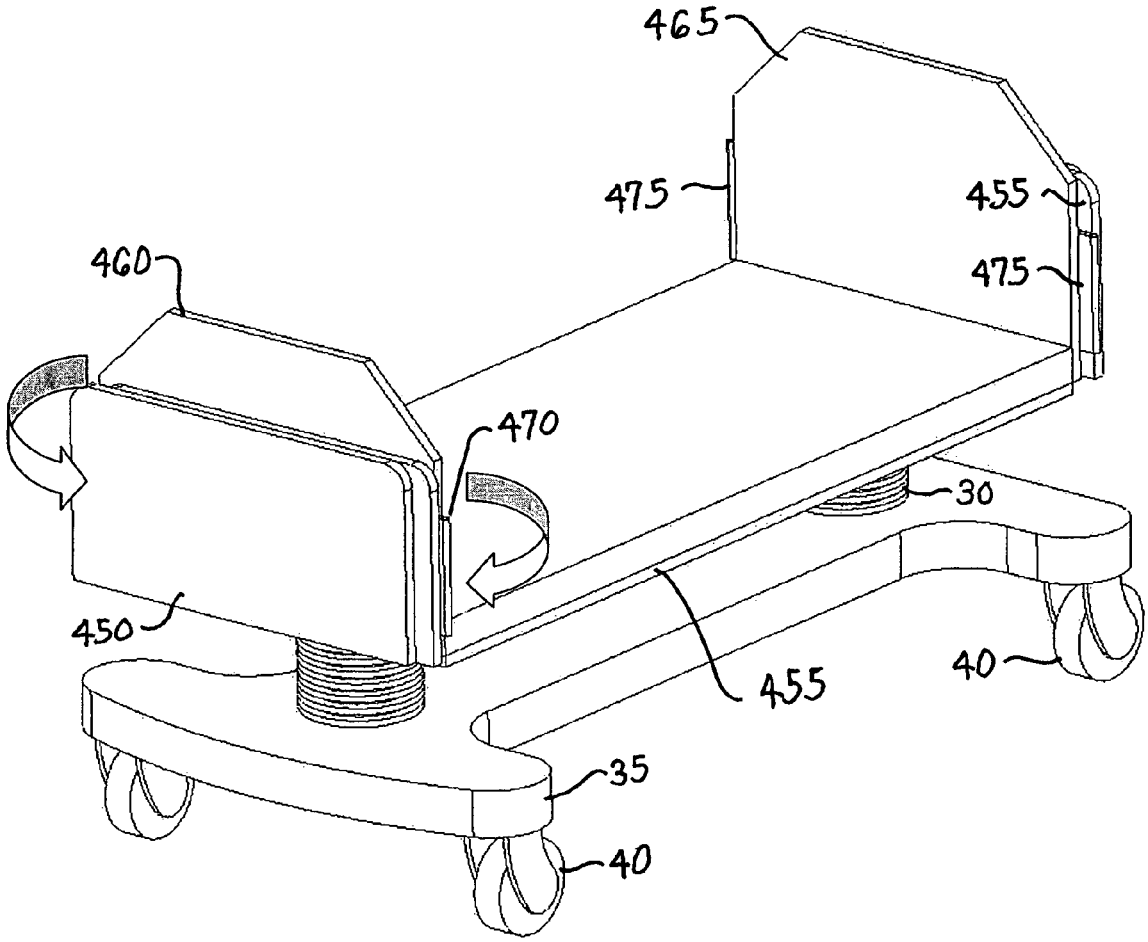
FIG. 18 is a perspective view according to FIG. 17 with the gap fillers in a stowed position.

Referring now to FIGS. 17-18, a bed 10 having a pair of gap fillers 450, 455 is illustrated. The gap fillers 450, 455 are planar sections pivotally mounted to a footboard 460 and headboard 465 of the bed 10 by hinges 470, 475. In a deployed position, shown in FIG. 17, the gap fillers 450, 455 are operable to block gaps that would normally exist between a conventional siderail (not shown) and each of the footboard 460 and the headboard 465. In a stowed position, shown in FIG. 18, the gap fillers 450, 455 are rotated about the hinges 470, 475 to lie parallel to the footboard 460 or the headboard 465 of the bed 10.

Figure 19:
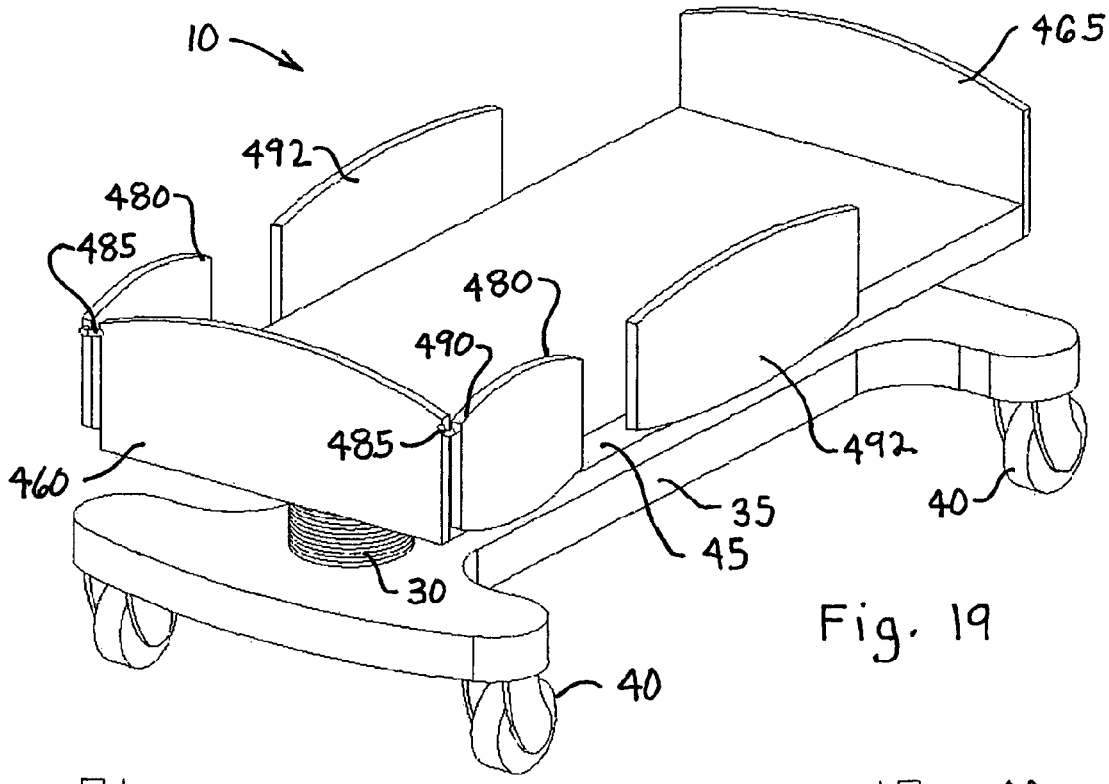
FIG. 19 is a perspective view of a bed with gap filler pivotally attached to a footboard according to a further embodiment of the invention.
Figure 20:
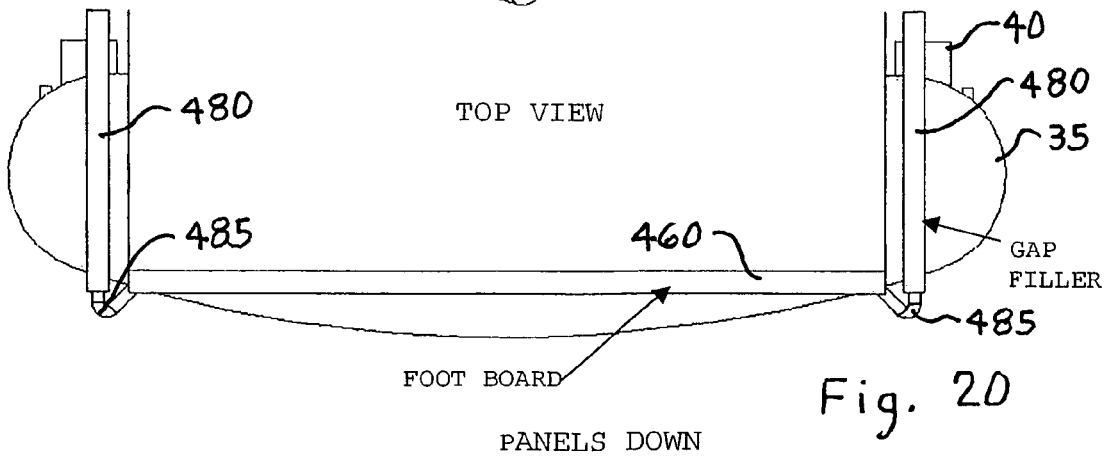
FIG. 20 is a plan view of the bed with gap filler pivotally attached to the footboard of FIG. 19.
Figure 21:
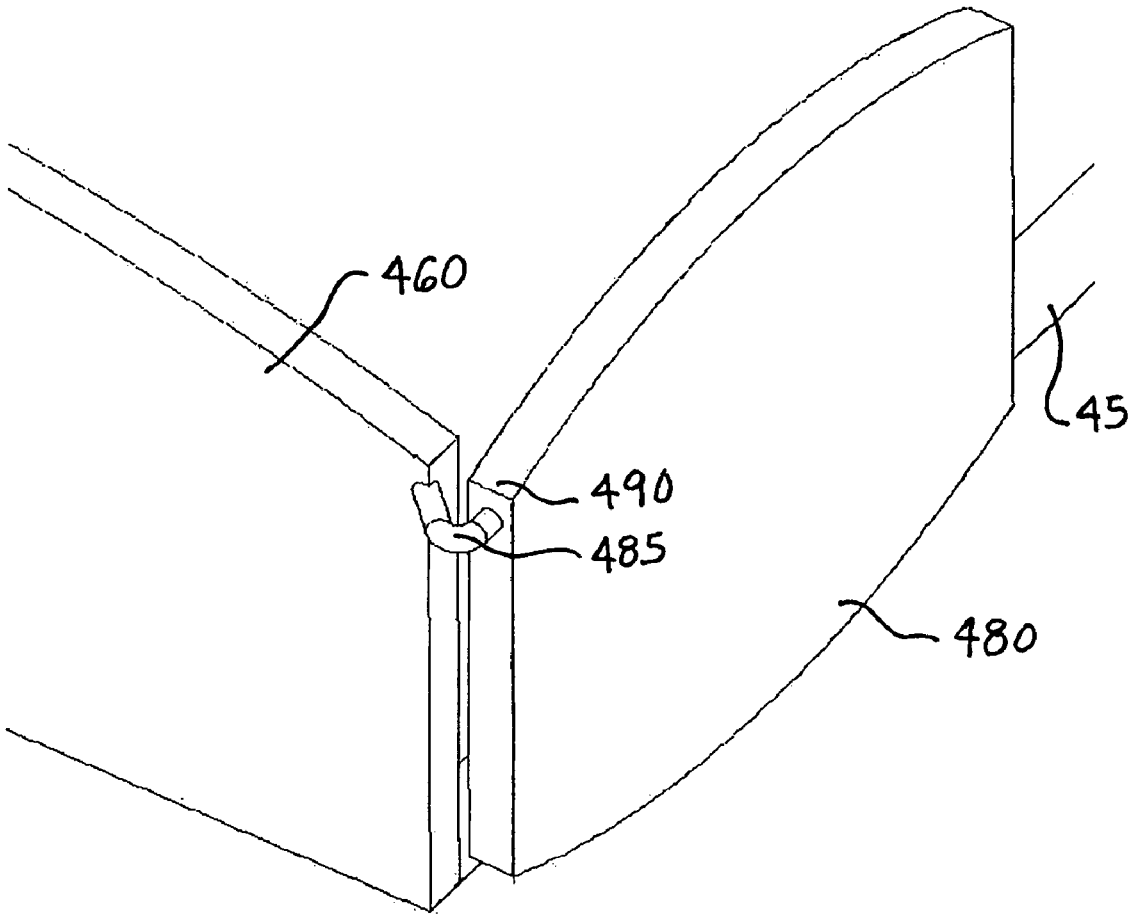
FIG. 21 is an enlarged perspective view of a pivot mechanism according to FIGS. 19-20.

Referring to FIGS. 19-32, a further embodiment of a gap filler 480 according to the invention is illustrated. As shown in FIGS. 19-21, the gap filler 480 is pivotally connected to the footboard 460 of the bed 10 by an eccentric two-axis pivot arm or hinge 485 mounted to an upper extent 490 of the gap filler 480. The gap filler 480 is further adaptable for mounting to the headboard 465 of the bed 10.

Figure 22:
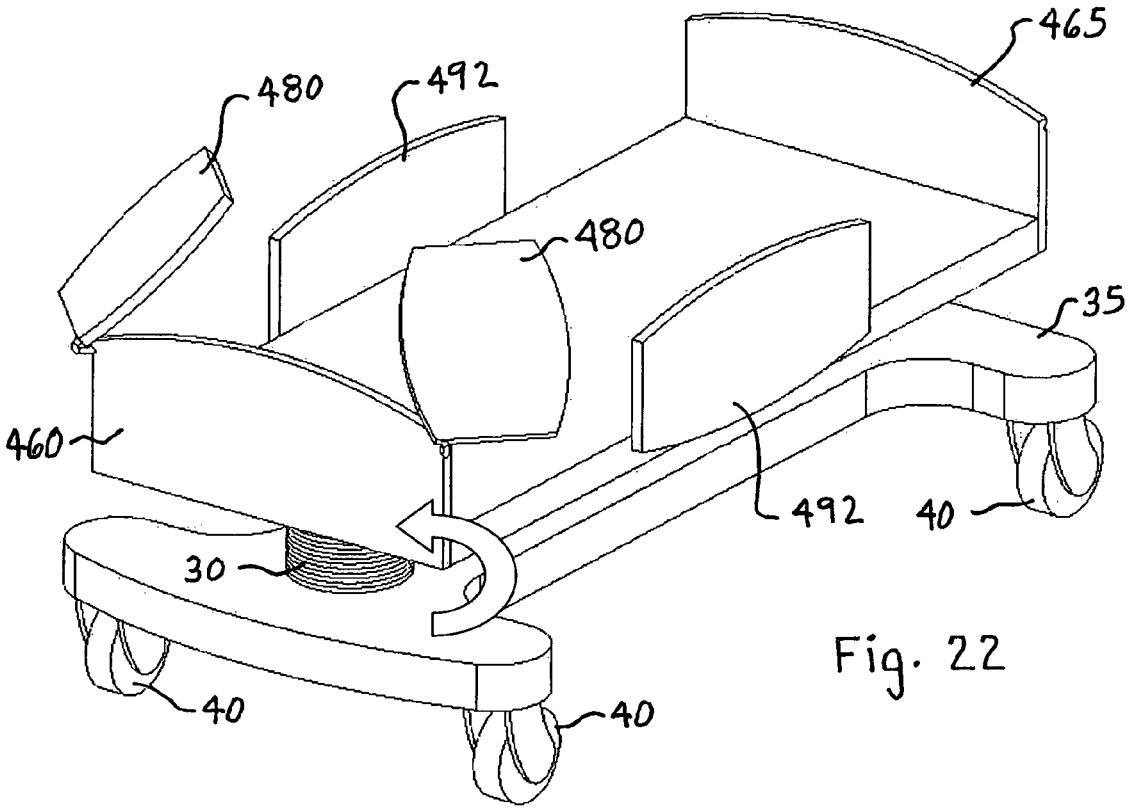
FIG. 22 is a perspective view of a bed according to FIGS. 19-21 with the gap fillers in a partially stowed position.
Figure 23:
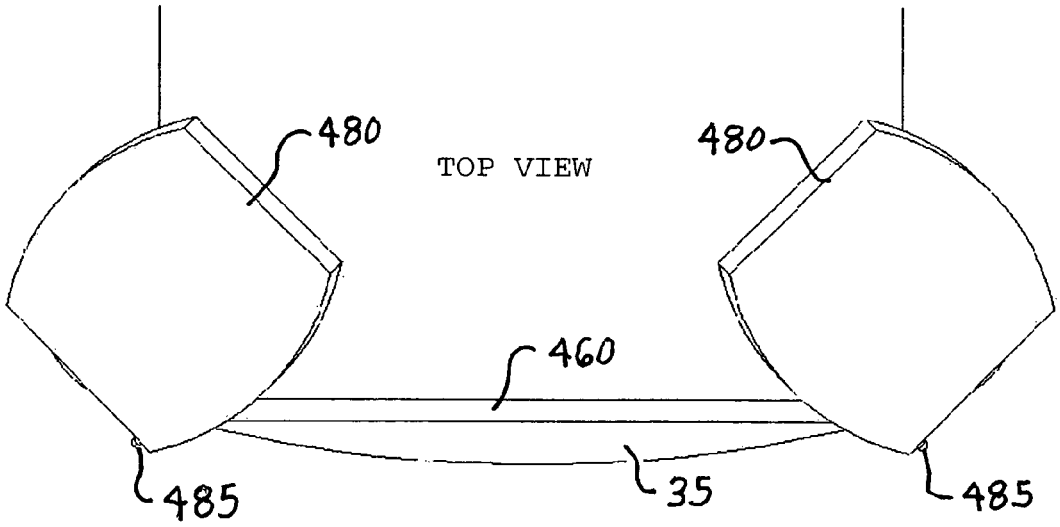
FIG. 23 is a plan view according to FIG. 22.
Figure 24:
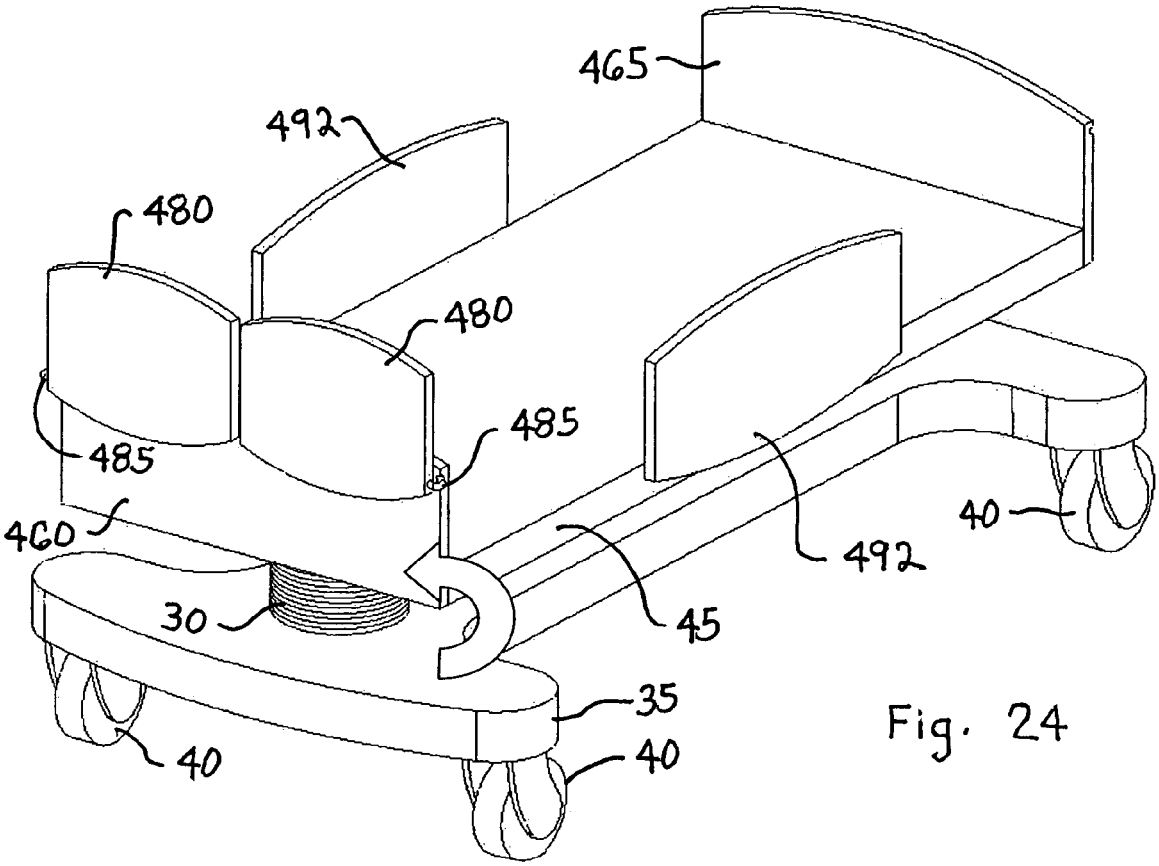
FIG. 24 is a perspective view of the bed with gap fillers pivotally attached to the footboard according to FIGS. 19-23 with the gap fillers in the stowed position.
Figure 25:
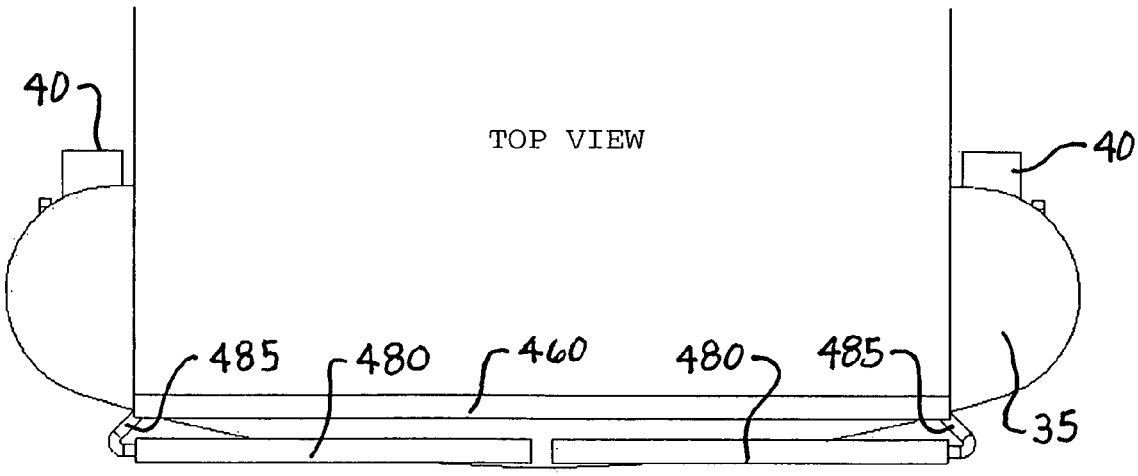
FIG. 25 is a plan view according to FIG. 24.

In the deployed position of FIGS. 19-21, the gap filler 480 is operable to block a gap between the footboard 460 and a conventional siderail 492. When not in use, the gap filler 480 is shifted to a stowed position parallel to the footboard 460 (FIG. 24). As shown in FIGS. 22-23, the gap filler 480 is shifted from the deployed position, through an arcuate path defined by the two-axis pivot hinge 485, to the stowed position of FIGS. 24-25.

Figure 26:
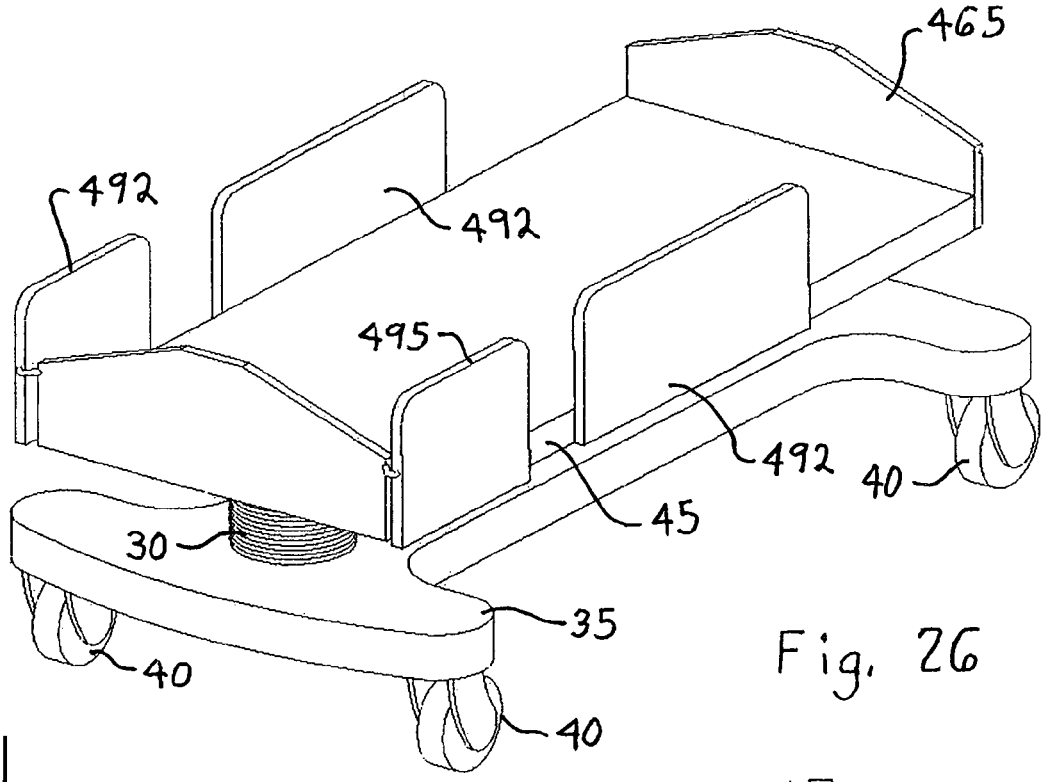
FIG. 26 is a perspective view of a bed with gap filler pivotally mounted to the footboard according to a further embodiment of the invention.
Figure 27:
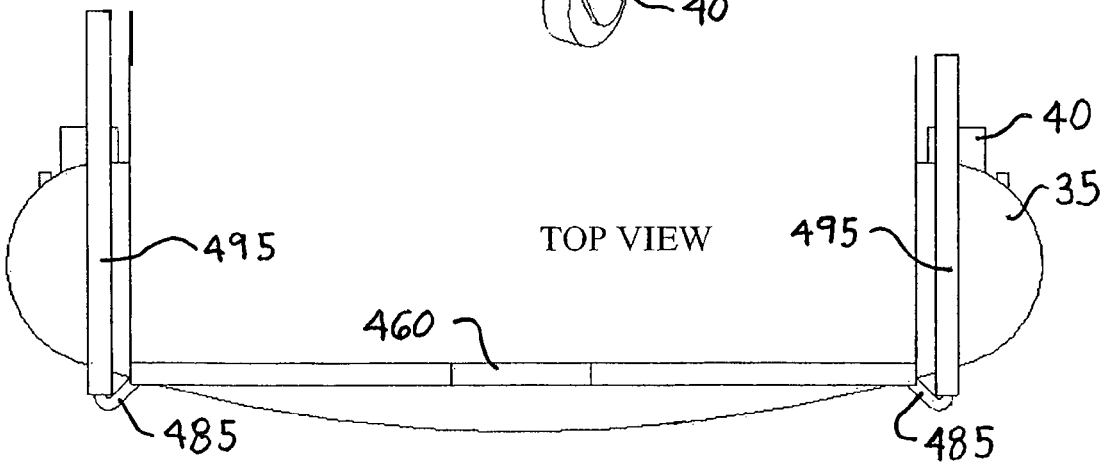
FIG. 27 is a plan view according to FIG. 26.
Figure 28:
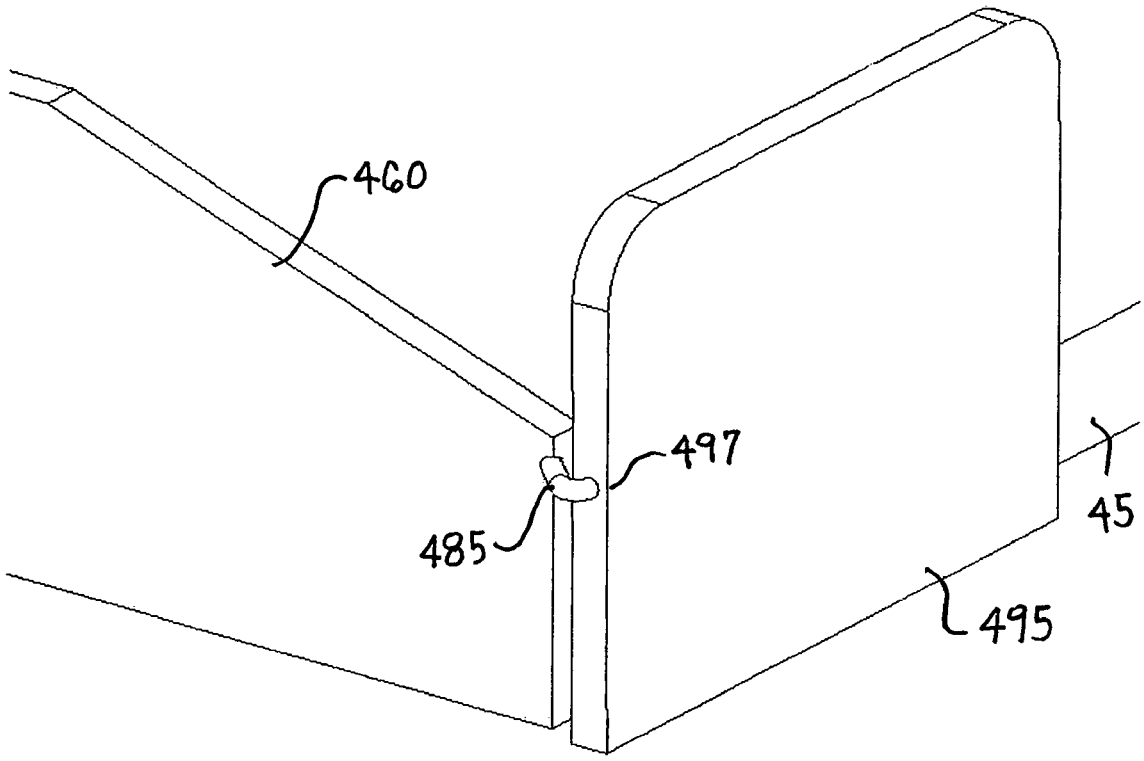
FIG. 28 is an enlarged detail view of the pivot mechanism according to FIGS. 26-27.
Figure 29:
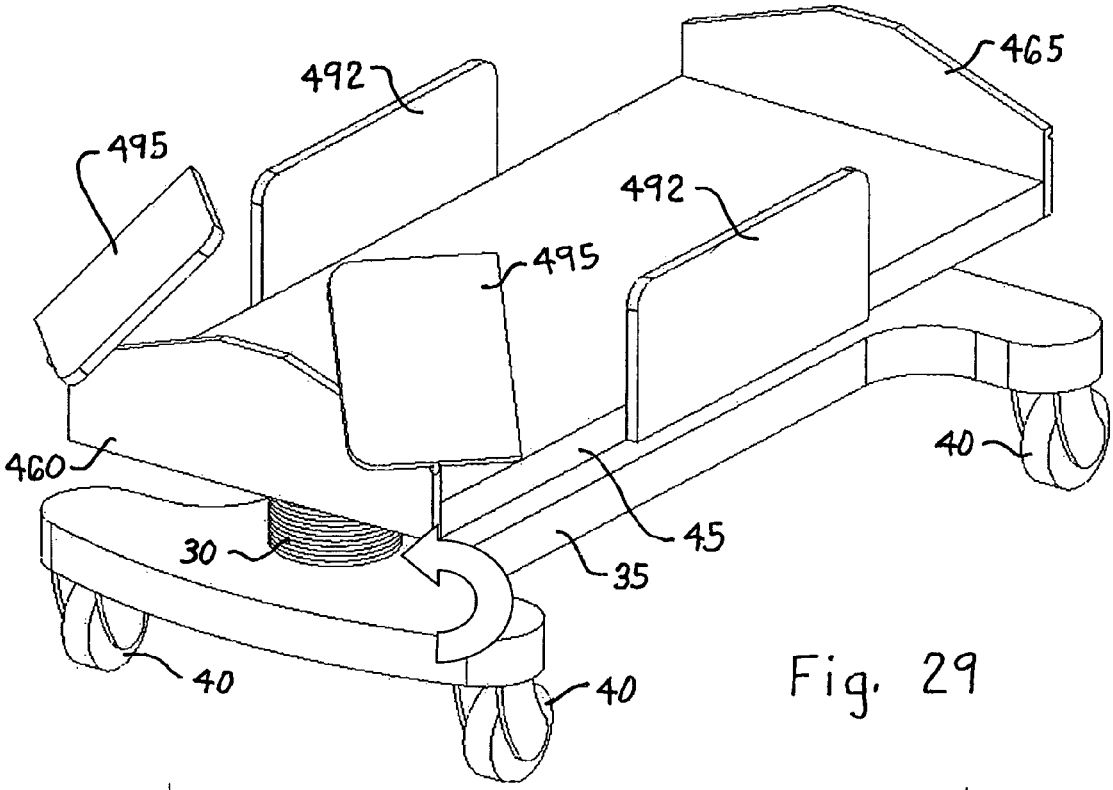
FIG. 29 is a perspective view of a bed with gap fillers pivotally attached to the footboard according to FIGS. 26-28 with the gap fillers in a partially stowed position.
Figure 30:
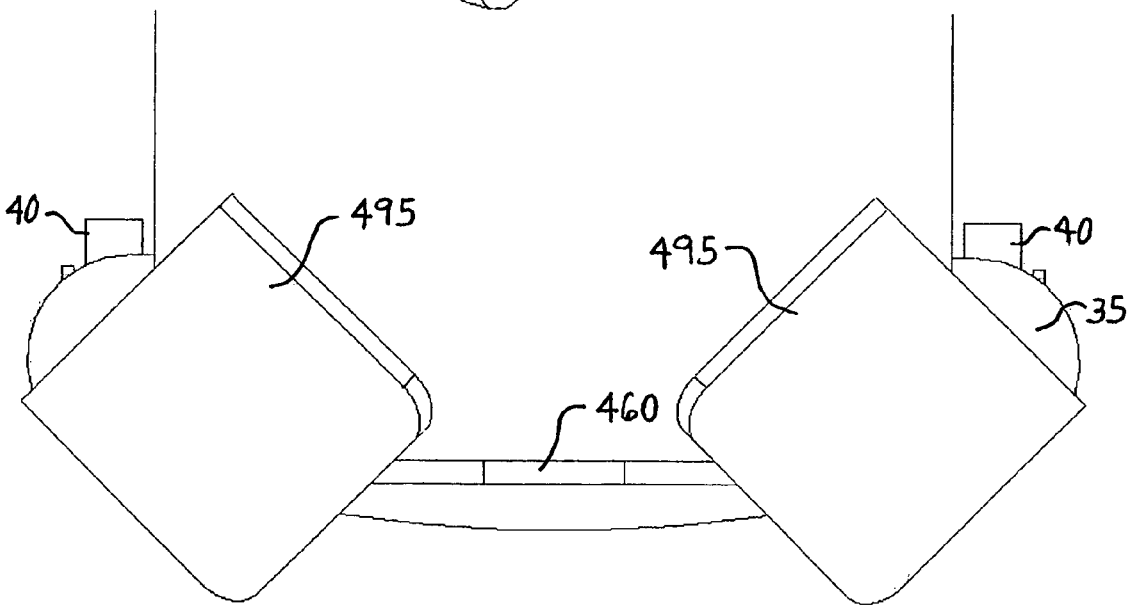
FIG. 30 is a plan view according to FIG. 29.
Figure 31:
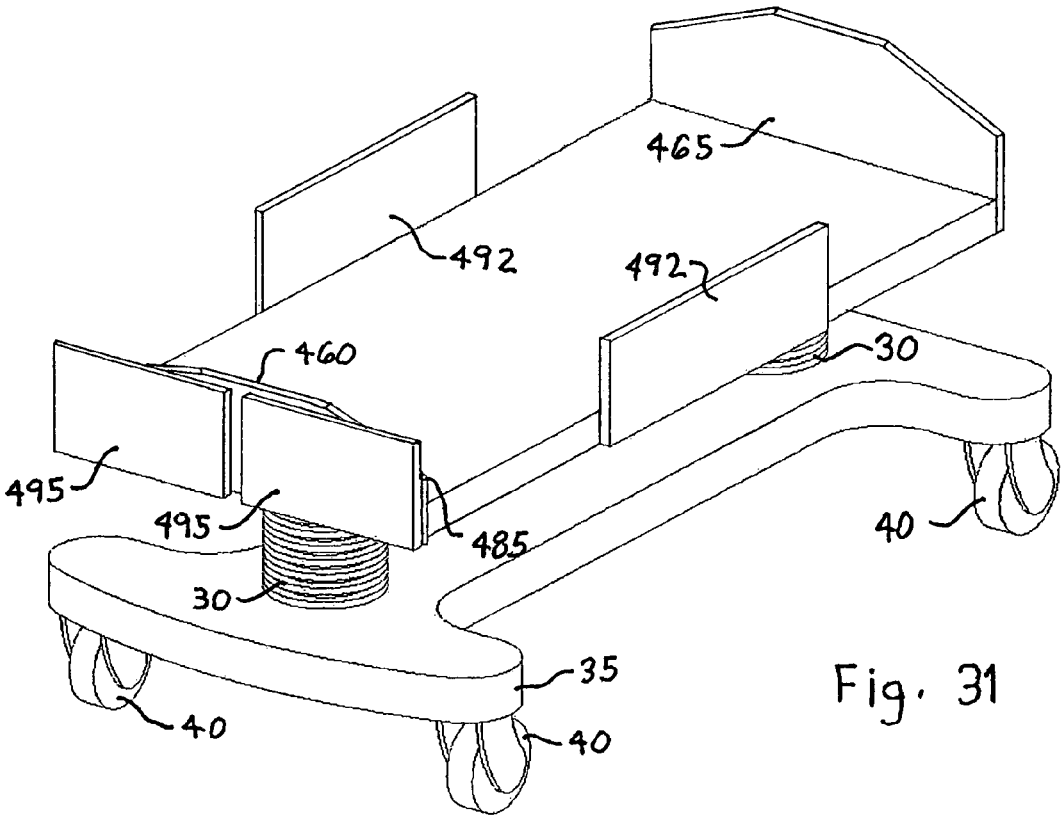
FIG. 31 is a perspective view of a bed with gap fillers pivotally attached to the footboard according to FIGS. 26-30 with the footboards in the stowed position.
Figure 32:
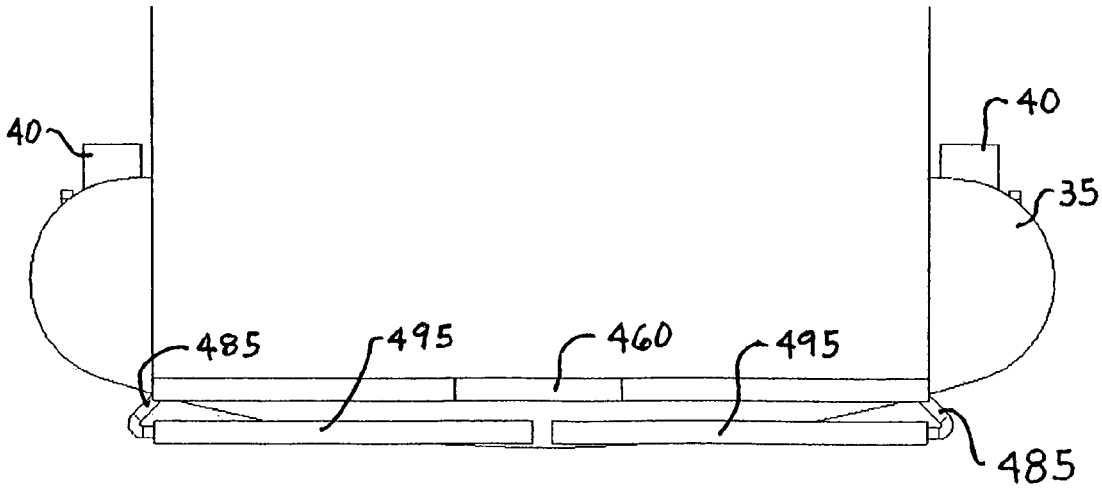
FIG. 32 is a plan view according to FIG. 31.

A variation of the embodiment of FIGS. 19-25 is illustrated in FIG. 26-32. Referring to FIG. 26, a gap filler 495 is pivotally connected to the footboard 460. Unlike the previous embodiment, however, the pivot hinge 485 is attached to the gap filler 495 at a center portion 497. The gap filler 495 functions in the same fashion as the embodiment of FIGS. 19-25, configured to block a gap created between the footboard 460 and the conventional siderail 492. In this embodiment, however, when the gap filler 495 is in the stowed position parallel to the footboard 460, the gap filler 495 substantially overlaps the footboard 460 (FIG. 31).

Figure 33:
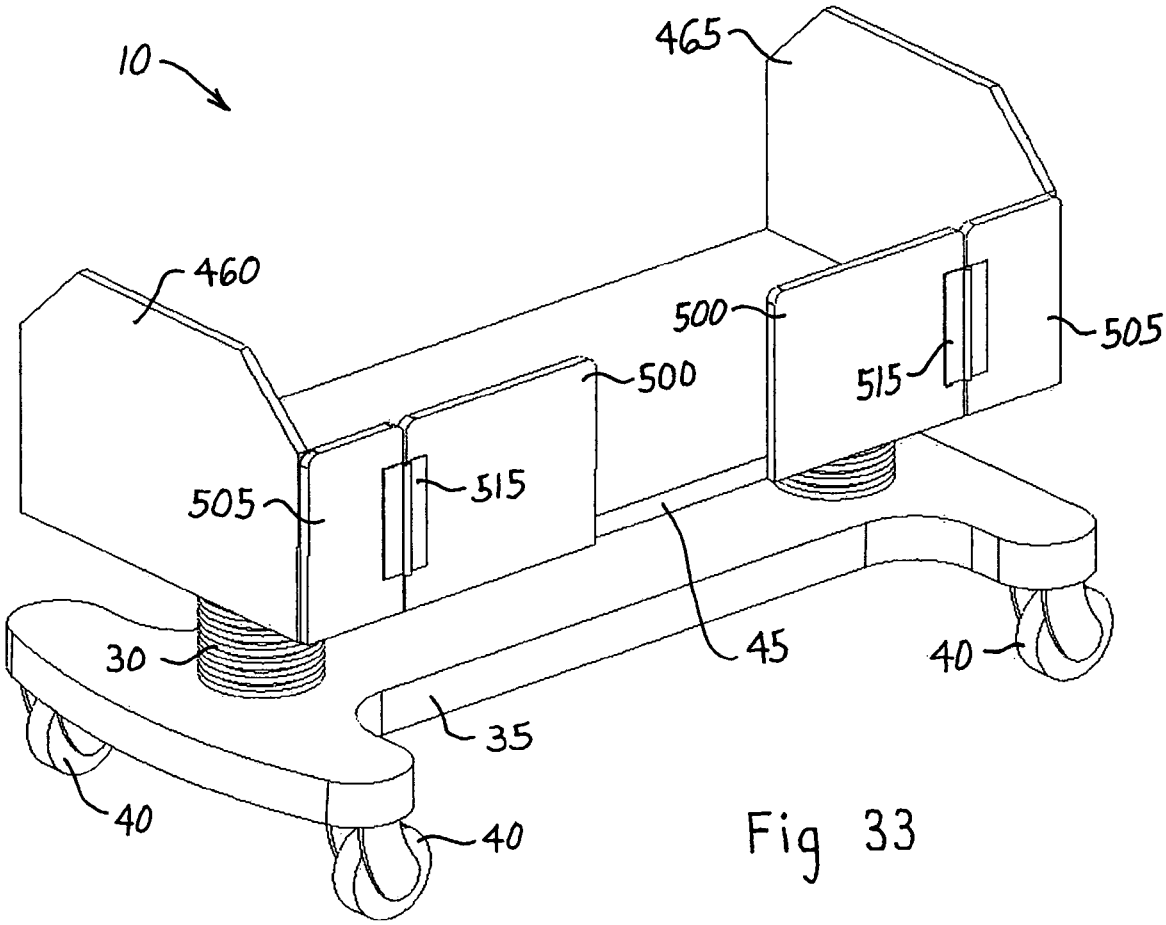
FIG. 33 is a perspective view of a bed with siderail-mounted gap fillers according to a further embodiment of the invention.
Figure 34:
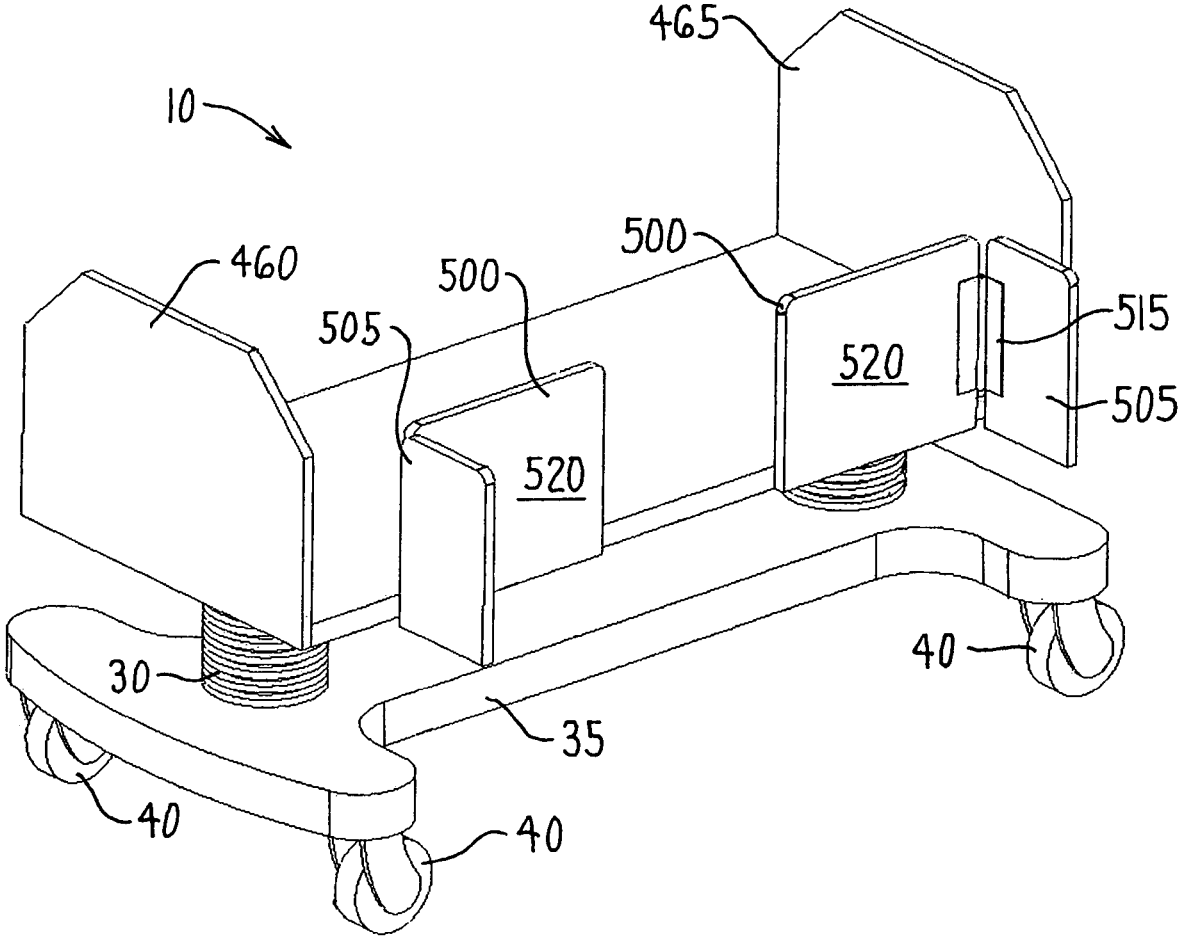
FIG. 34 is a perspective view according to FIG. 33 with the gap fillers open.

Referring to FIGS. 33-38, a bed 10 having a siderail 500 with a hinge-mounted end gap filler 505 or center gap filler 510 is illustrated. As shown in FIG. 33-34, the end gap filler 505 is pivotally mounted to the siderail 500 by a hinge 515, and is configured to fill the gap between the footboard 460 or the headboard 465 and the siderail 500. The end gap filler 505 can be rotated away from the bed 10, as shown in FIG. 34, and can be stowed flat against the outside face 520 of the siderail 500.

Figure 35:
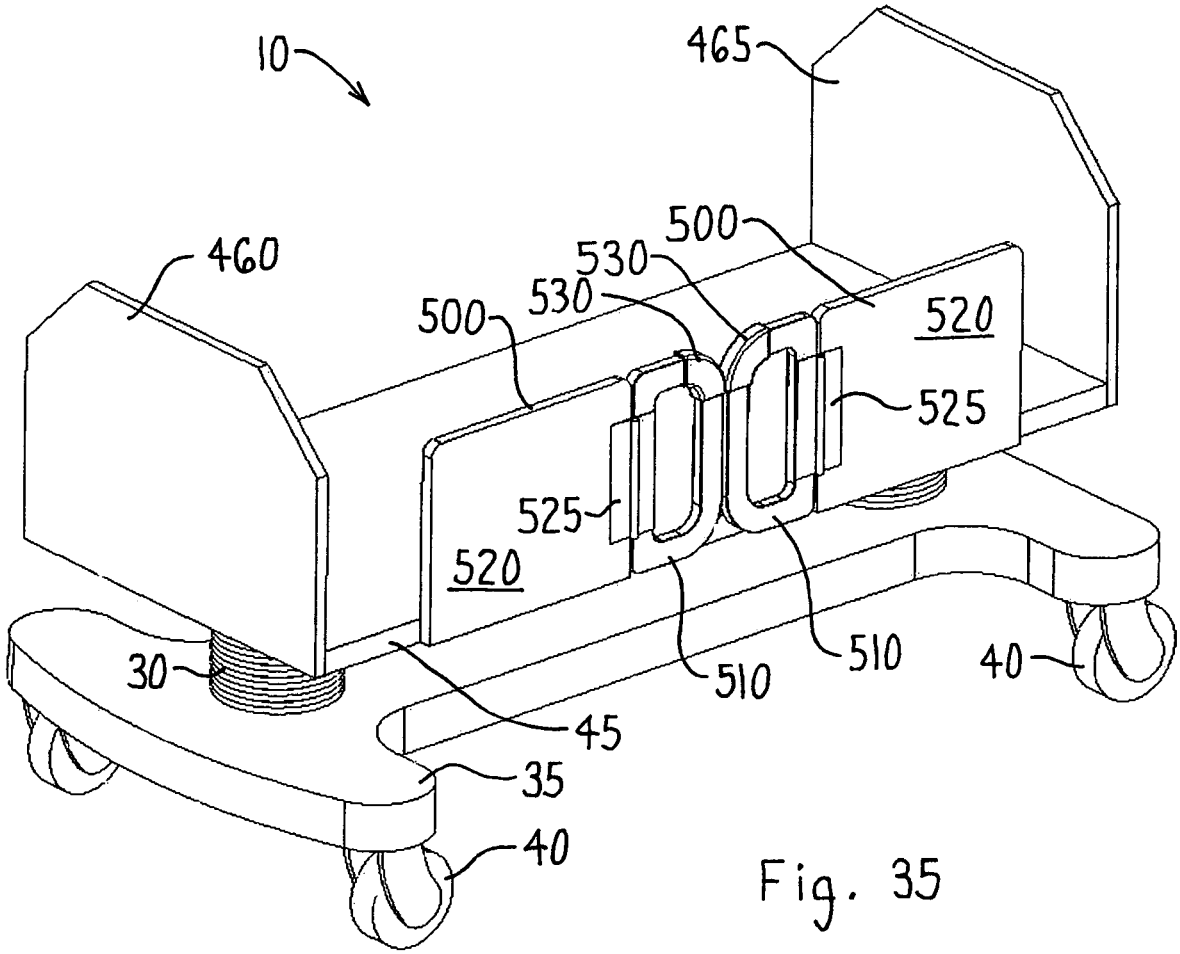
FIG. 35 is a perspective view of a bed with centrally positioned gap fillers pivotally mounted to the bed siderails according to a further embodiment of the invention.
Figure 36:
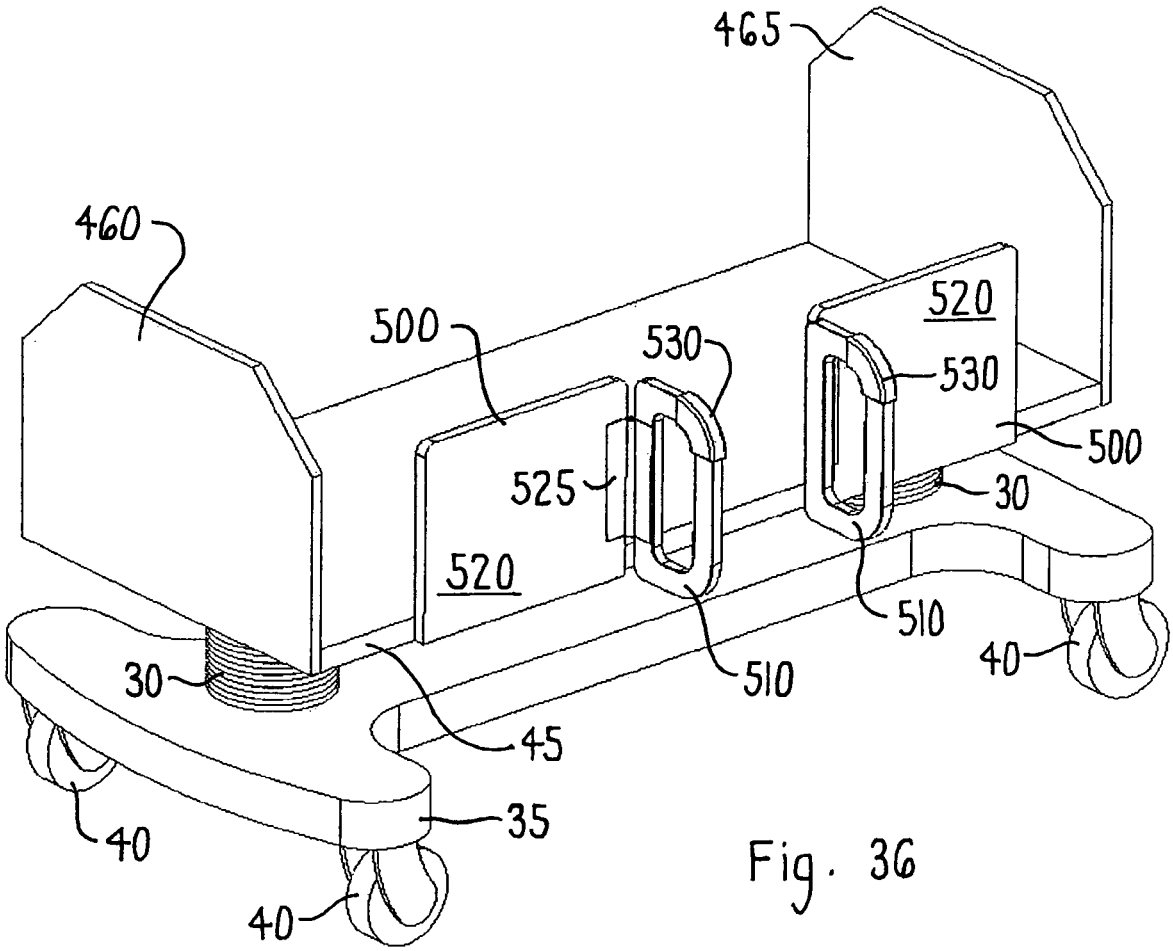
FIG. 36 is a perspective view of a bed according to FIG. 35 with the gap fillers rotated to an open position.

Referring to FIGS. 35-36, the siderail 500 with hinge-mounted center gap filler 510 is illustrated. The center gap filler 510 is pivotally mounted to the siderail 500 by a hinge 525 and is configured to cover at least a portion of the gap between adjacent siderails 500. As shown in FIG. 36, the center gap filler 510 is rotatable about the hinge 525 away from the bed 10 and can be stowed flat against the outer face 520 of the siderail 500. The center gap filler 510 is D-shaped and includes a gripping surface 530 to provide a patient handhold.

Figure 37:
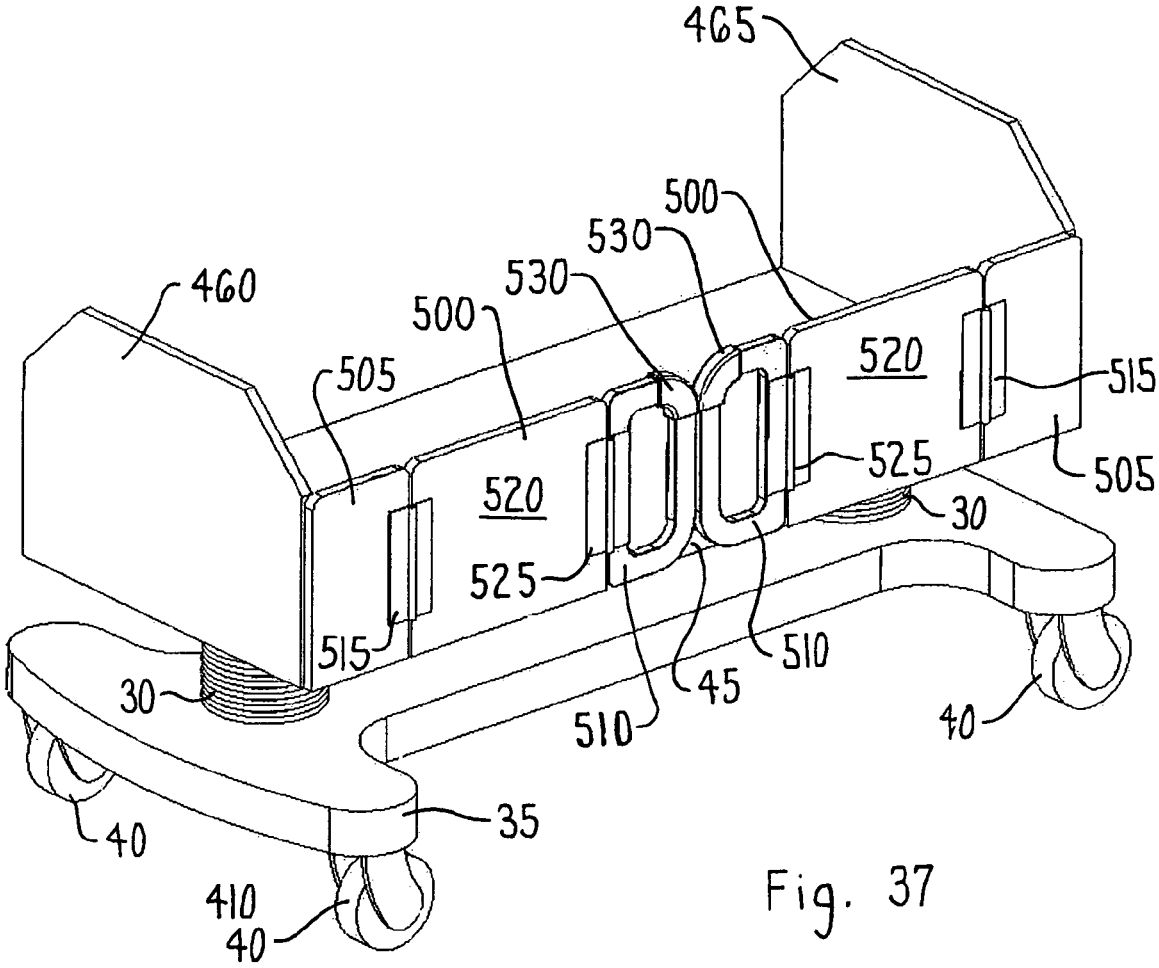
FIG. 37 is a perspective view of a bed according to FIGS. 33-36 with end and center gap fillers pivotally attached to the bed siderails.
Figure 38:
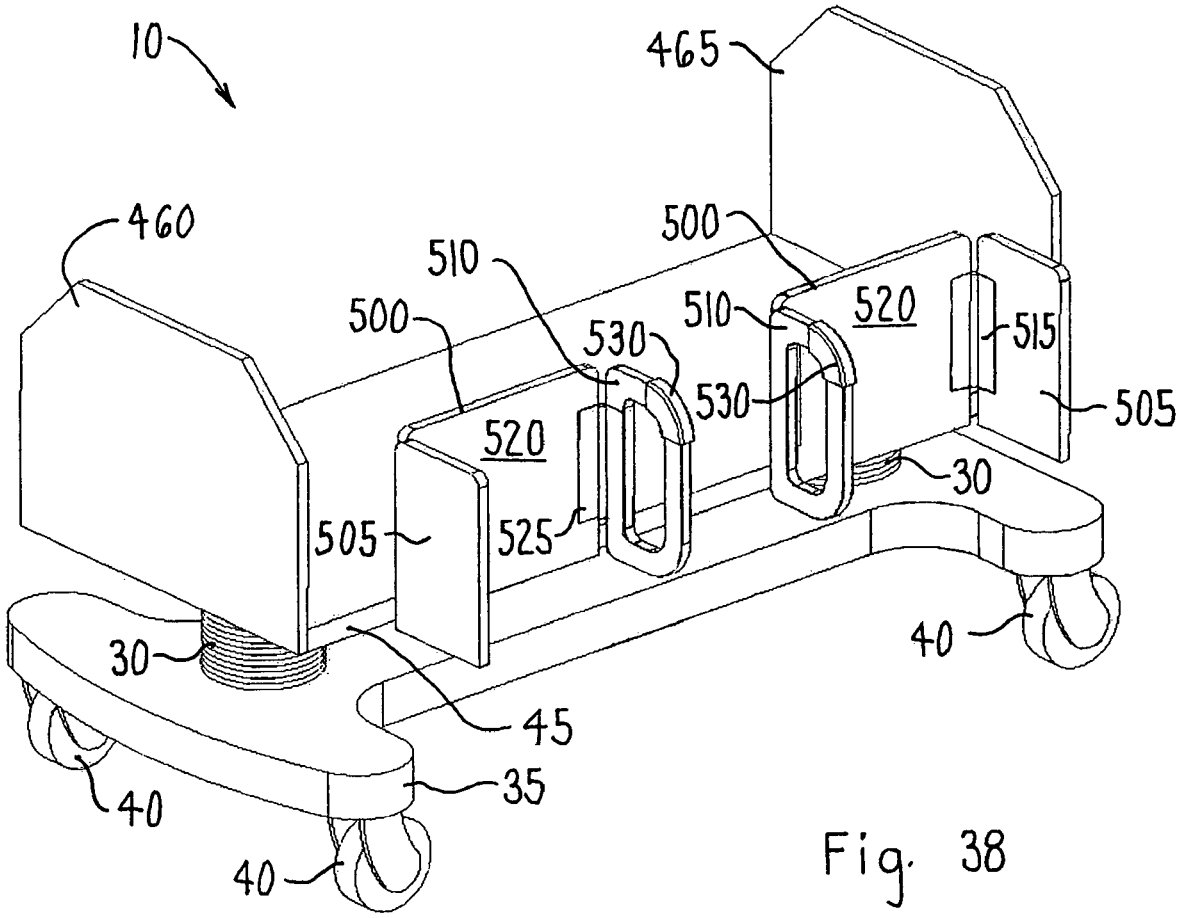
FIG. 38 is a perspective view of a bed according to FIG. 37 with the gap fillers rotated to an open position.

The siderail 500 can be configured with both the end gap filler 505 and the center gap filler 510, as shown in FIGS. 37-38. The end gap filler 505 is configured to fill the gap between each siderail 500 and the footboard 460 or the headboard 465. The center gap filler 510 is configured to fill the gap between the siderails 500.

Figure 39:
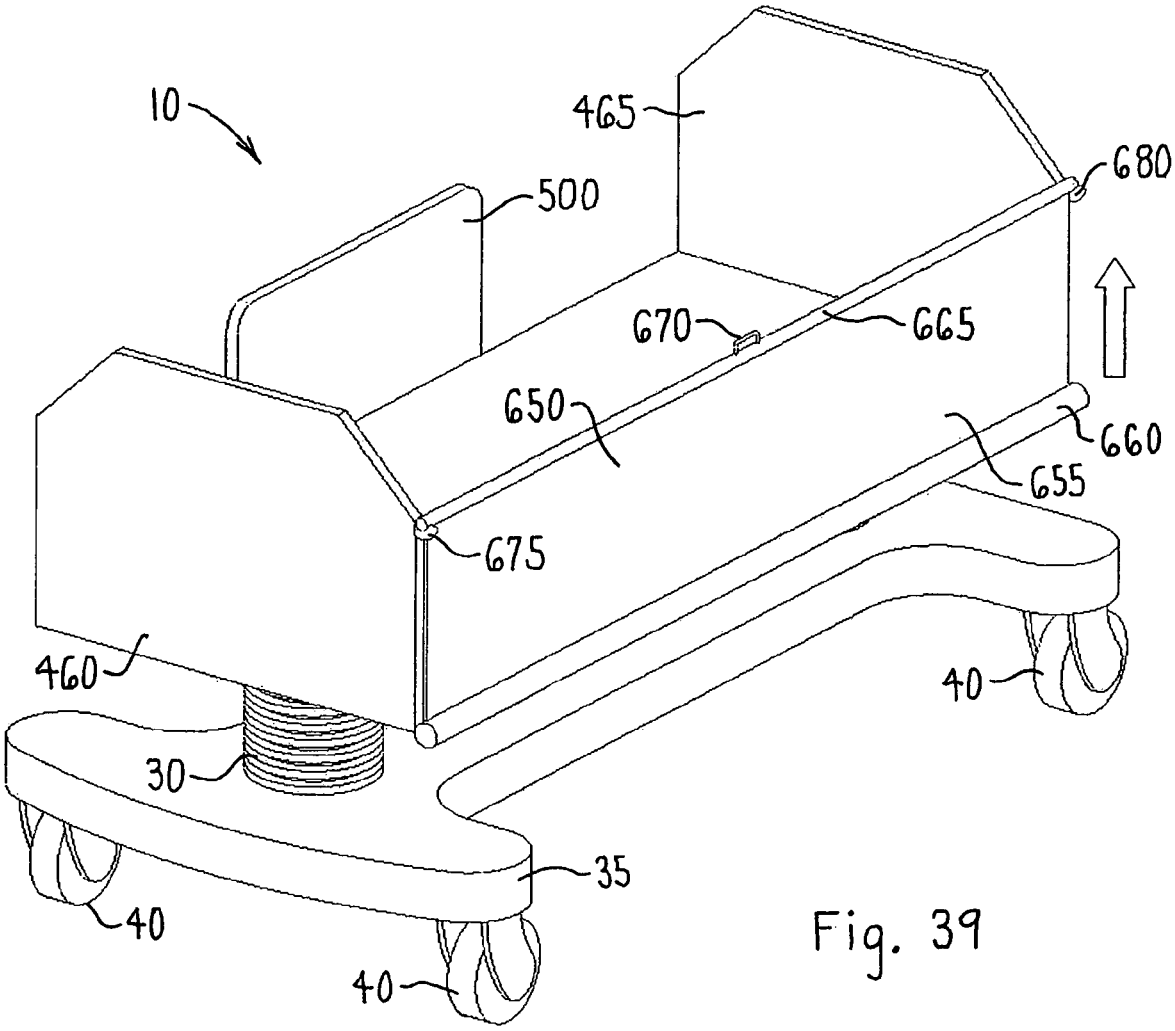
FIG. 39 is a perspective view of a bed with a continuous, window-shade style siderail according to a further embodiment of the invention.
Figure 40:
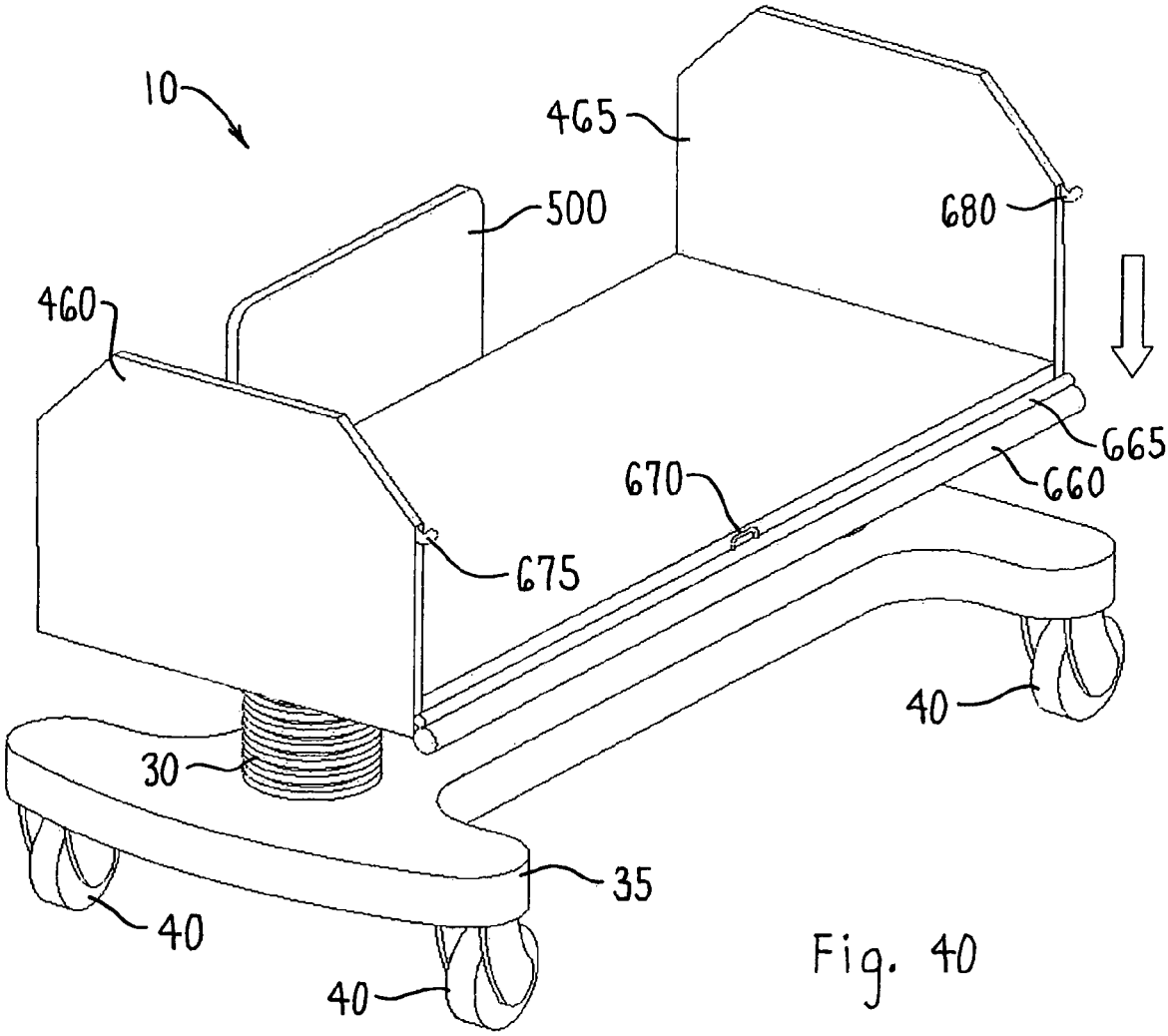
FIG. 40 is a perspective view of a bed according to FIG. 39 with the siderail in the retracted position.

Referring to FIGS. 39-40, a further embodiment of a siderail 650 is illustrated, configured for continuous coverage of the side of the bed 10. The siderail 650 comprises a window-shade type fabric 655 retractable onto a spool 660 secured to the bed frame side rail 45, and a horizontal rod 665 having a handle 670 for raising or lowering the siderail 650. A catch 675, 680 is mounted to each of the footboard 460 and the headboard 465 of the bed 10. As shown in FIG. 39, the siderail 650 is secured in a deployed position. In the deployed position, the horizontal rod 665 is supported on the catches 675, 680. FIG. 40 illustrates the stowed position, where in the fabric 655 is retracted into the spool 660.

Figure 41:
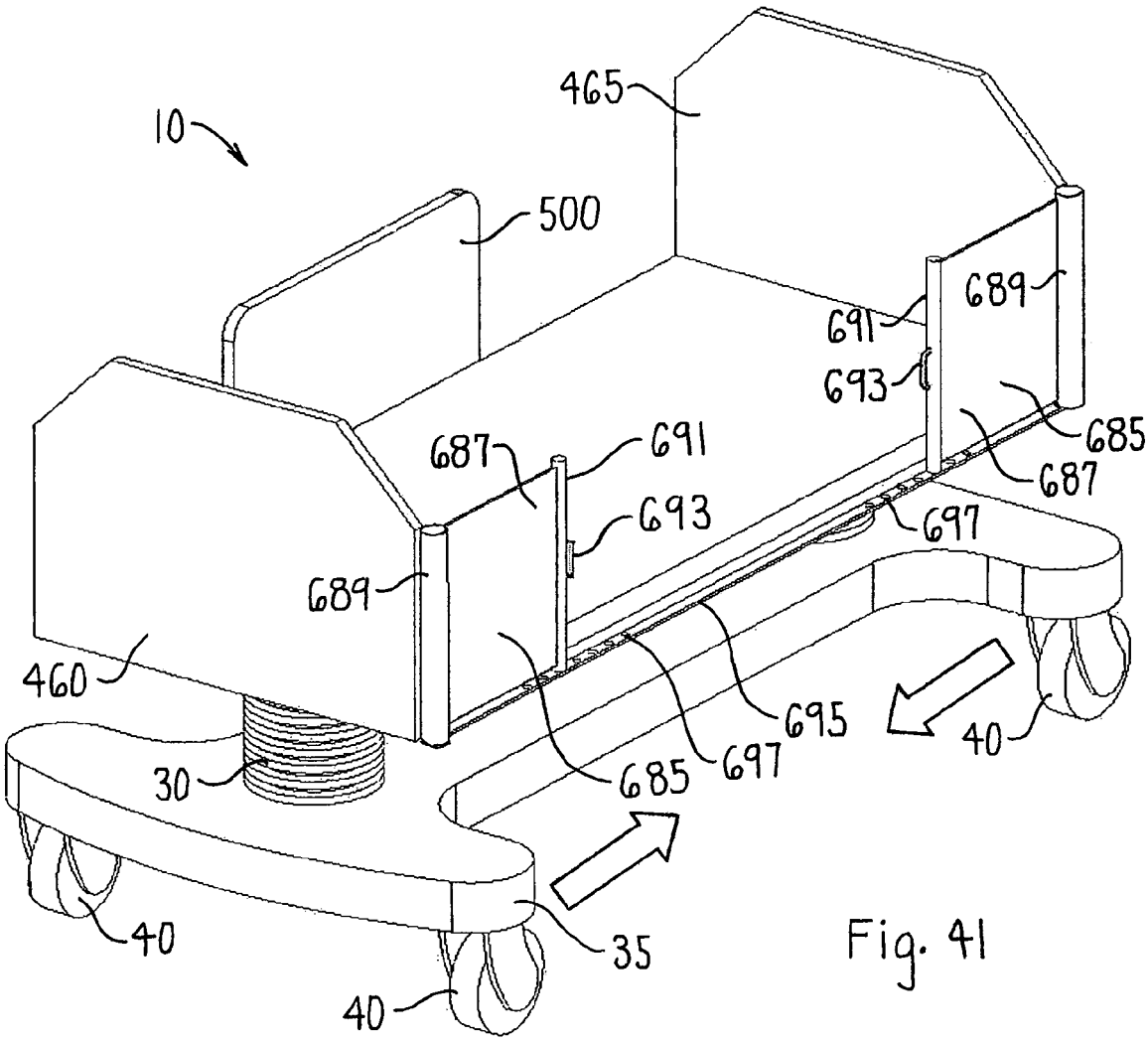
FIG. 41 is a perspective view of a bed with horizontally-extending window-shade style siderails according to a further embodiment of the invention.
Figure 42:
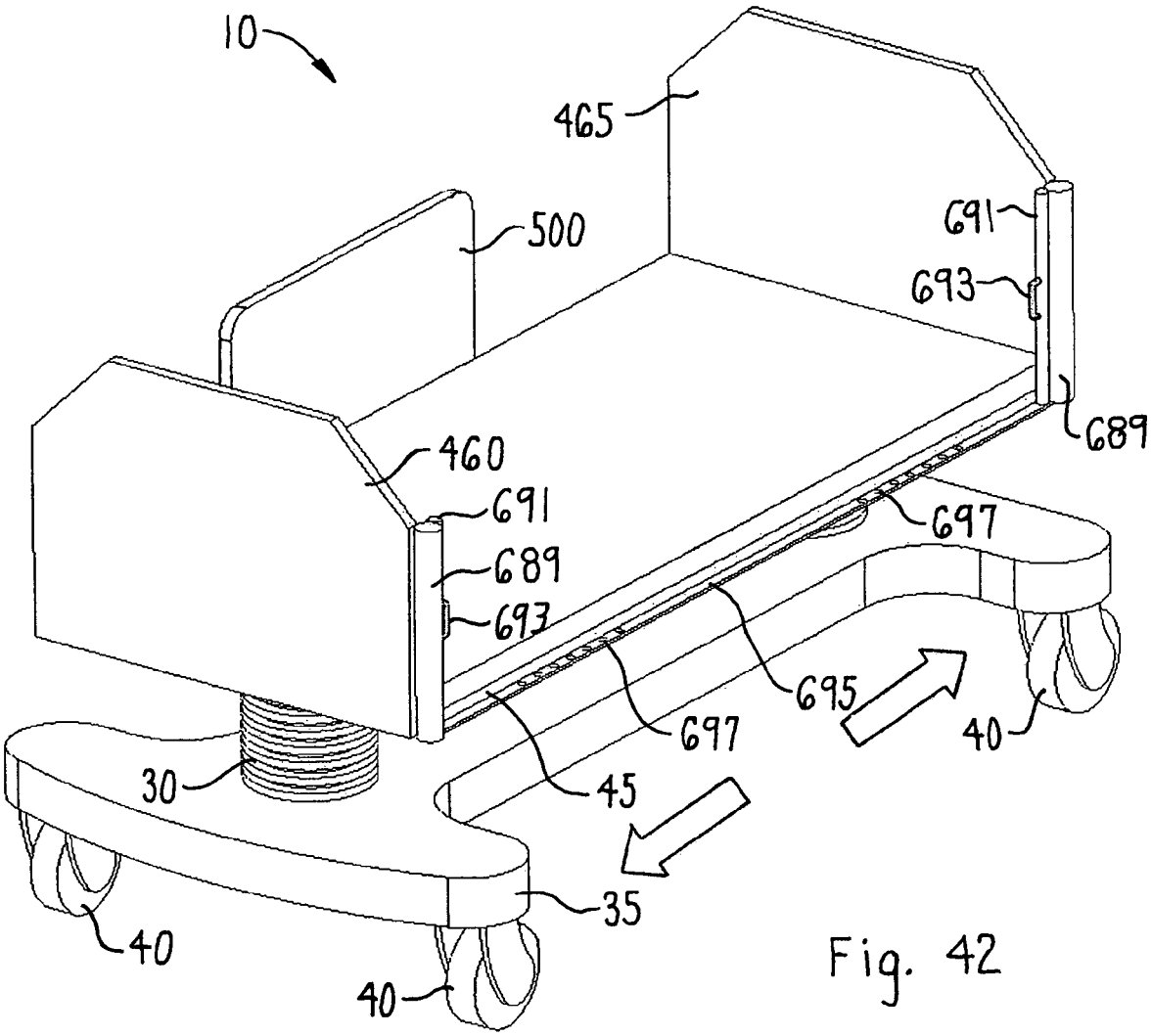
FIG. 42 is a perspective view of a bed according to FIG. 41 with the siderails in the retracted position.
Figure 43:
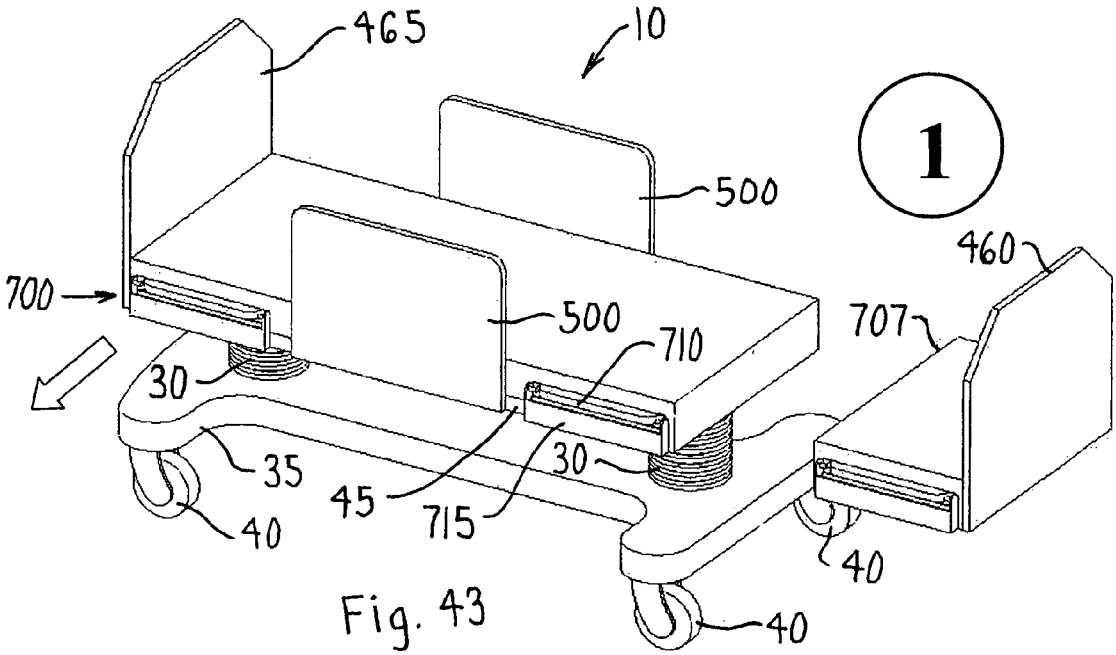
FIG. 43 is a perspective view of a bed and bed extension with frame-mounted gap filler according to a further embodiment of the invention.
Figure 44:
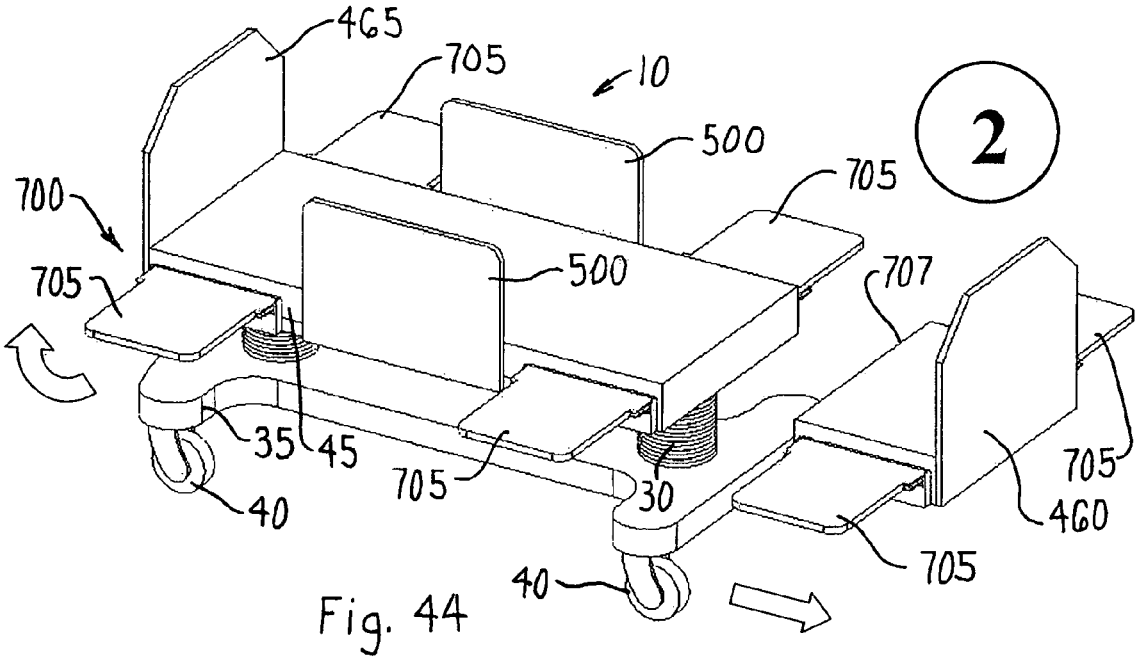
FIG. 44 is a perspective view according to FIG. 43 with the gap filler in a horizontally extended position.
Figure 45:
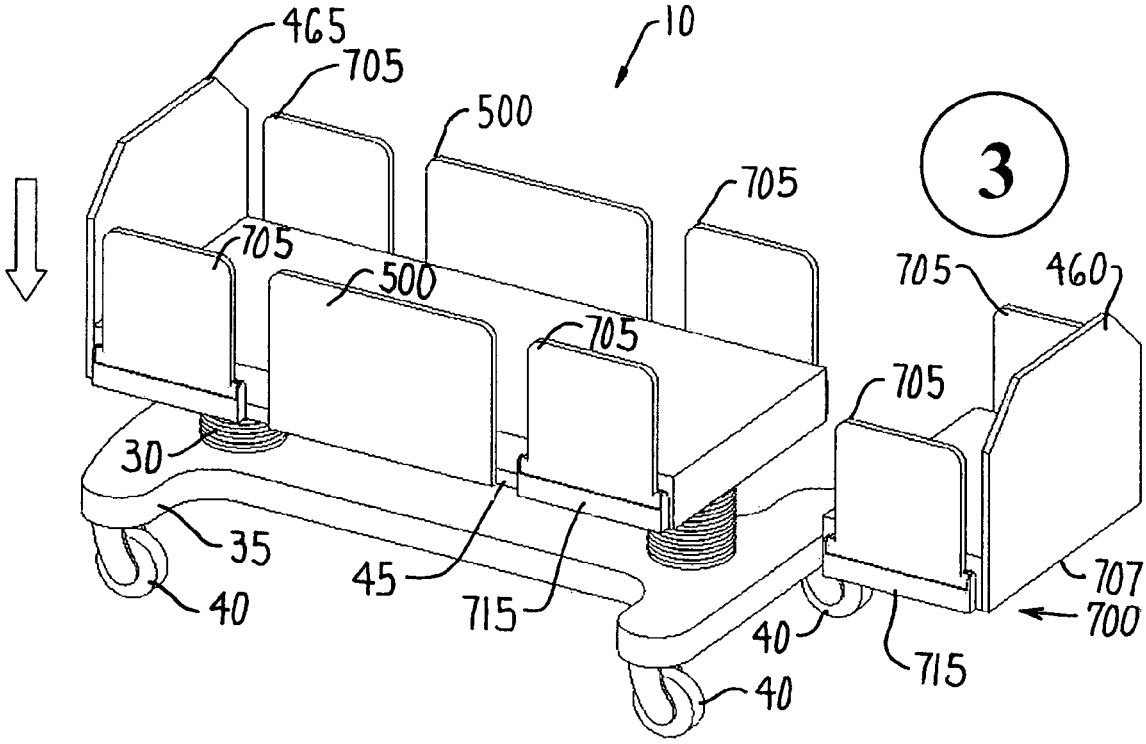
FIG. 45 is a perspective view of the bed according to FIGS. 43-44 with the gap fillers in the vertically extended position.
Figure 46:
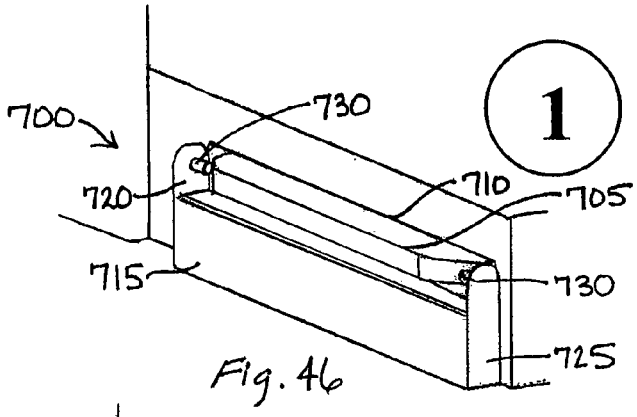
FIG. 46 is an enlarged perspective view of a gap filler according to FIGS. 43-45 in the stowed position.
Figure 47:
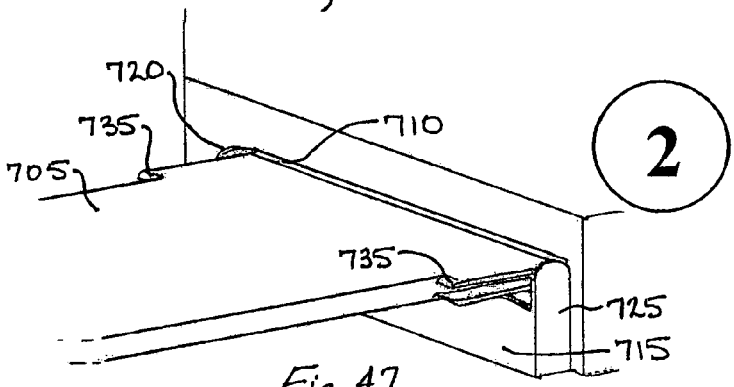
FIG. 47 is an enlarged perspective view of the gap filler according to FIGS. 43-46 in the horizontally extended position.
Figure 48:
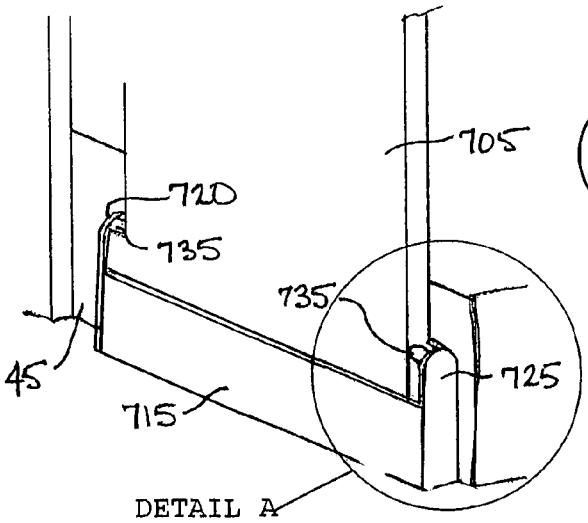
FIG. 48 is an enlarged perspective view of the gap filler according to FIGS. 43-47 with the gap filler in the vertically extended position.
Figure 49:
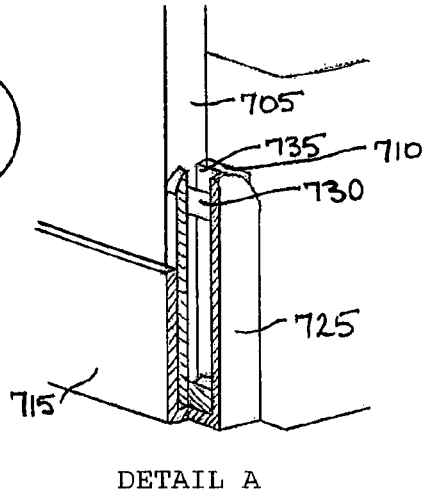
FIG. 49 is an enlarged detail view of a vertical locking mechanism of the gap filler according to FIGS. 43-48.

Referring to FIGS. 41-42, a further embodiment of a gap filler 685 is illustrated. The gap filler 685 comprises a window-shade-type fabric 687 coiled on a spool 689 and including a terminal rod 691 having a handle 693. The spool 689 is mounted vertically adjacent either the footboard 460 or headboard 465 (or both) of the bed 10, in alignment with the bed frame side rail 45. A perforated rail 695 having a plurality of apertures 697 is mounted adjacent the bed frame side rail 45, the apertures configured to receive an end of the terminal rod 691. As shown in FIG. 41, the gap filler 687 can be extended from the footboard 460 or headboard 465, the fabric 687 filling the gap adjacent the footboard 460 or headboard 465, with the terminal rod 691 anchoring the gap filler 687 by receipt in one of the apertures 697. The gap filler 687 extends from the footboard or headboard to provide continuous coverage along the bed frame side rail 45 in conjunction with the conventional siderail 500. When not in use, the gap filler 687 is stored vertically on the spool 689 at the headboard 460 or footboard 465, as shown in FIG. 42.

Referring now to FIGS. 43-49, the bed 10 is provided with a further embodiment of a gap filling system 700 comprising a plurality of rigid planar gap fillers 705. The gap fillers 705 are stowed horizontally underneath the bed surface or an auxiliary, removable, or stowable optional bed extender 707, and are configured for deployment through openings 710 in the bed frame side rail 45.

Referring to FIGS. 46-49, a base cavity 715 configured for receiving the gap filler 705 is formed on the bed frame side rail 45 and positioned below each opening 710. The base cavity 715 includes a pair of upstanding sidewalls 720, 725. Each sidewall 720, 725 includes an inwardly directed guide pin 730. The span between the guide pins 730 provides sufficient clearance for the gap filler 705 to be drawn through the opening 710. As the gap filler 705 is drawn through the opening 710, guide slots 735 formed in the edges of the gap filler 705 are exposed and engage the guide pins 730. The guide slots 735 terminate at the end of the gap filler 705. When the gap filler 705 is withdrawn from the opening 710 so that the guide pins 730 bottom out in the guide slots 735, the gap filler is configured to be rotatable to a vertical orientation. Once vertical, the gap filler 705 is configured to drop into the base cavity 715 and form a wall parallel to the bed frame side rail 45.

Figure 50:
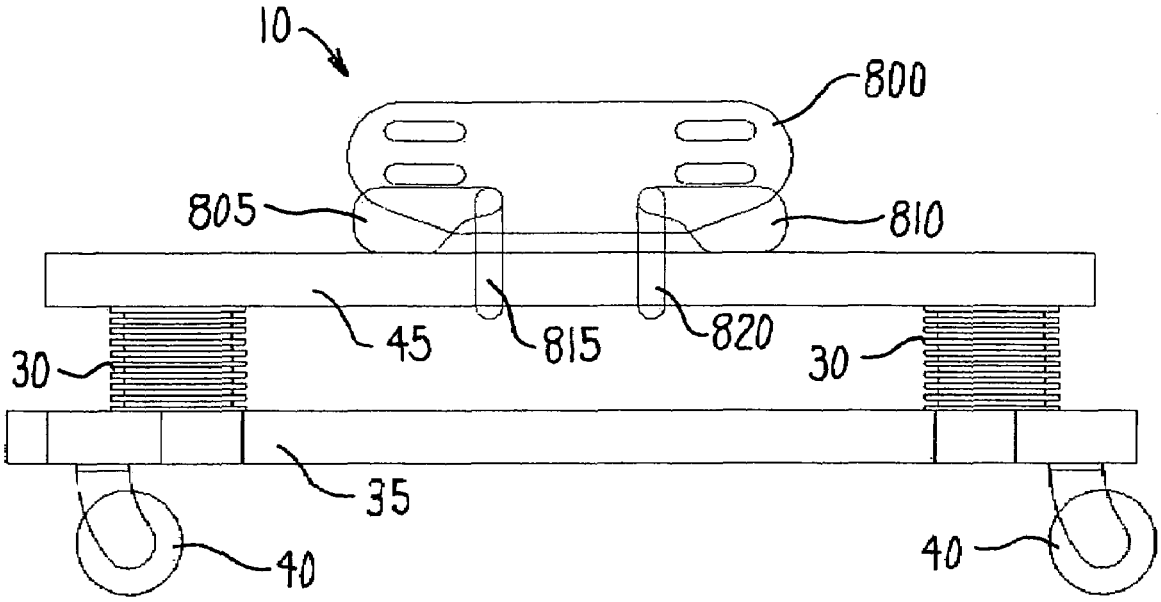
FIG. 50 is a side view of a bed with siderail and vertically acting gap filler according to a further embodiment of the invention.
Figure 51:
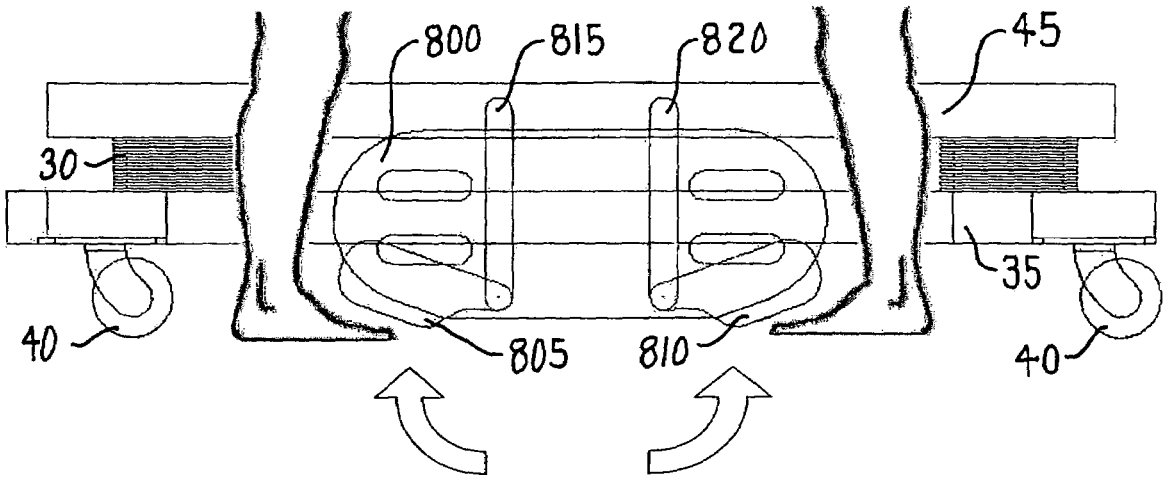
FIG. 51 is a side view of a bed with siderail according to FIG. 50 with the siderail in the stowed position.
Figure 52:
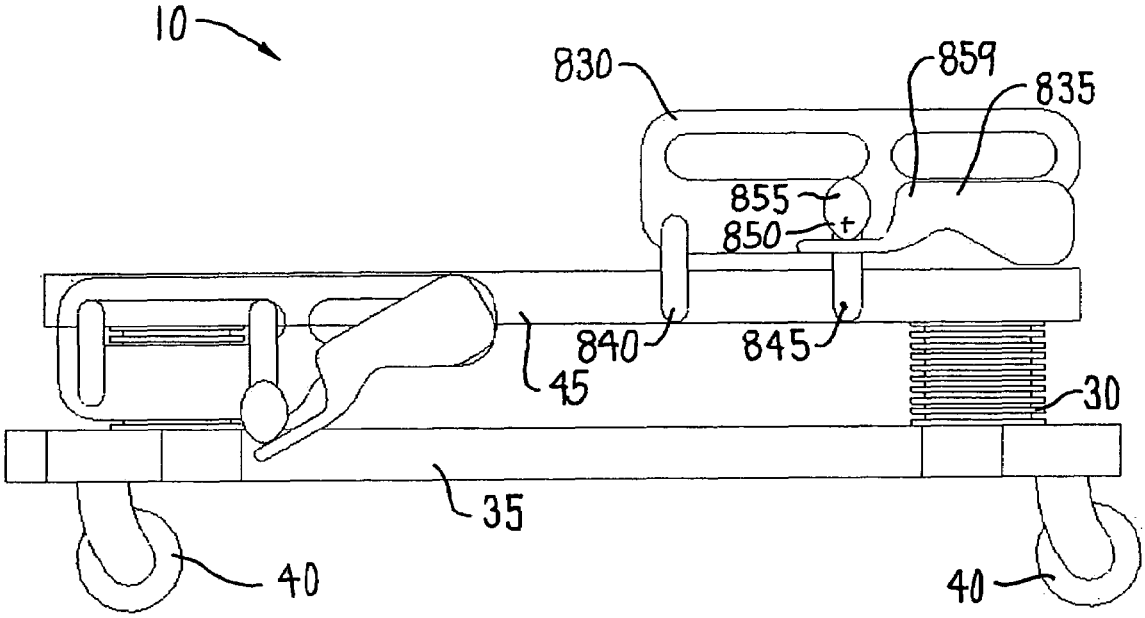
FIG. 52 is a side view of a bed with pivoting siderail and cam-activated gap filler according to a further embodiment of the invention.

FIGS. 50-51 illustrate a siderail 800 with free-hanging gap fillers 805, 810. The siderail 800 is pivotally connected to the bed frame side rail 45 by a pair of support arms 815, 820. In the deployed, use position of FIG. 50, the gap fillers 805, 810 are pivotally mounted to the siderail 800 and hang freely to a horizontal orientation between the siderail 800 and the bed 10. Referring to FIG. 51, when the siderail 800 is in a lowered or stowed position proximate the floor surface supporting the bed 10, the gap fillers 805, 810 are likewise positioned horizontally, proximate the floor surface. The gap fillers 805, 810 being free-hanging, should the bed be moved and encounter a low-lying obstacle, or should an attendant approach the lowered siderail 800, the gap filler 805, 810 is free to lift rather than wedge the obstacle or the foot of the attendant against the floor. The gap fillers 805, 810 are therefore configured to fill a gap between the siderail and the bed surface, and further configured for ready displacement upon contacting an object while in the stowed position.

Figure 53:
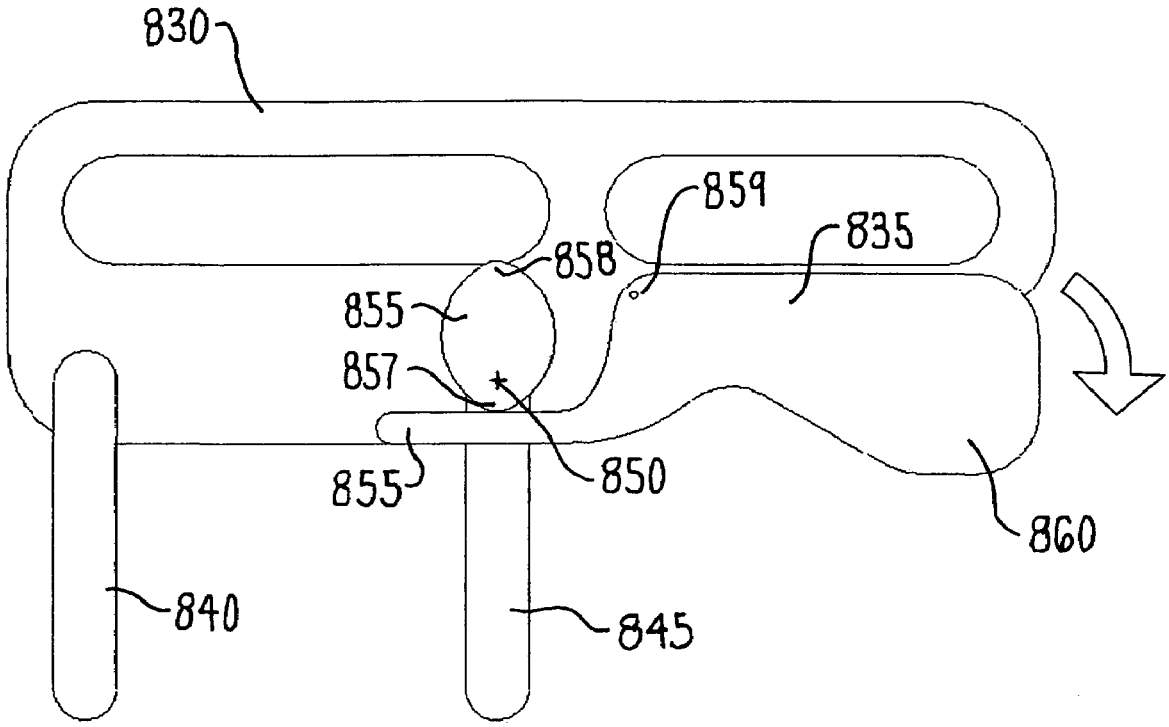
FIG. 53 is a side view of a siderail according to FIG. 52 in the deployed, use position.
Figure 54:
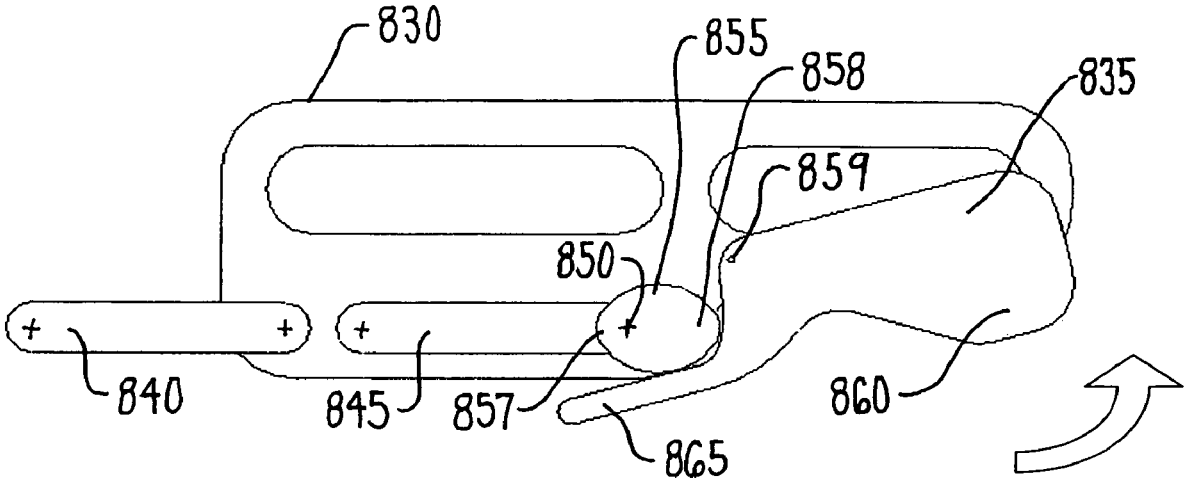
FIG. 54 is a side view of the siderail of FIGS. 52-53 in a partially stowed position.
Figure 55:
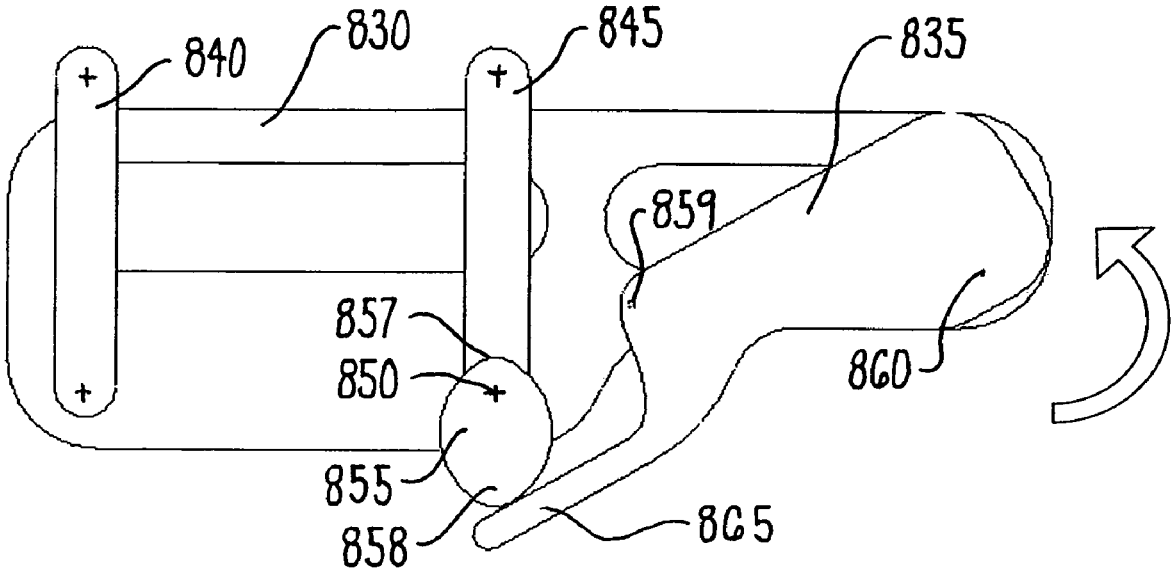
FIG. 55 is a side view of the siderail of FIGS. 52-54 in the stowed position.

FIGS. 52-55 illustrate a siderail 830 having a cam-activated gap filler 835. The siderail 830 is pivotally mounted to the bed frame side rail 45 by a pair of support arms 840, 845. The support arm 845 has an upper pivot shaft 850, to which a football-shaped cam 855 is eccentrically mounted. Referring to FIG. 53, the cam 855 includes a minor lobe 857 and a major lobe 858. The cam-activated gap filler 835 is pivotally mounted to the siderail 830 by a pivot pin 859 and includes a gap filling portion 860 and a lever arm portion 865. The gap filler 835 and cam 855 are arranged on the siderail 830 so that the cam 855 can act upon the lever arm portion 865 of the gap filler 835. With the siderail 830 in the deployed, use position of FIG. 53, the cam 855 is oriented so that the minor lobe 857 is directed downwardly toward the lever arm portion 865 of the gap filler 835. The gap filling portion 860 of the gap filler 830 is thereby free to hang under gravity to its lowermost position to fill a gap between the siderail 830 and the bed 10. Referring to FIGS. 53-55, as the siderail 830 rotates from the deployed, use position to a stowed position (FIG. 55), an increasing radius of the cam 835 is directed toward the lever arm portion 865 of the gap filler 835. As the siderail 830 reaches the stowed position, the major lobe 858 of the cam 855 is directed to the lever arm portion 865 of the gap filler 835, raising the gap filling portion 860 to its uppermost, stowed position.

Figure 56:
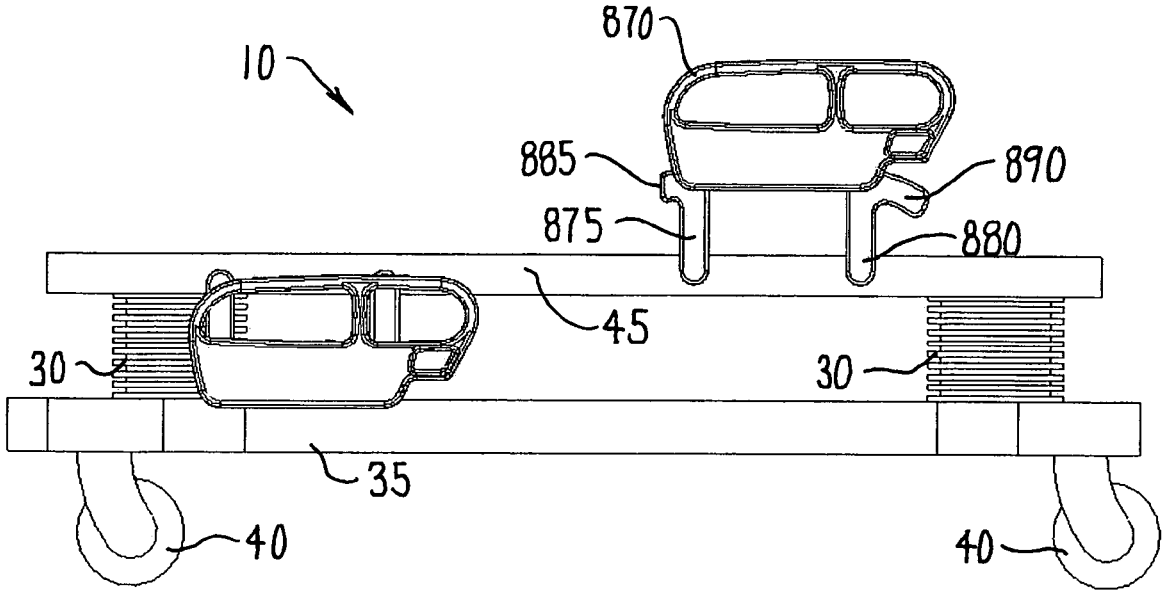
FIG. 56 is a side view of a bed with siderail having integrally formed gap filler according to a further embodiment of the invention.
Figure 57:
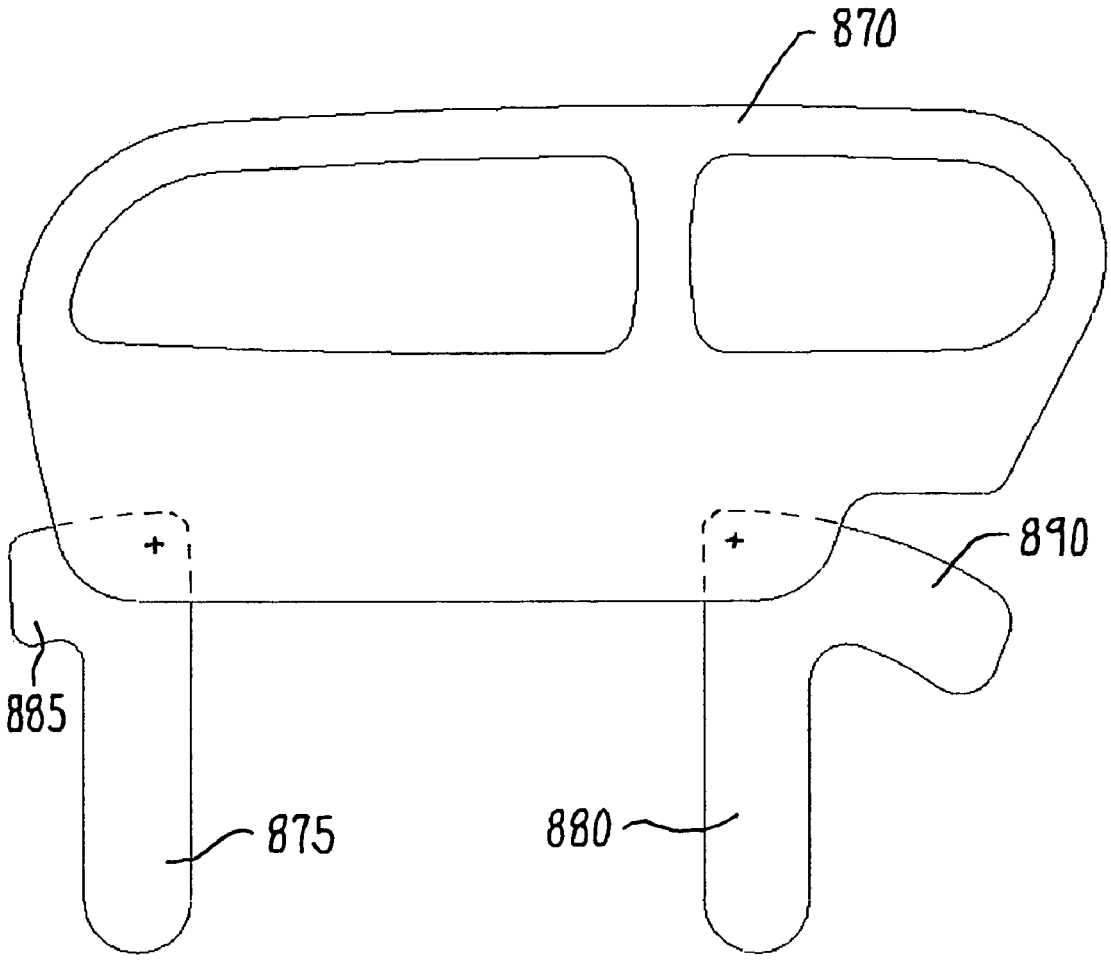
FIG. 57 is a side view of a siderail according to FIG. 56 in a deployed, use position.
Figure 58:
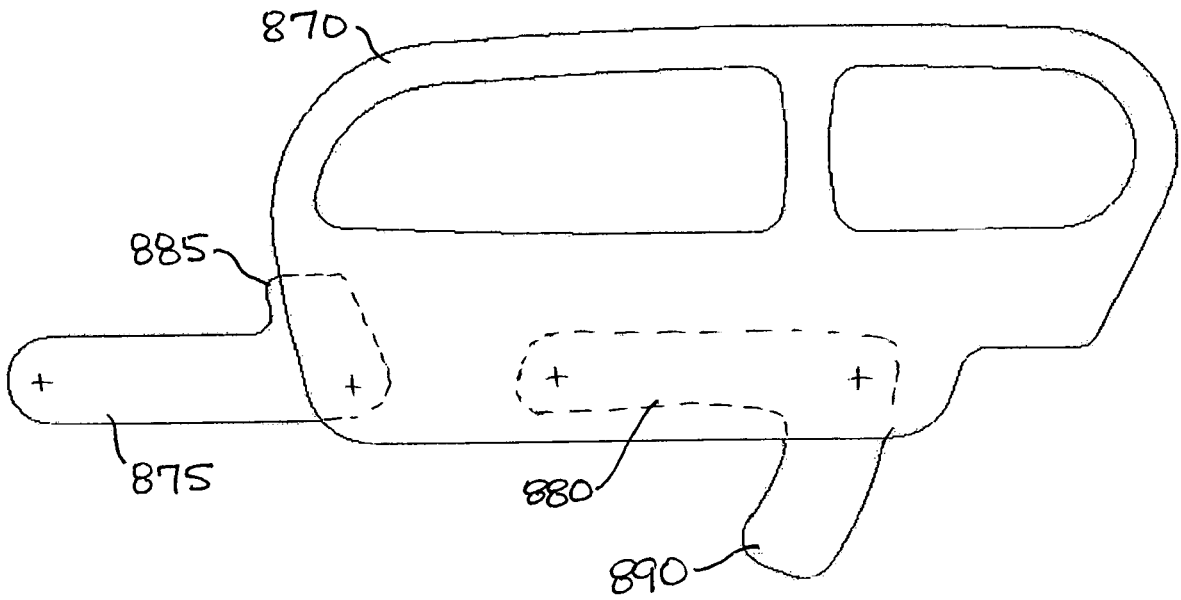
FIG. 58 is a side view of a siderail according to FIGS. 56-57 in a partially stowed position.
Figure 59:
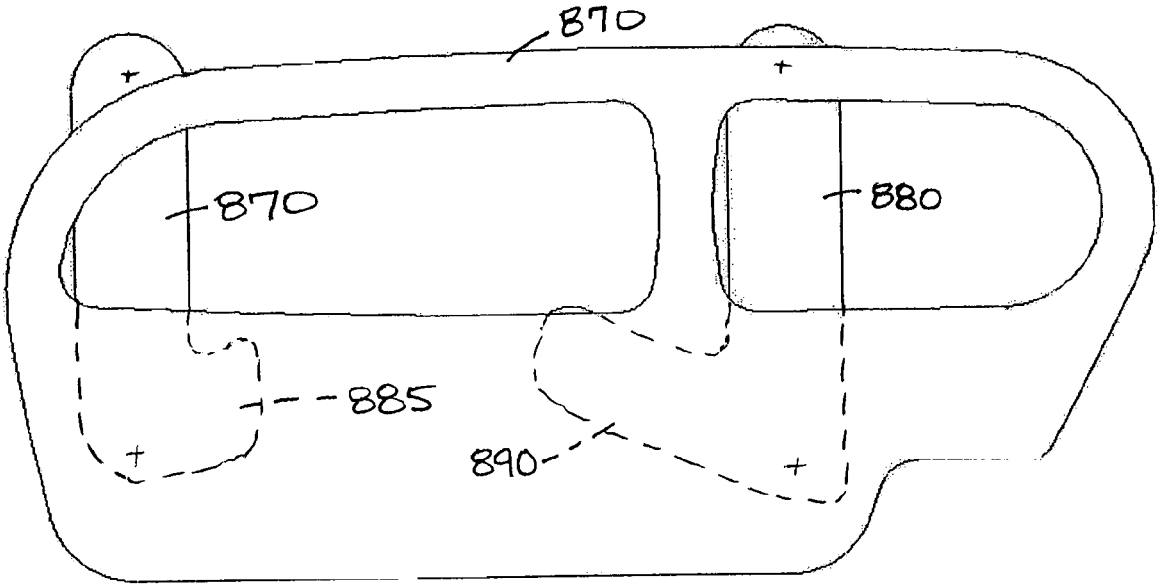
FIG. 59 is a side view of a siderail according to FIGS. 56-58 in the stowed position.
Figure 60:
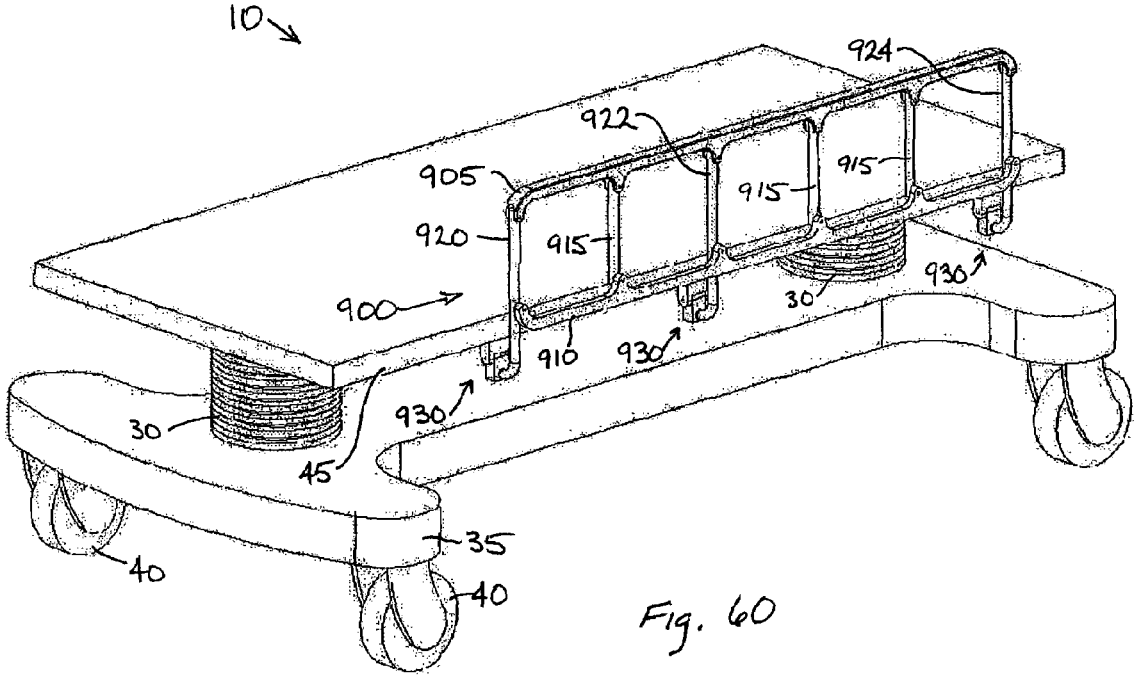
FIG. 60 is a perspective view of a bed having a pivotally extending, stowable siderail according to a further embodiment of the invention.
Figure 61:
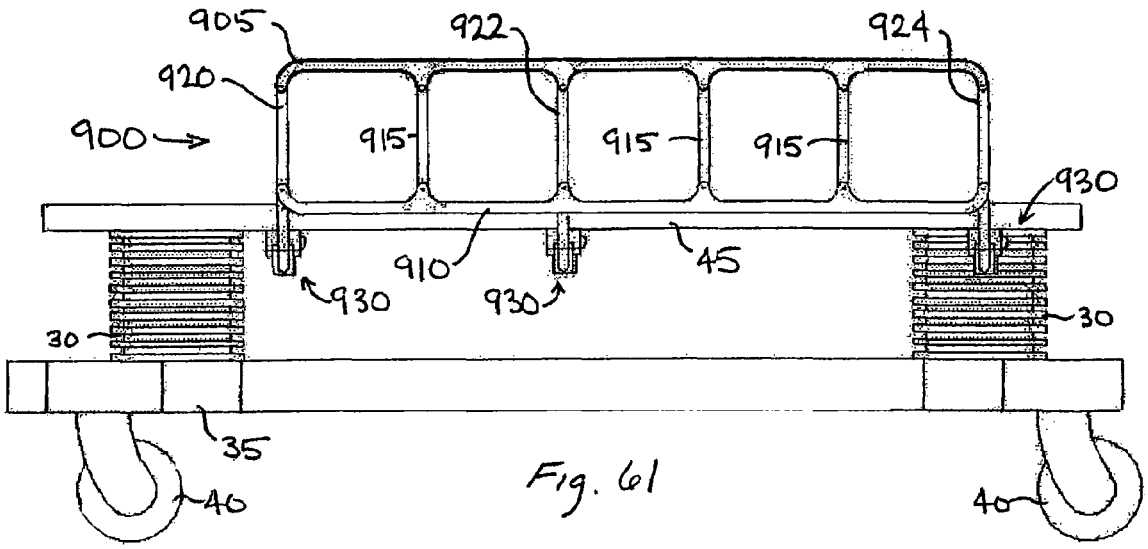
FIG. 61 is a side view of the bed with siderail in the deployed, use position according to FIG. 60.

FIGS. 56-59 disclose a siderail 870 pivotally mounted to a bed frame side rail 45 by a pair of support arms 875, 880. The support arms 875, 880 are generally L-shaped, thereby integrally including a gap filling portion 885, 890 respectively. Each gap filling portion 885, 890 is a lateral extension of the respective support arm 875, 880 of the siderail 870, and is configured to occupy a gap between the siderail 870 and the bed 10 when the siderail 870 is in the deployed, use position, as shown in FIGS. 56-57. Referring to FIGS. 58-59, as the siderail 870 is lowered from the deployed, use position to a stowed position, the support arms 875, 880 rotate so that the gap filling portions 885, 890 are concealed behind the siderail 870.

A further embodiment of a siderail 900 is illustrated in FIGS. 60-76. The siderail 900 includes an upper horizontal rail 905 and a lower horizontal rail 910, with the upper and lower horizontal rails 905, 910 connected by a plurality of spindles 915. The spindles 915 are pivotally connected to both the upper and lower horizontal rails 905, 910.

The siderail 900 further includes a plurality of support arms 920, 922, 924 pivotally connected to the upper and lower horizontal rails 905, 910. The support arms 920, 922, 924 are parallel to each other and to the spindles 915 so that the siderail 900 is collapsible in the sense of an extended four-bar linkage.

Figures 69, 70:
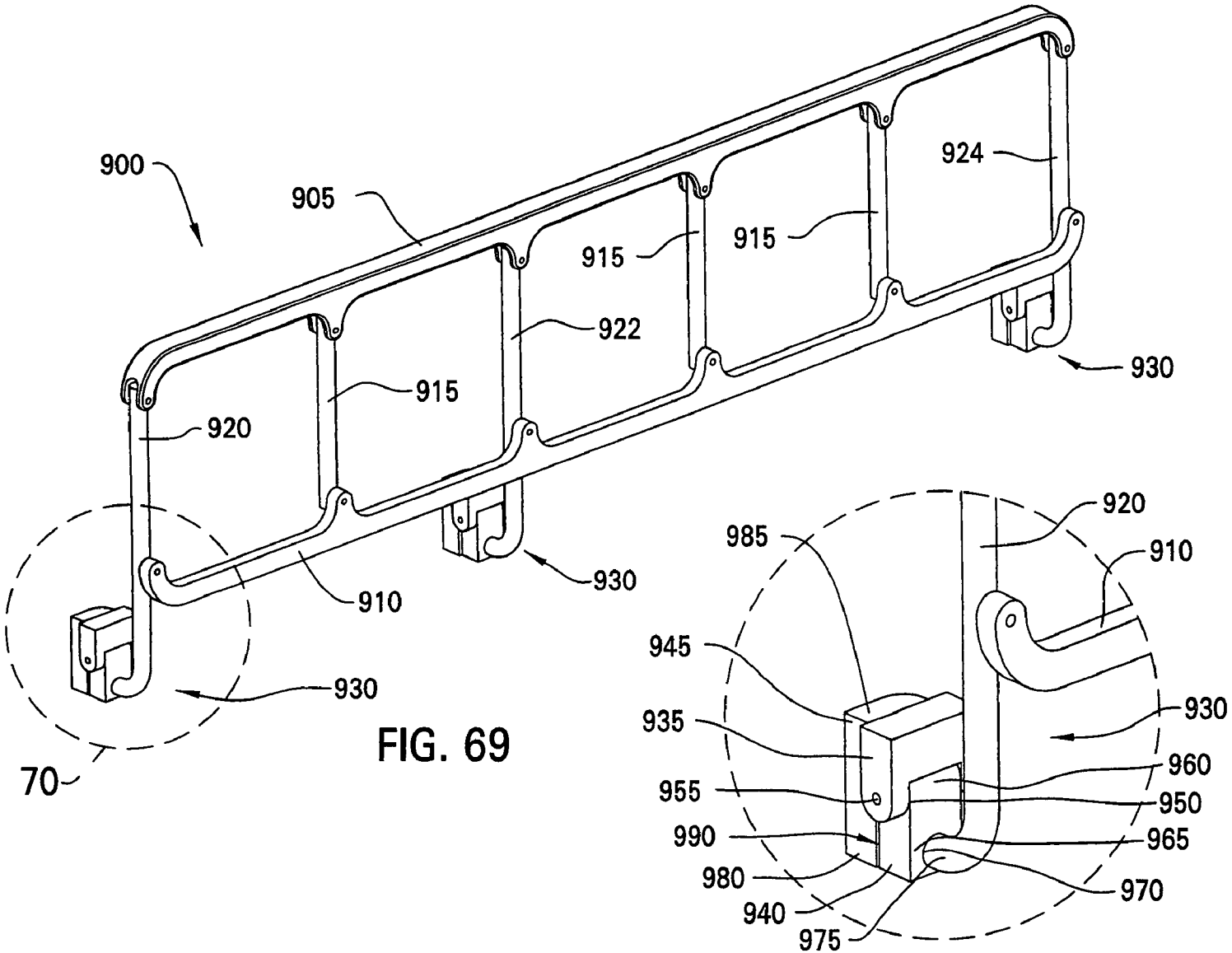
FIG. 69 is a perspective view of the siderail according to FIGS. 60-68.
FIG. 70 is an enlarged perspective view of a mounting mechanism of the siderail according to FIGS. 60-69.
Figure 71:
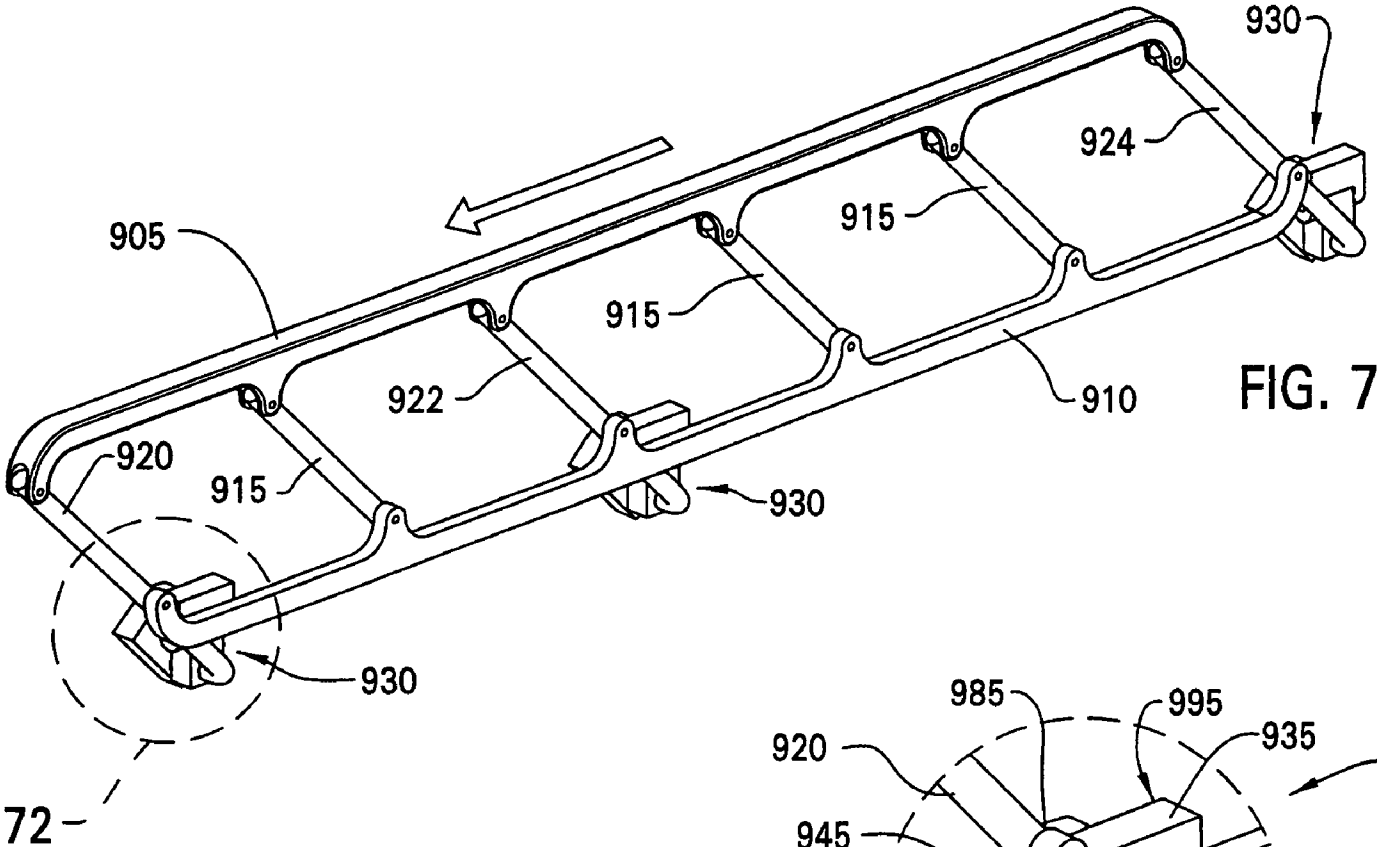
FIG. 71 is a perspective view of the siderail according to FIGS. 60-70 in the partially folded position.
Figure 72:
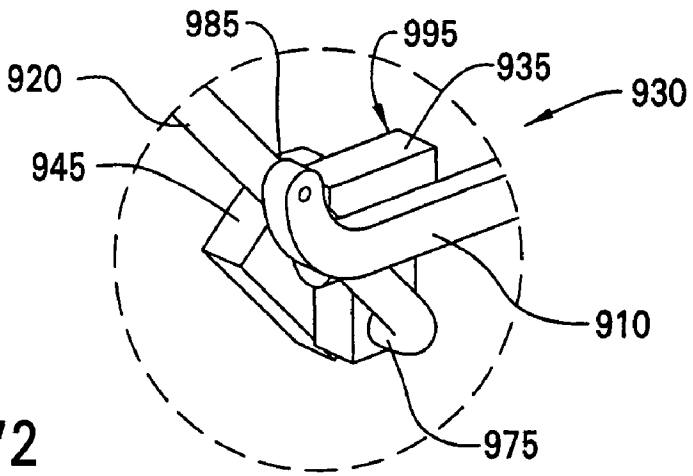
FIG. 72 is an enlarged detail view of the mounting mechanism of the siderail according to FIGS. 60-71 in the partially folded position.

The support arms 920, 922, 924 are further pivotally connected to a mounting assembly 930 secured to an underside of the bed frame side rail 45 (see FIG. 70). The mounting assembly 930 includes a hinge block 935, a pivot block 940 and a wedge block 945. The hinge block 935 is configured for mounting to the bed frame side rail 45 and includes a pivot cutout 950 and a pivot pin 955. The pivot block 940 includes a pivot portion 960 and a mount portion 965 having a through aperture 970. Each support arm 920, 922, 924 includes an inwardly turned base extension 975. The wedge block 945 is L-shaped, having a base portion 980 and a leg portion 985 (see FIG. 76).

The pivot cutout 950 of the hinge block 935 is configured to receive the pivot portion 960 of the pivot block 940, with the pivot pin 955 pivotally connecting the pivot block 940 to the hinge block 935. With the siderail 900 in the upright position, the pivot block 940 depends directly below the hinge block 935. The through aperture 970 of the pivot block 940 is configured to receive the base extension 975 of one of the support arms 920, 922, 924 therethrough. The respective support arm 920, 922, 924 is thereby pivotally connected to the pivot block 940 by the base extension 975. The base extension 975 is configured to connect to the wedge block 945, with the base portion 980 of the wedge block 945 fixedly mounted to the base extension 975, against an inside face 990 of the pivot block 940.

Figure 62:
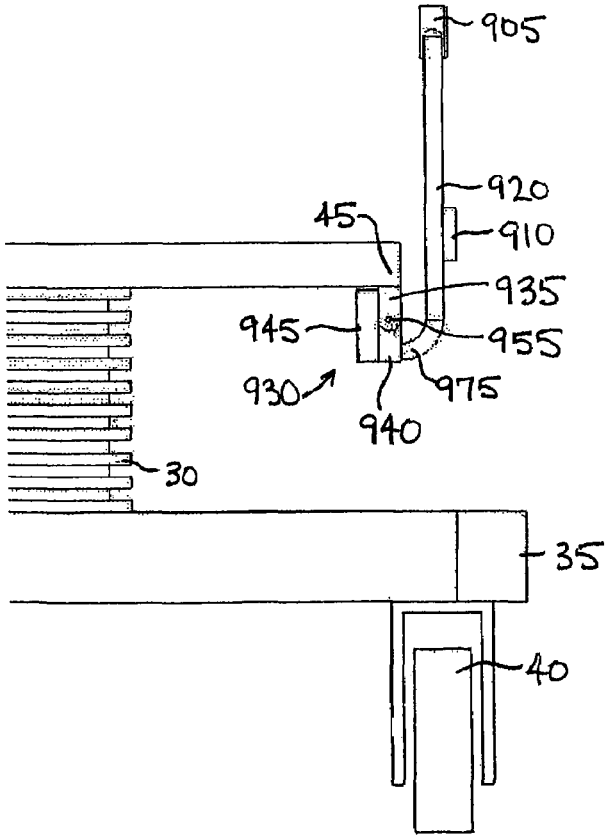
FIG. 62 is an end view of the bed with siderail according to FIGS. 60-61.
Figure 63:
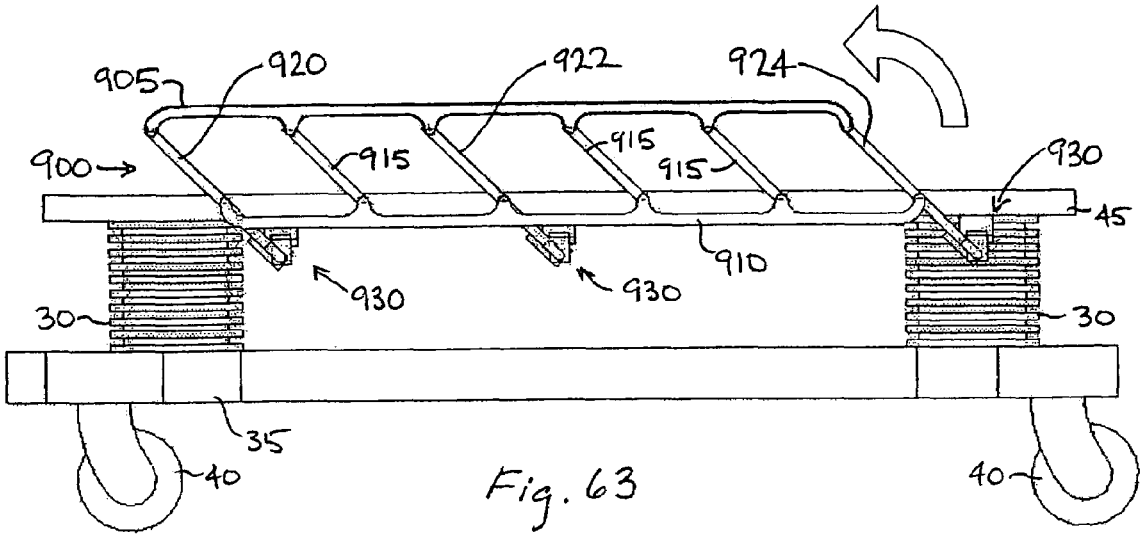
FIG. 63 is a side view of the bed with siderail according to FIGS. 60-62 with the siderail in a partially folded position.
Figure 64:
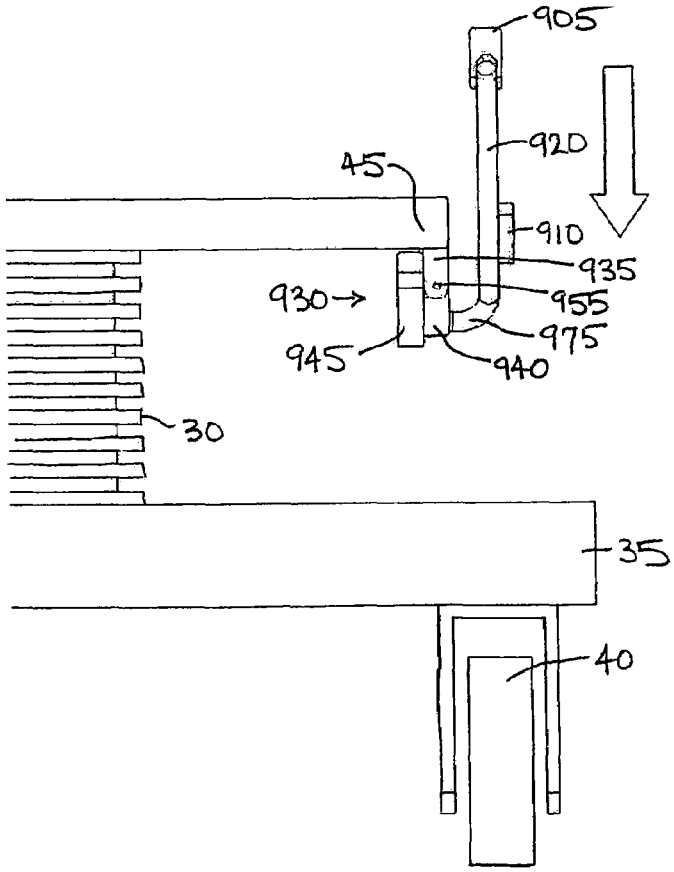
FIG. 64 is an end view of the bed with siderail according to FIG. 63.
Figure 65:
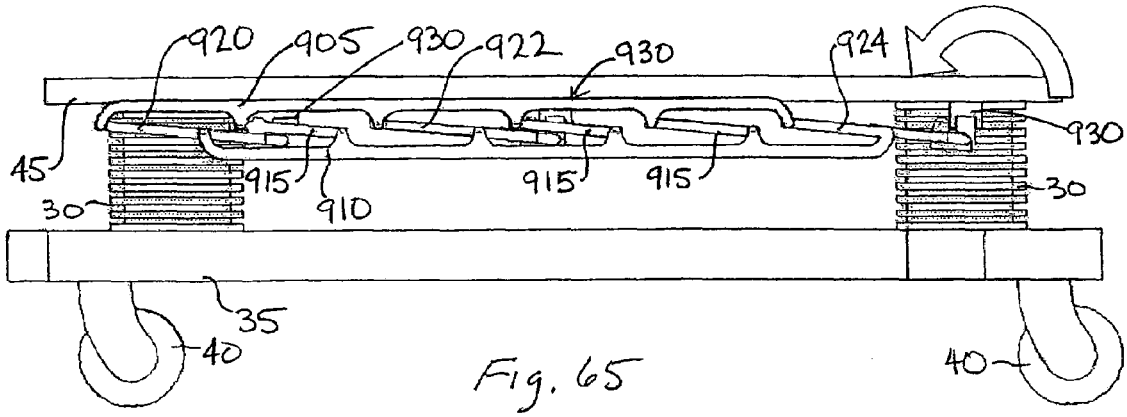
FIG. 65 is a side view of the bed with siderail according to FIGS. 60-64 with the siderail in a folded position.
Figure 66:
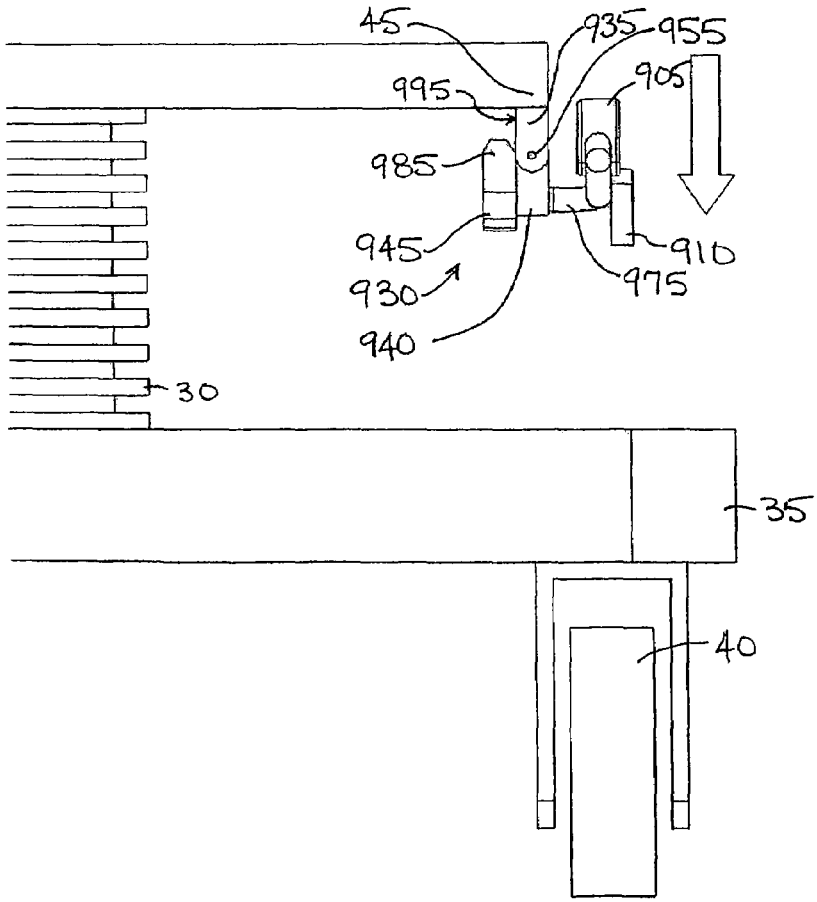
FIG. 66 is an end view of the bed with siderail according to FIG. 65.
Figure 67:
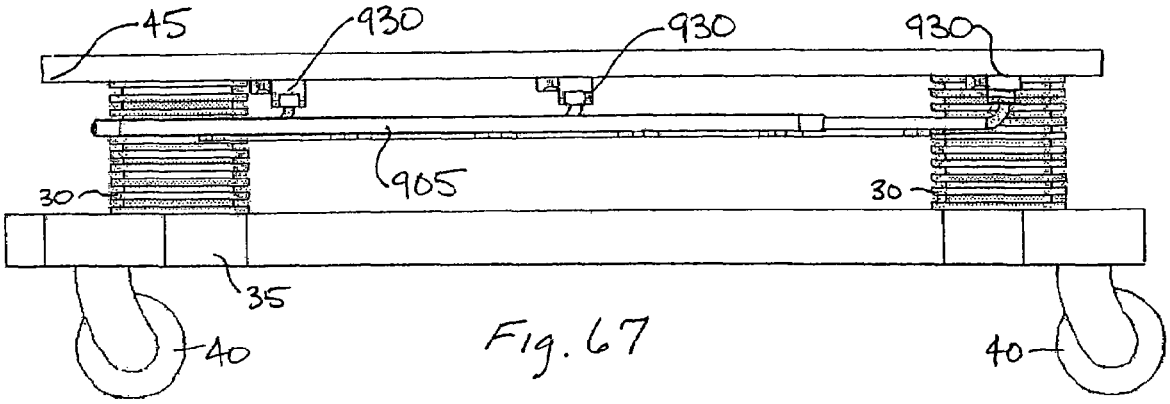
FIG. 67 is a side view of the bed with siderail according to FIGS. 60-66 with the siderail in an under-bed stowed position.
Figure 68:
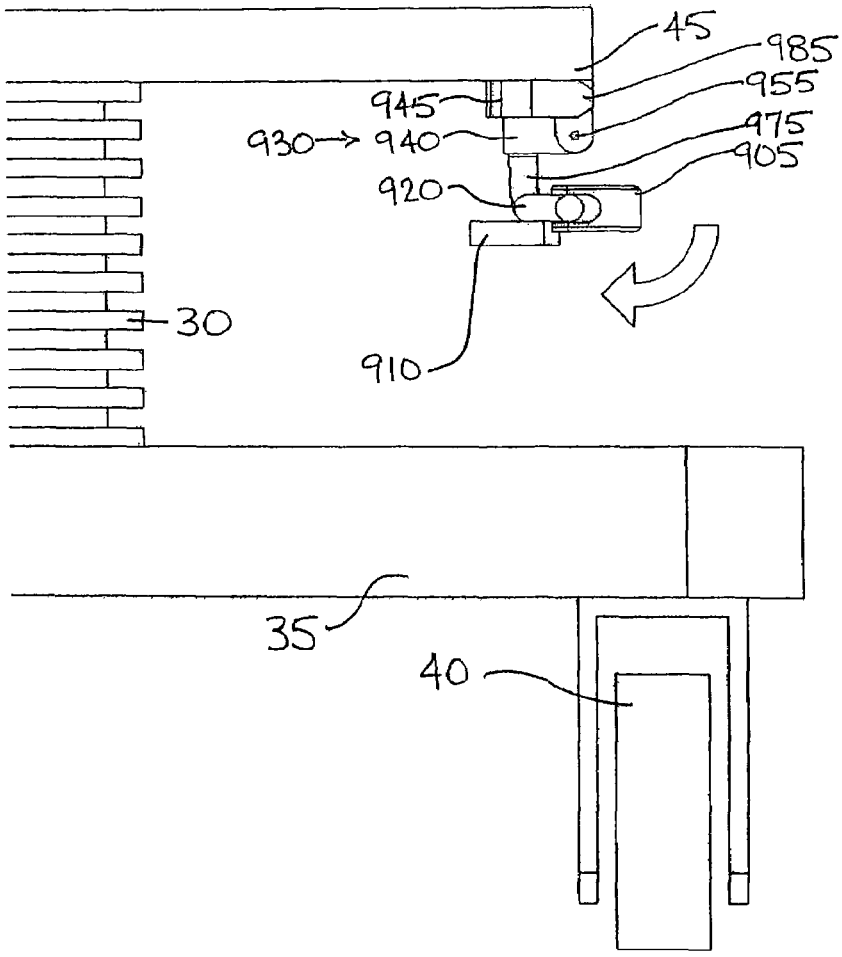
FIG. 68 is an end view of the bed with siderail according to FIG. 67.

Referring FIGS. 62 and 69-70, the siderail 900 is in the deployed, use position. The support arms 920, 922, 924 are vertically oriented, and the wedge block 945 is inverted so that the leg portion 985 of the L-shaped wedge block 945 is positioned against an inside face 995 of the hinge block 935. The wedge block 945 thus prevents the pivot block 940 from rotating clockwise about the pivot pin 955.

The siderail 900 is configured for movement to a lowered position shown in FIGS. 65-66 and 73-74 by rotating the support arms 920, 922, 924 about the base extension 975. The support arms 920, 922, 924 and the spindles 915 thus also pivot between the upper and lower horizontal rails 905, 910 to draw them together in the manner of a four-bar link.

Figure 73:
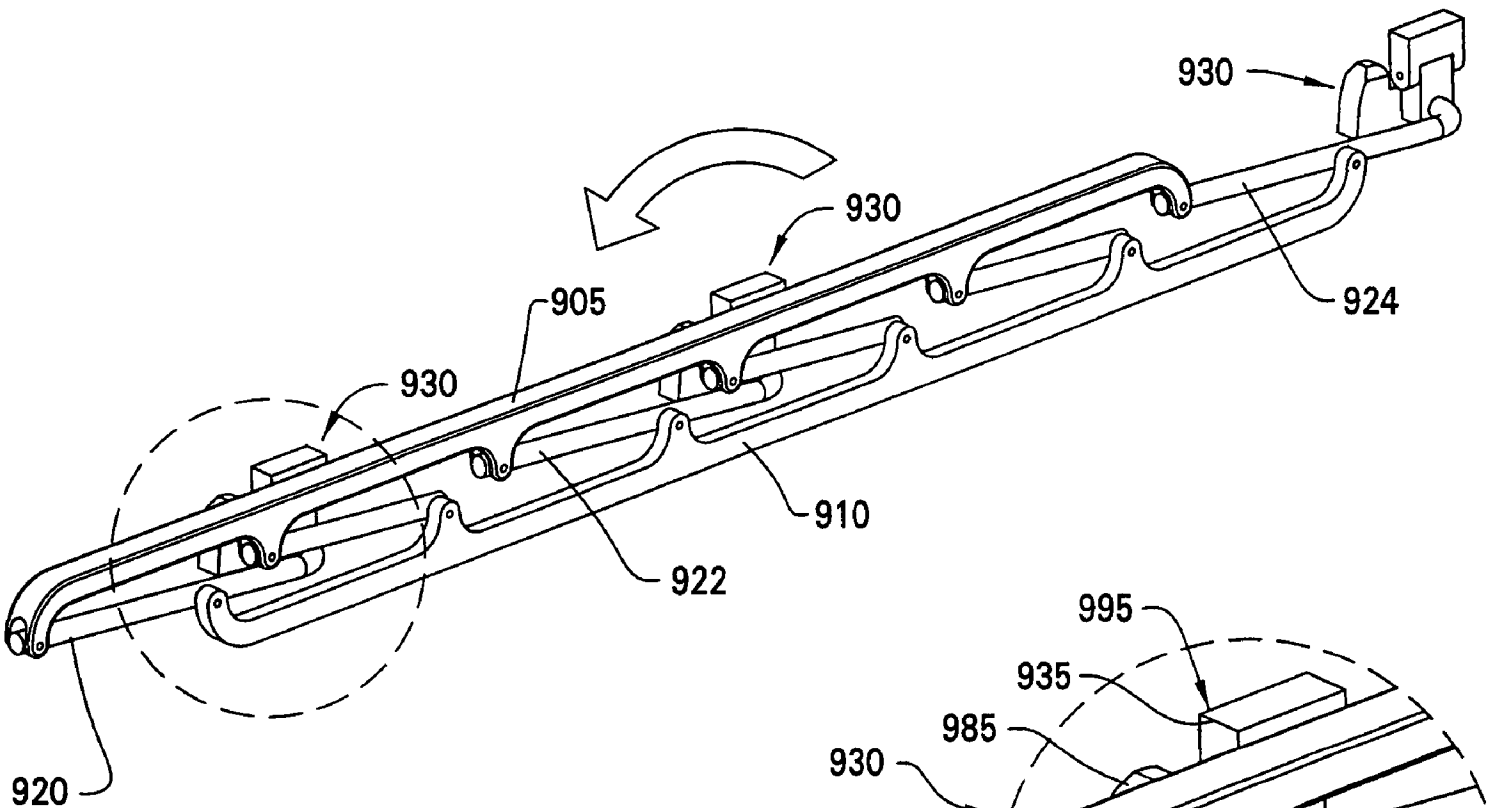
FIG. 73 is a perspective view of the siderail according to FIGS. 60-72 in the folded position.
Figure 74:
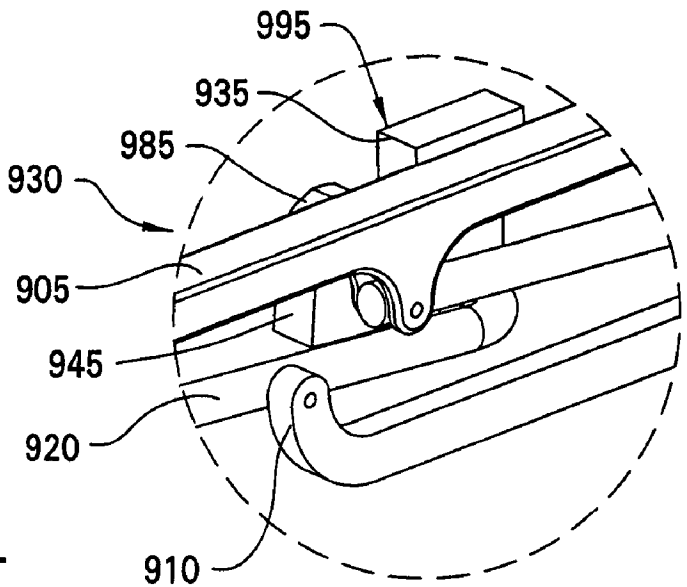
FIG. 74 is an enlarged perspective detail of the mounting mechanism of the siderail according to FIGS. 60-73 in the folded position.
Figures 75, 76:
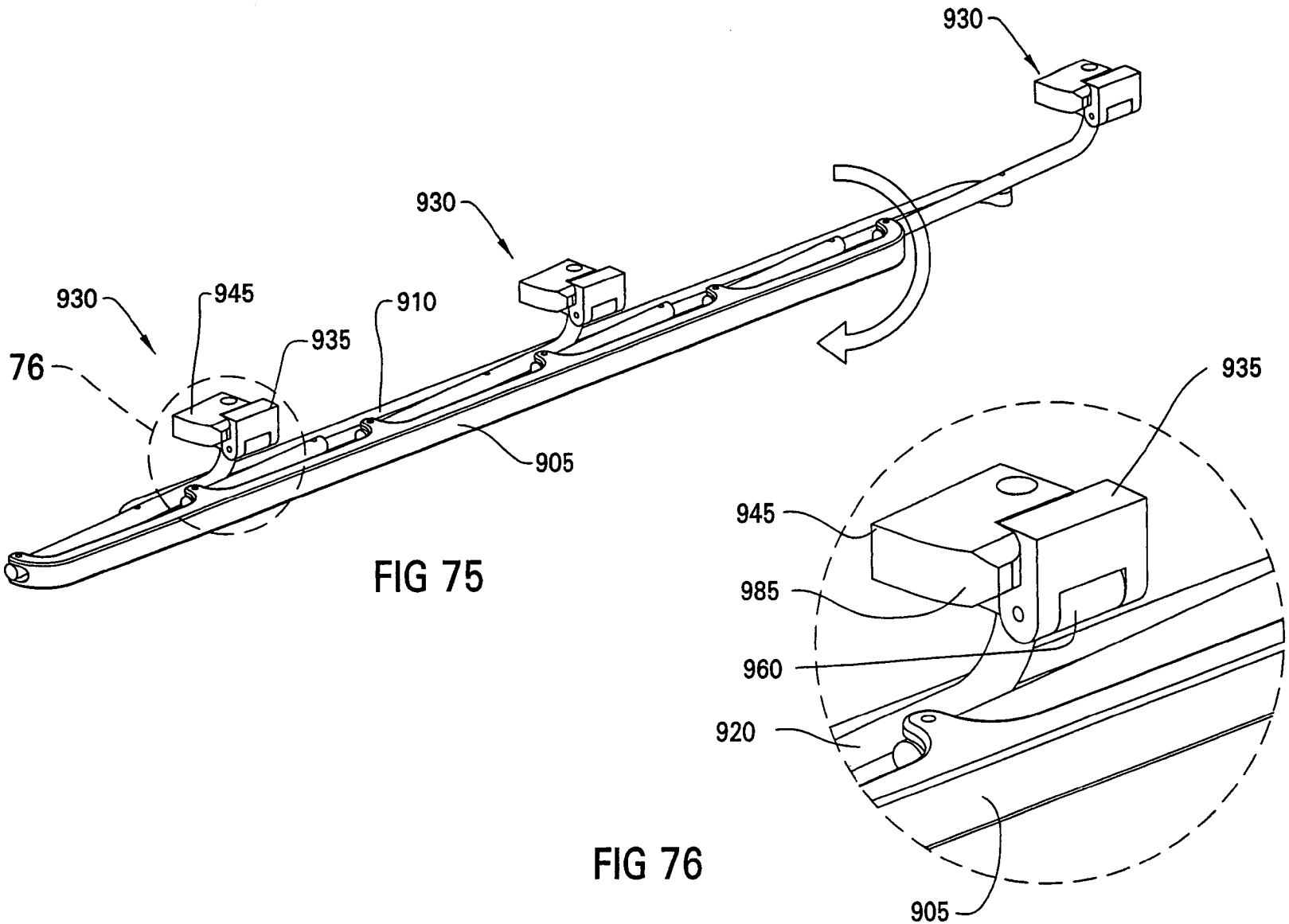
FIG. 75 is a perspective view of the siderail according to FIGS. 70-74 in the under-bed stowed position.
FIG. 76 is an enlarged view of the mounting mechanism for the siderail according to FIGS. 60-75 in the under-bed stowed position.
Figure 77:
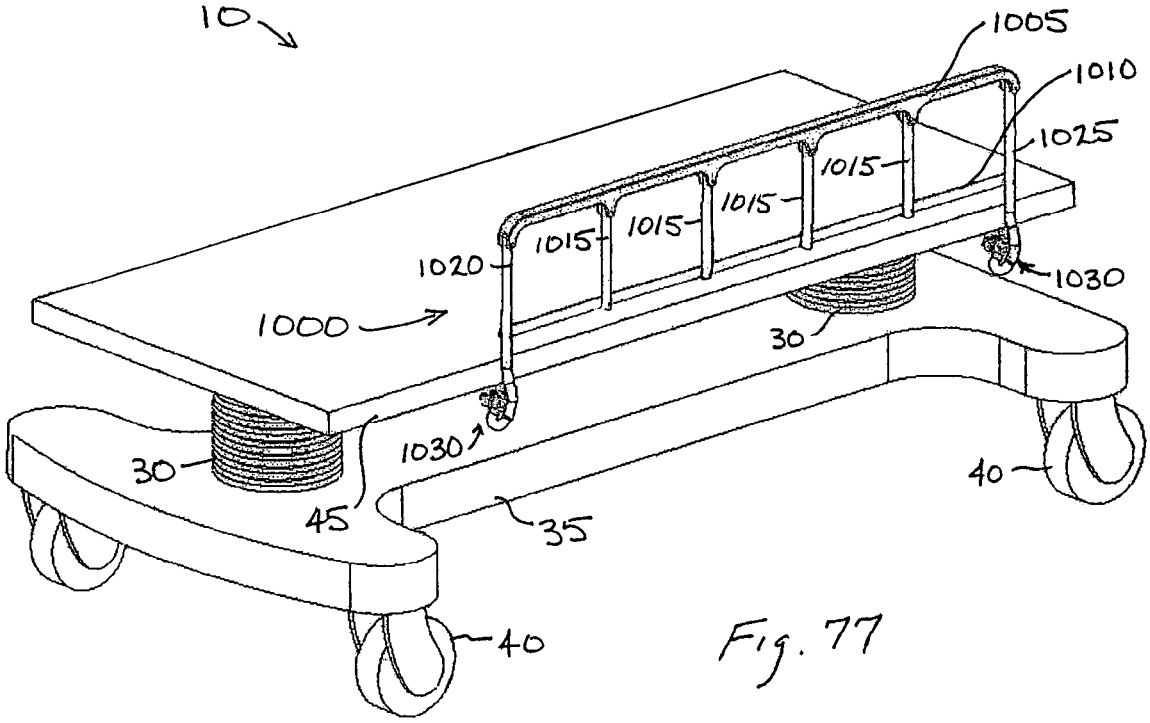
FIG. 77 is a perspective view of a bed with a gear-drive-mounted siderail according to a further embodiment of the invention.
Figure 78:
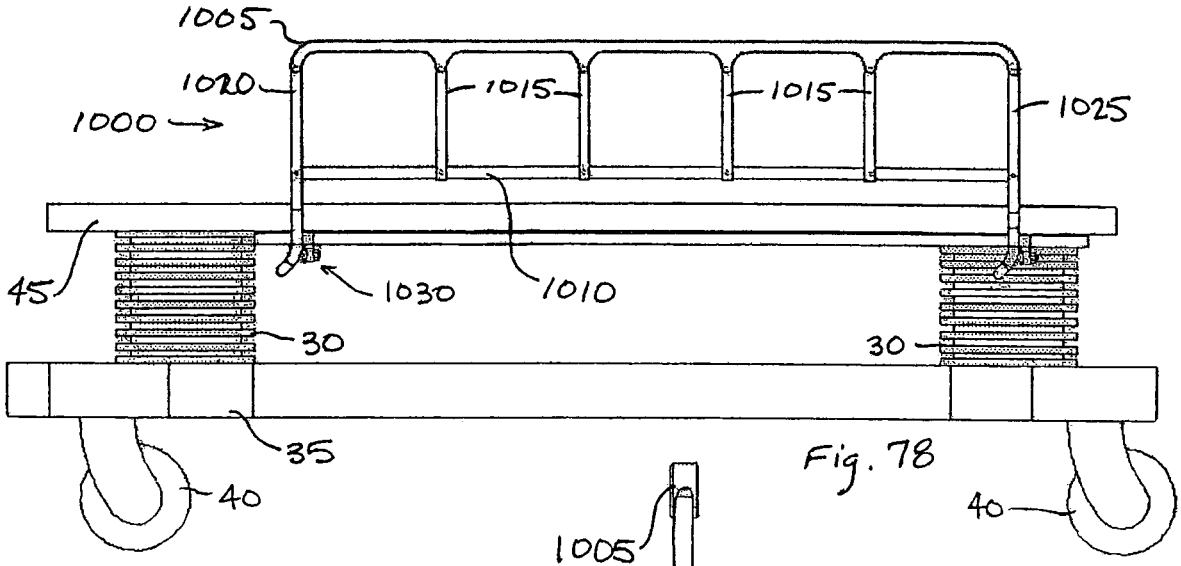
FIG. 78 is a side view of the bed with gear-drive-mounted siderail in the deployed, use position according to FIG. 77.
Figure 79:
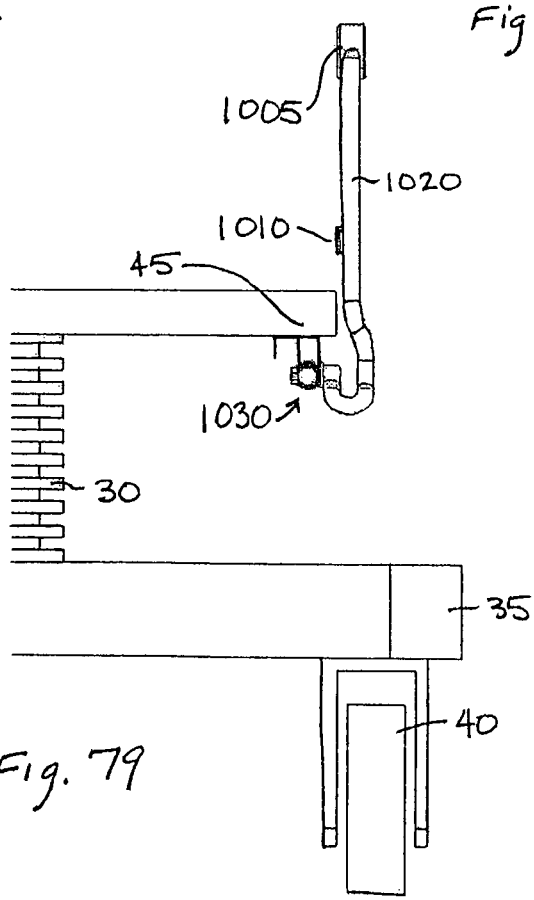
FIG. 79 is an end view of the bed with gear-drive-mounted siderail according to FIGS. 77-78.
Figure 80:
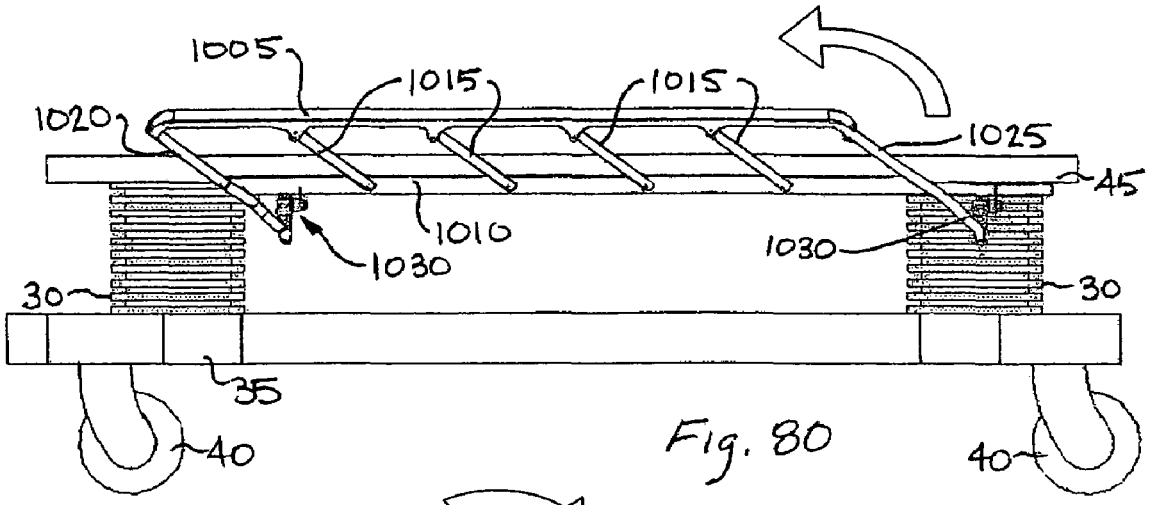
FIG. 80 is a side view of the bed with gear-drive-mounted siderail according to FIGS. 77-79 with the siderail in the partially folded position.
Figure 81:
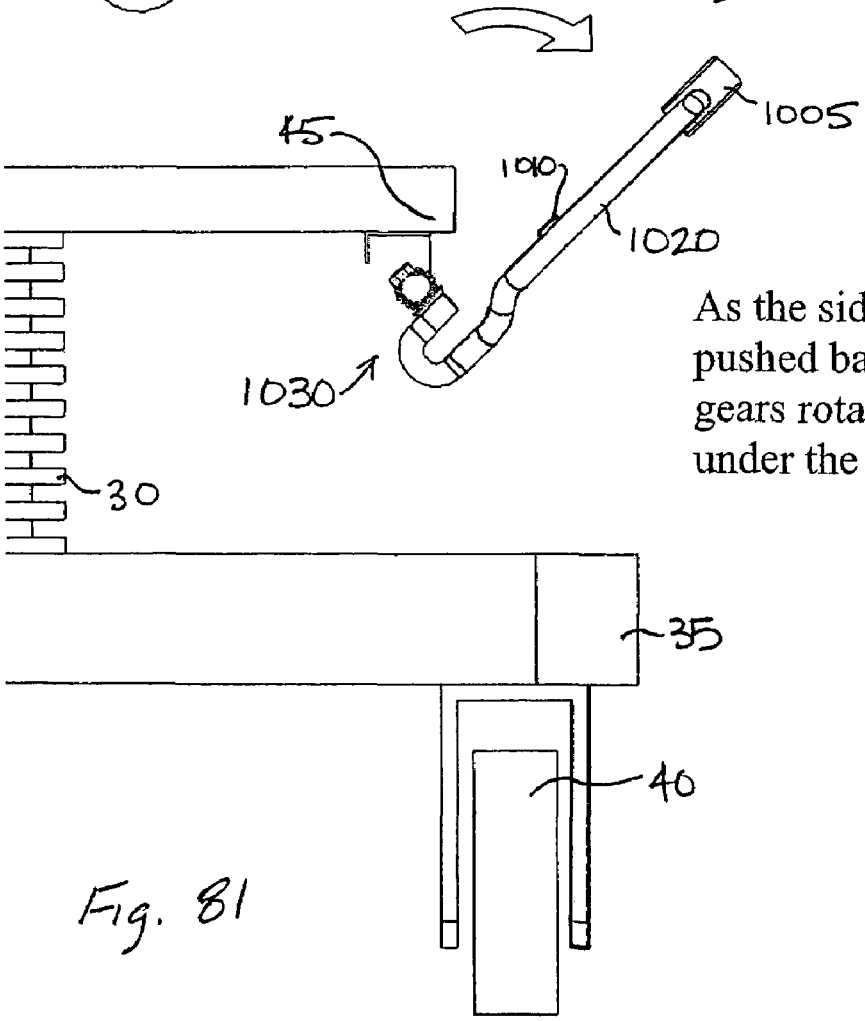
FIG. 81 is an end view of the bed with gear-drive-mounted siderail according to FIGS. 77-80 with the siderail in the partially folded position.
Figure 82:
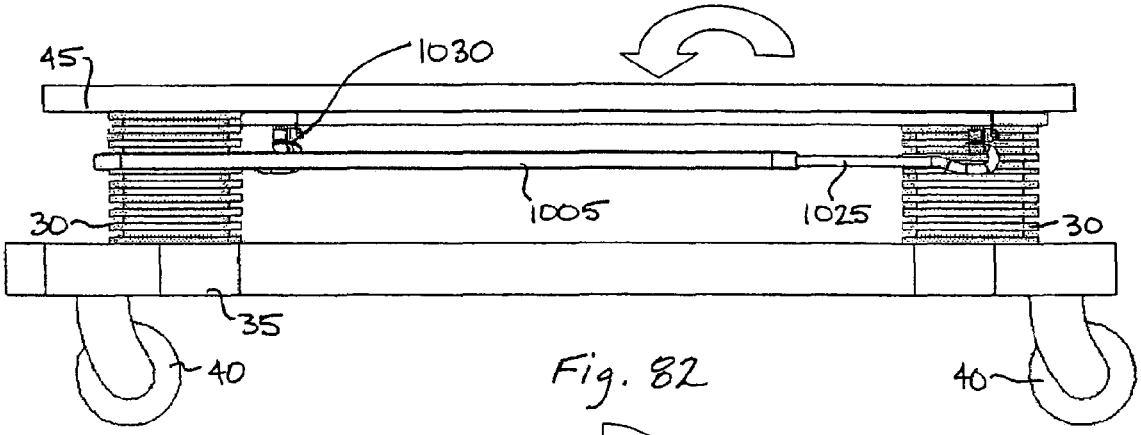
FIG. 82 is a side view of the bed with gear-drive-mounted siderail according to FIGS. 77-81 with the siderail in the fully folded and stowed position.
Figure 83:
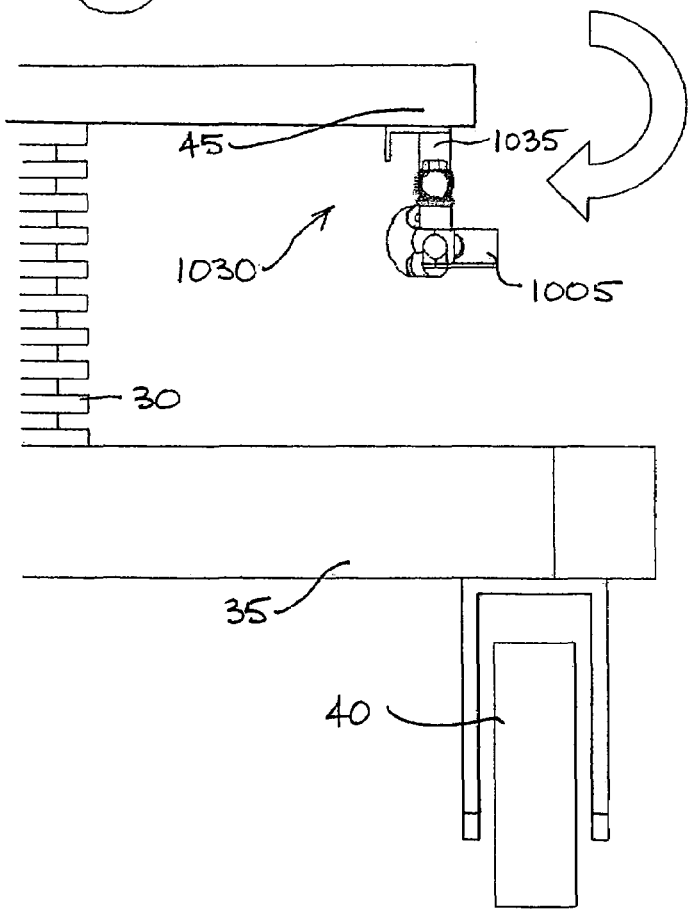
FIG. 83 is an end view of the bed with gear-drive-mounted siderail according to FIGS. 77-82 with the siderail in the fully folded and stowed position.
Figure 84:
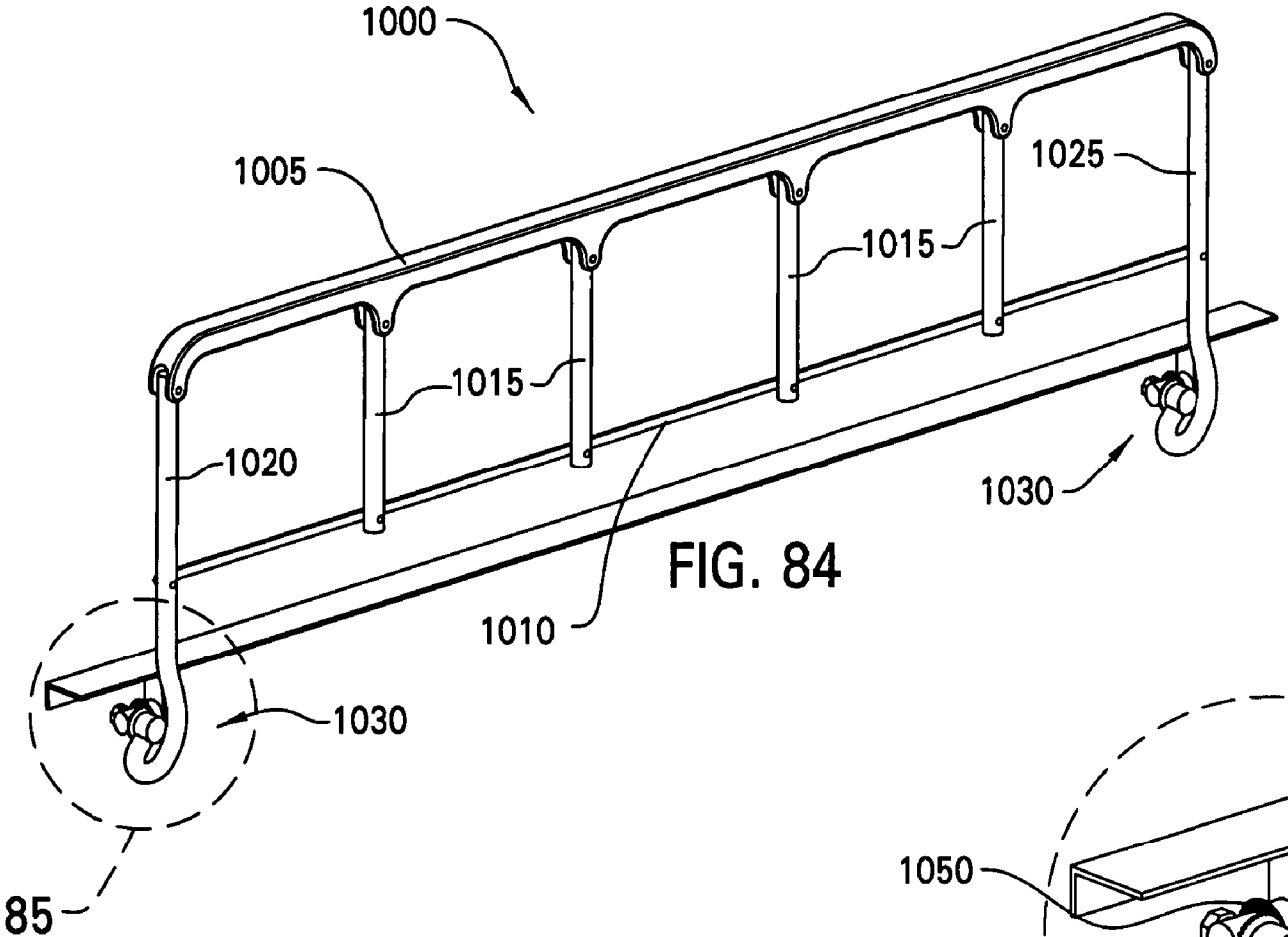
FIG. 84 is a perspective view of the gear-drive-mounted siderail according to FIGS. 77-83.
Figure 85:
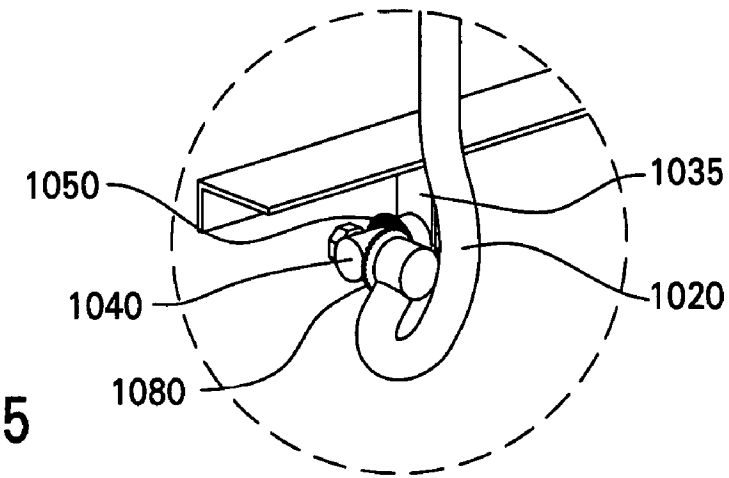
FIG. 85 is an enlarged perspective view of the gear drive of the gear-drive-mounted siderail according to FIGS. 77-84.

As the support arms 920, 922, 924 rotate counterclockwise, the base extension 975 rotates the wedge block 945 in the same fashion. As the wedge block 945 is rotated counterclockwise, the leg portion 985 of the L-shaped wedge block 945 is rotated clear of the hinge block 935, as best shown in FIGS. 73-74. The base portion 980 of the wedge block 945, to which the base extension 975 is connected, aligns behind the mount portion 965 of the pivot block 935. The pivot block 935 is thereby released to rotate 90 degrees about the pivot pin 955 until the base portion 980 of the wedge block 945 contacts the inside face 995 of the hinge block 935.

The support arms 920, 922, 924 thus rotate downwardly to a collapsed position of the siderail 900, and then the collapsed siderail 900 is configured to rotate about pivot pin 955 of each hinge block 935 to a fully stowed position underneath the bed frame 25 and parallel to the bed frame side rail 45.

A further embodiment of a siderail 1000 is illustrated in FIGS. 77-88. The siderail 1000 includes an upper horizontal rail 1005 and a lower horizontal rail 1010, with the upper and lower horizontal rails 1005, 1010 connected by a plurality of spindles 1015. The spindles 1015 are pivotally connected to both the upper and lower horizontal rails 1005, 1010.

The siderail 1000 further includes a pair of support arms 1020, 1025 pivotally connected to the upper and lower horizontal rails 1005, 1010. The support arms 1020, 1025 are parallel to each other and to the spindles 1015 so that the siderail 1000 is collapsible in the sense of an extended four-bar linkage.

Figure 86:
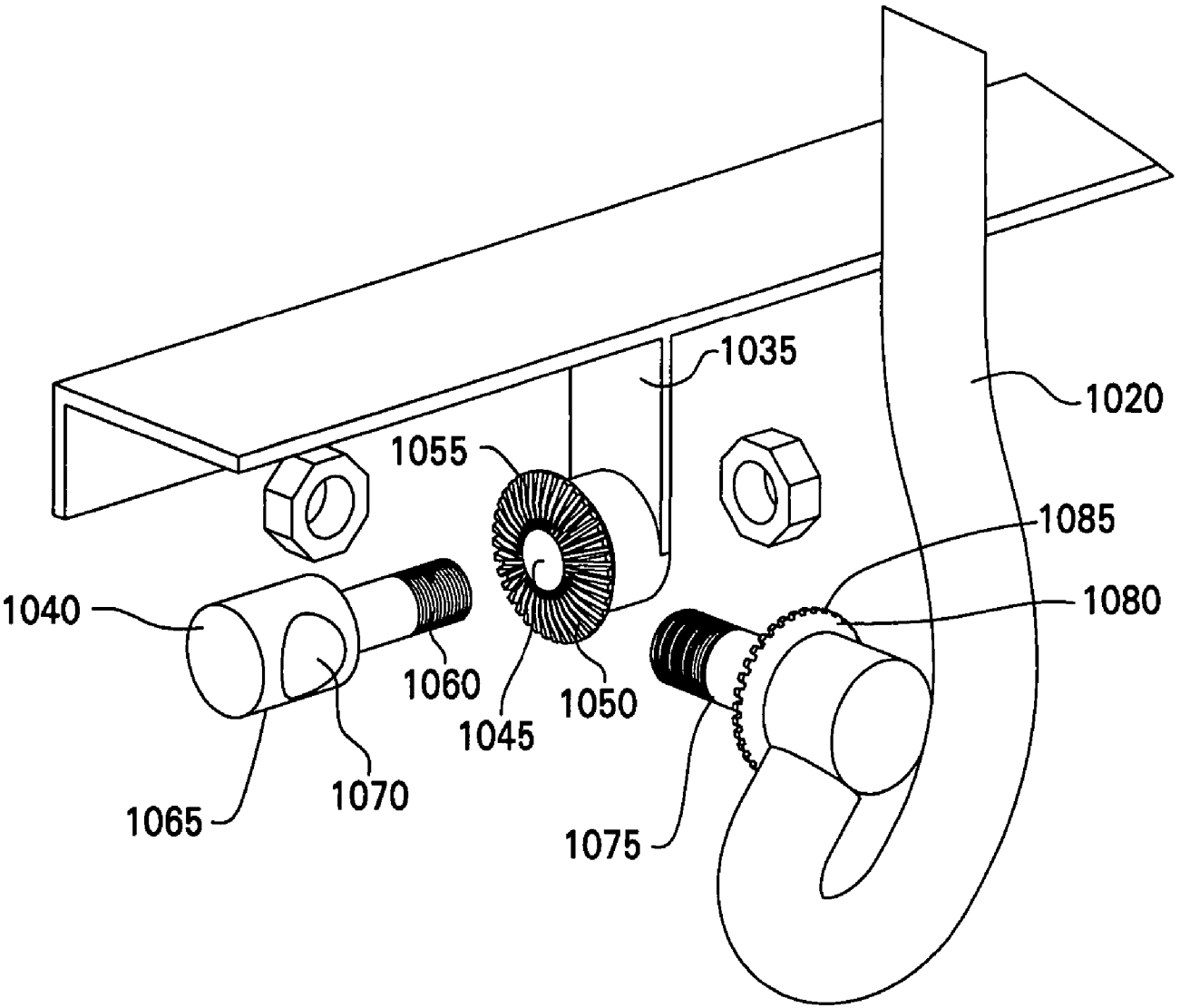
FIG. 86 is an exploded perspective view of the gear drive mechanism of the gear-drive-mounted siderail according to FIGS. 77-85.
Figure 87:
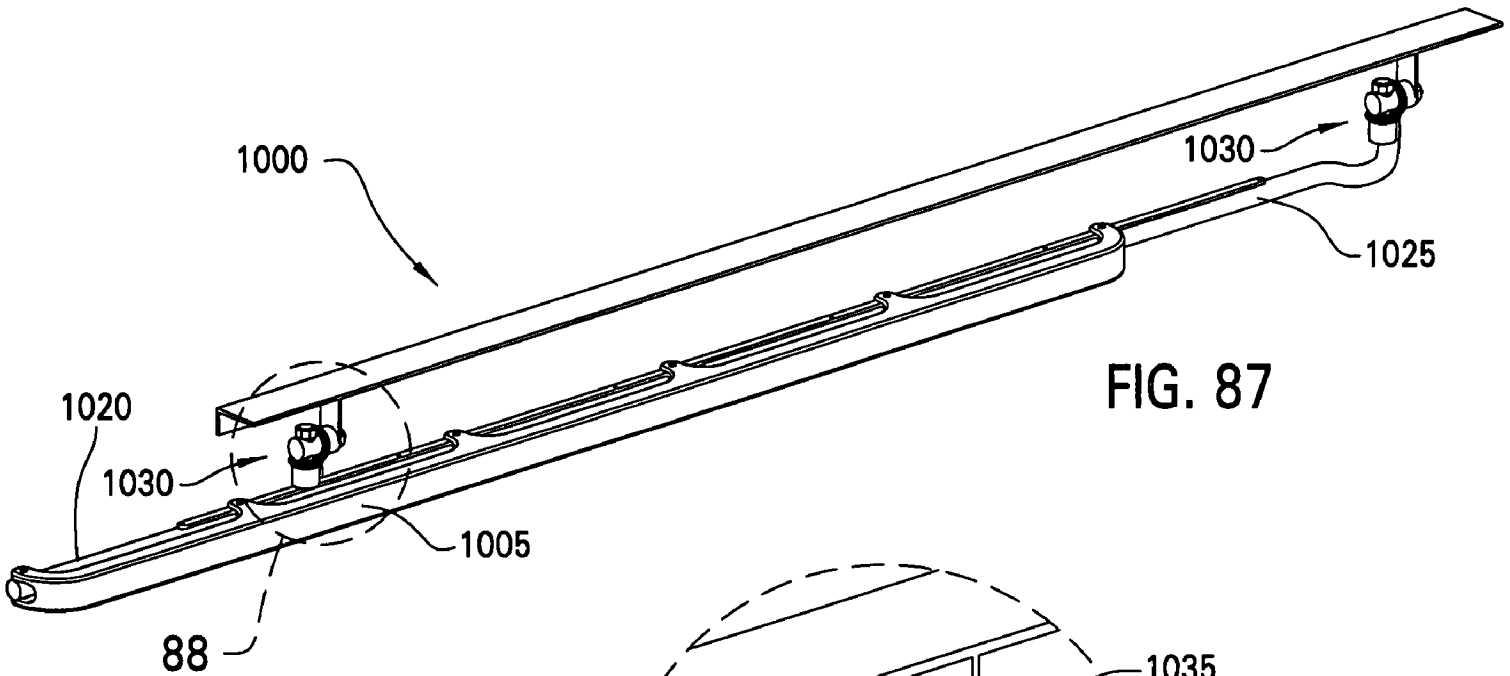
FIG. 87 is a perspective view of the gear-drive-mounted siderail of FIGS. 77-86 in the fully folded and stowed position.
Figure 88:
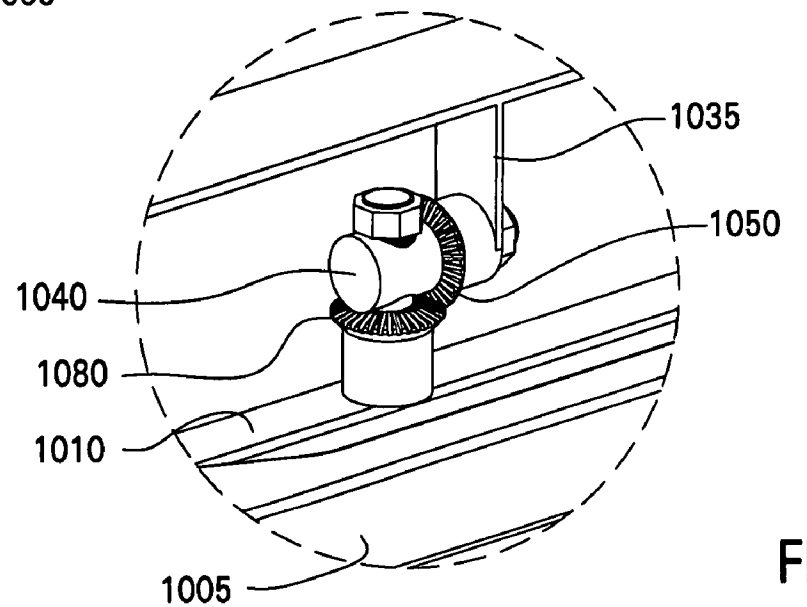
FIG. 88 is an enlarged perspective view of the gear drive mechanism of the gear-drive-mounted siderail of FIGS. 77-87 in the fully folded and stowed position.
Figure 89:
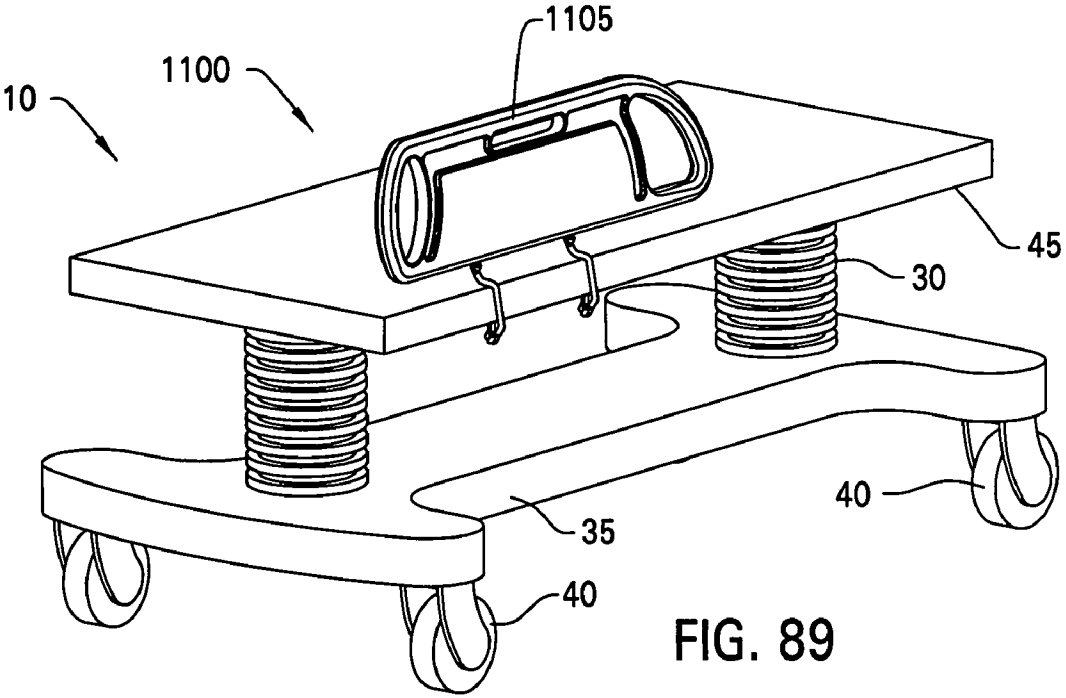
FIG. 89 is a perspective view of a siderail assembly according to a further embodiment of the invention.
Figure 90:
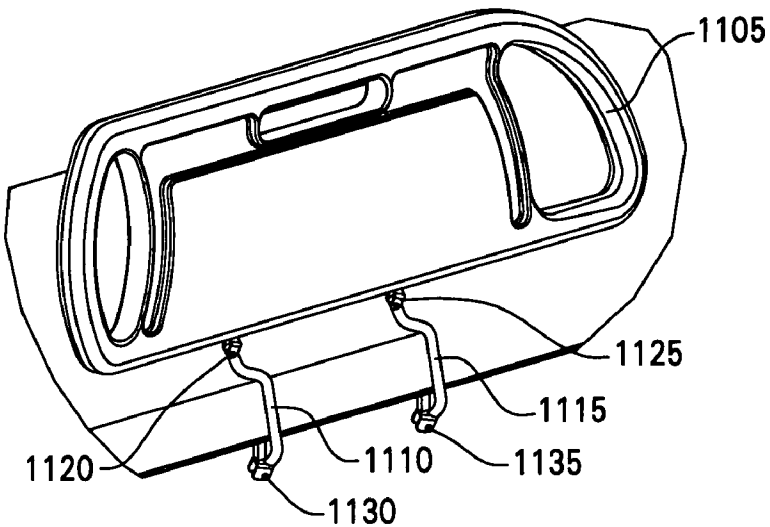
FIG. 90 is an enlarged perspective view according to FIG. 89.

The support arms 1020, 1025 are further pivotally connected to a mounting assembly 1030 secured to an underside of the bed frame side rail 45 (see FIG. 86). The mounting assembly 1030 includes a support stanchion 1035 and a pivot shaft 1040. The support stanchion 1035 includes a pivot shaft aperture 1045 surrounded by a beveled helical gear 1050 having gear teeth 1055. The pivot shaft 1040 includes a threaded portion 1060 and a head portion 1065 having a through aperture 1070. Each support arm 1020, 1025 includes a mounting stud 1075 surrounded by a beveled helical gear 1080 having gear teeth 1085. The through aperture 1070 of the pivot shaft 1040 is configured to receive the mounting stud 1075 of the support arm 1020, 1025. The pivot shaft aperture 1045 is configured to receive the threaded portion of the pivot shaft 1040. With the mounting stud 1075 received in the through aperture 1070 and the pivot shaft 1040 received in the pivot shaft aperture 1045, the beveled helical gears 1050, 1080 are configured to operably engage. While the gears 1050, 1080 are described as being helical, it is also anticipated that other configurations of beveled gear can be configured for this use.

Referring now to FIGS. 78-83, as the siderail 1000 is lowered, the spindles 1015 and the support arms 1020, 1025 rotate in a counterclockwise direction and the upper and lower horizontal rails 1005, 1010 collapse onto one another. As the support arms 1020, 1025 rotate about the mounting stud 1075, rotation of the gear 1080 relative to the gear 1050 rotates the mounting stud 1075 about the pivot shaft 1040 from a horizontal orientation to a vertical orientation. The support arms 1020, 1025 thus rotate downwardly and inwardly so that as the siderail 1000 is lowered to the collapsed position of FIGS. 82-83 and 87-88, it is simultaneously rotated inwardly to a stowed condition underneath the bed frame 25 and parallel to the bed frame side rails 45.

A further embodiment of a siderail assembly 1100 is illustrated in FIGS. 89-96. The siderail assembly 1100 includes a siderail 1105 pivotally supported from the bed frame side rail 45 by at least two support arms 1110, 1115. The support arms 1110, 1115 are pivotally connected to the siderail 1105 by upper pivot brackets 1120, 1125. The support arms 1110, 1115 are pivotally connected to the bed frame side rail 45 by lower pivot brackets 1130, 1135. The lower pivot brackets are mounted to stanchions 1140, 1145 and depend directly below the bed frame side rail 45. In a further embodiment, the support arms 1110, 1115 can be configured with an in-turned lower end directly pivotally mounted in the lower pivot bracket after the manner disclosed in commonly owned U.S. Pat. No. 6,253,397, issued Jul. 3, 2001, incorporated herein by reference.

Each of the upper and lower pivot brackets 1120, 1125, 1130, 1135 includes a pivot pin defining a pivot axis for the respective pivot bracket. The pivot pins of the pivot brackets 1120-1135 are parallel to each other, in order to define a four-bar linkage between the siderail 1105, bed frame side rail 45, and support arms 1110, 1115, but are skew with respect to the longitudinal or transverse directions of the bed 10 and with respect to a vertical direction.

Figure 91:
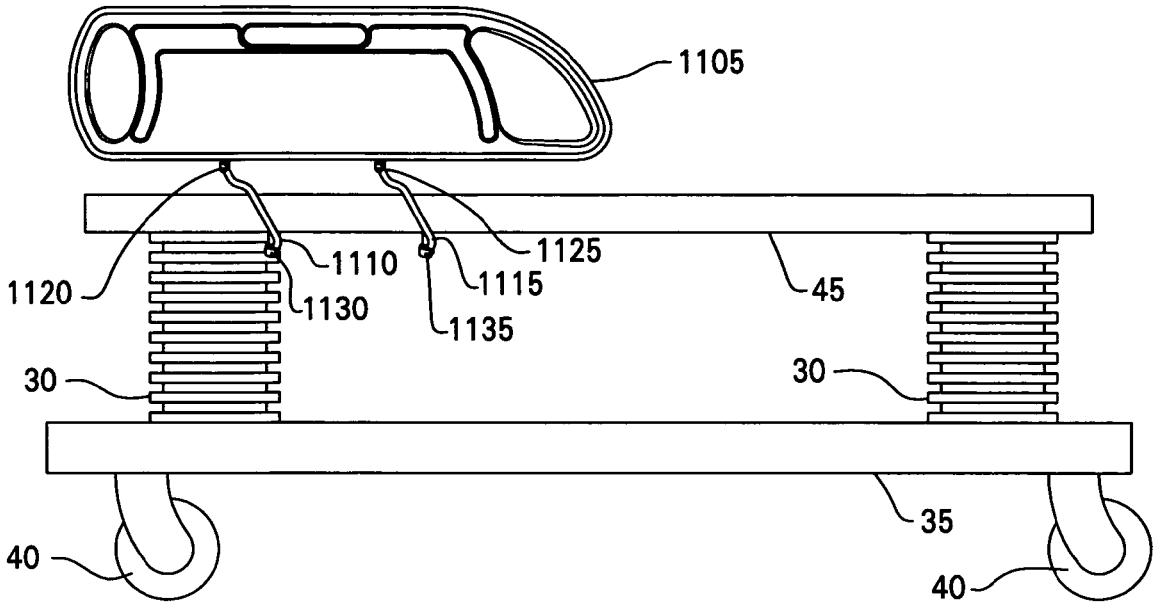
FIG. 91 is a side view of the siderail assembly according to FIGS. 89-90 in a deployed, use position.
Figure 92:
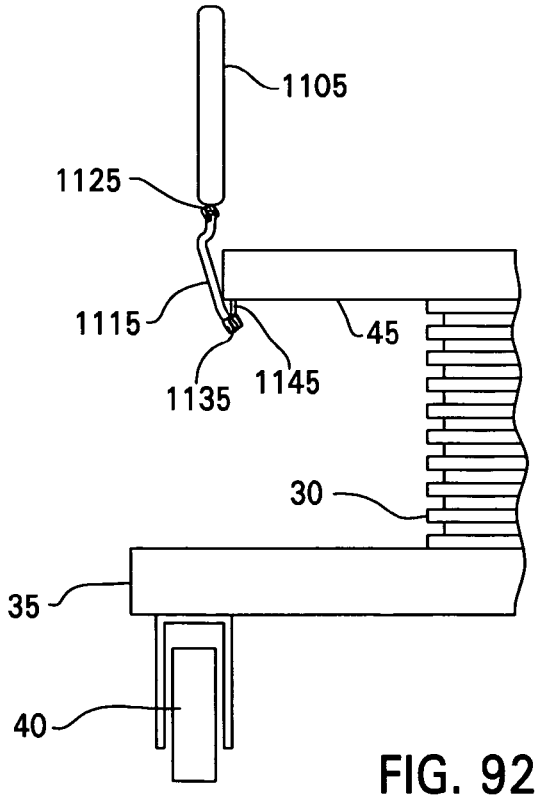
FIG. 92 is an end view according to FIG. 91.

The siderail assembly 1100 is configured so that the siderail 1105 is closely secured adjacent the surface of the bed 10 when in the upright, deployed position shown in FIGS. 89-92. In order to attain this condition, the support arms 1110, 1115 must form identical compound curves to reach the siderail 1105 from the lower pivot brackets 1130, 1135, which are underneath the bed frame side rail 45, and which are in a non-orthogonal orientation as described above. As shown in FIGS. 91-92, the support arms 1110, 1115 extend outwardly and upwardly to the right from the lower pivot brackets 1130, 1135, then turn leftwardly and subsequently inwardly to the upper pivot brackets 1120, 1125. This circuitous routing of the support arms 1110, 1115 is necessary to clear the bed frame side rail 45 and bring the siderail 1105 snugly against the bed 10. The support arms 1110, 1115 are releasably secured in the upright, deployed position as described in the aforementioned U.S. Pat. No. 6,253,397.

Figure 93:
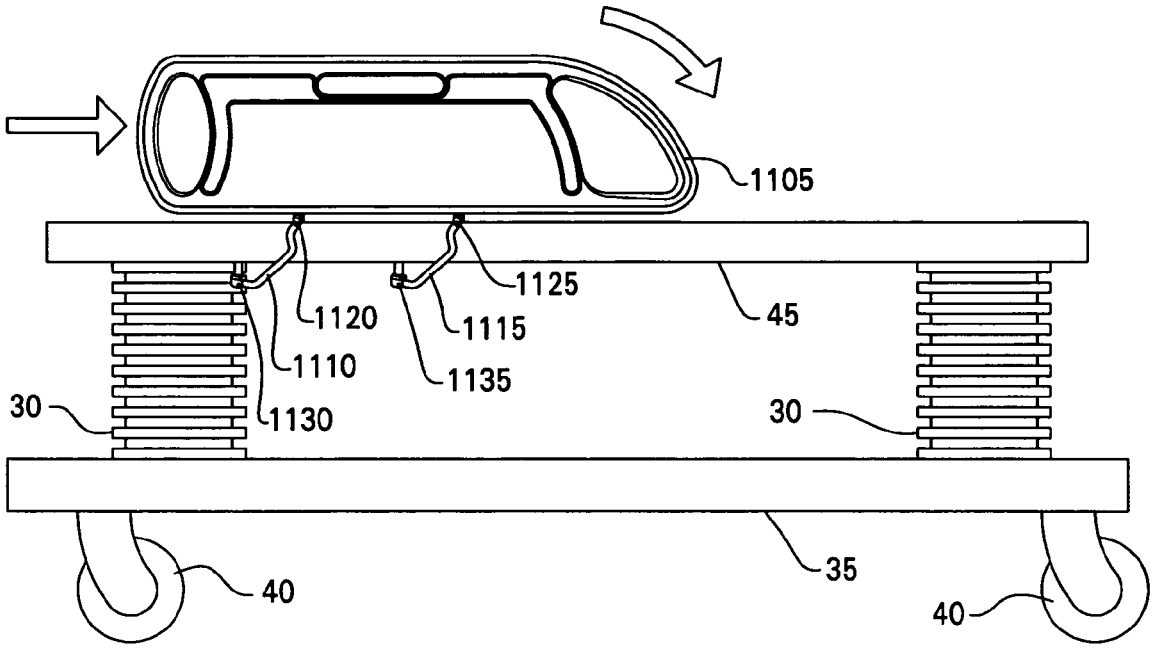
FIG. 93 is a side view of the siderail assembly according to FIGS. 89-92 in a partially stowed position.
Figure 94:
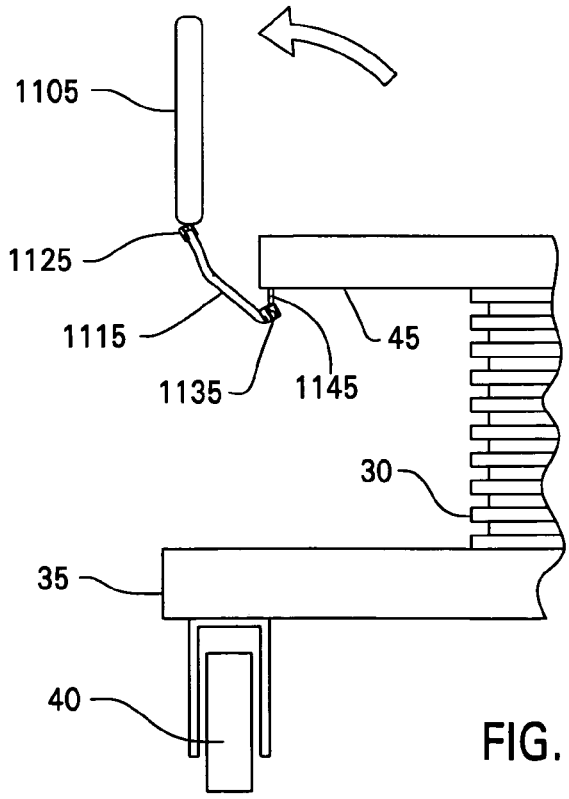
FIG. 94 is an end view according to FIG. 93.
Figure 95:
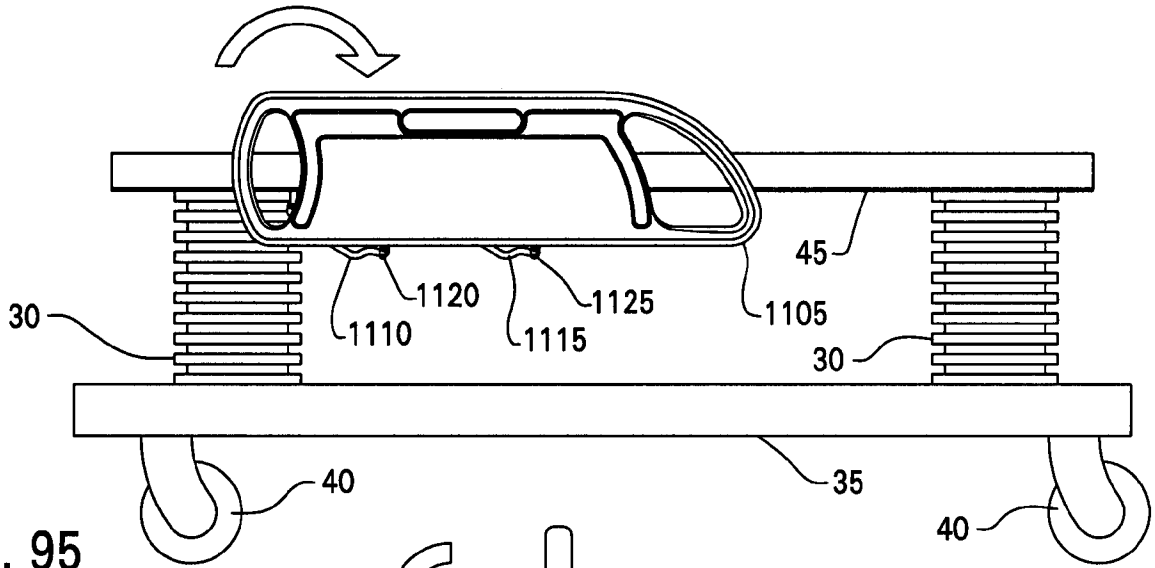
FIG. 95 is a side view of the siderail assembly according to FIGS. 89-94 in a stowed position.
Figure 96:
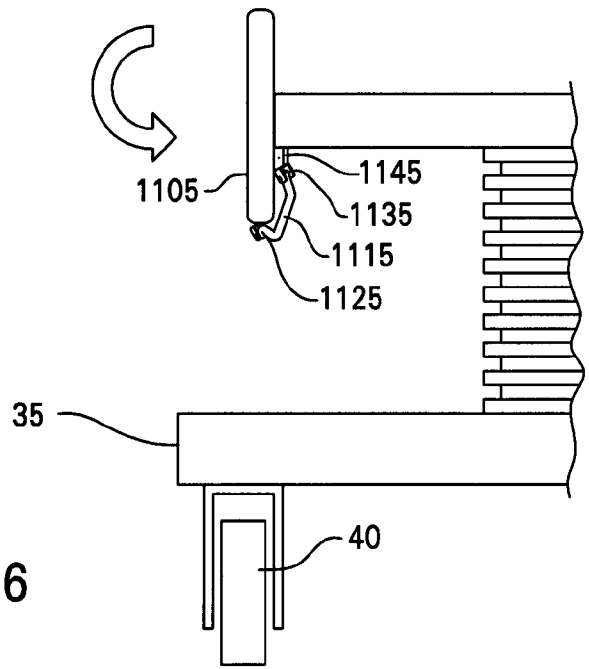
FIG. 96 is an end view according to FIG. 95.

Referring now to FIG. 93, the siderail 1105 has been displaced to the right. Due to the orientation of the pivot axes of the pivot brackets 1120-1135, as the siderail 1105 is displaced to the right, it is displaced outwardly from the bed frame side rail 45 through a pre-defined portion of the rotation of the support arms 1110, 1115. As the siderail 1105 continues to the right, the support arms 1110, 1115 pass a crossover point after which, as the siderail 1105 continues to move to the right, the support arms 1110, 1115 draw the siderail 1105 inwardly toward the bed frame side rail 45. As the siderail 1105 reaches its lowermost, stowed position, it abuts the bed frame side rail 45, as illustrated in FIGS. 95-96. In the illustrated embodiment, the siderail 1105 abuts the bed frame side rail 45 and rests on the upper end of the support arms 1110, 1115.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A bed having a bed frame and a patient support surface, the patient support surface having an upper surface and supported at the bed frame, and a siderail mounted at the bed frame for deployment from a stowed position to a deployed position wherein the siderail extends alongside the patient support surface and above the upper surface of the patient support surface, and wherein the siderail comprises:

an upper horizontal rail;

a lower horizontal rail; and a pair of support arms pivotally connecting and generally aligning the upper and lower horizontal rails in a common plane, the common plane being generally vertically aligned when the siderail is in the deployed position, the support arms pivotally connecting the upper and lower horizontal rails at the bed frame and being arranged to collapse the siderail in the manner of a four-bar linkage, and the siderail being configured to rotate under the bed frame in the stowed position wherein the upper horizontal rail and the lower horizontal rail generally remain in the common plane when the siderail is collapsed and rotated but with the common plane moving under the bed frame.

2. The bed of claim 1, wherein the siderail is connected to the bed frame by a gear drive mechanism, whereby the collapsing of the siderail simultaneously rotates the siderail under the bed frame.

3. The bed according to claim 1, wherein the siderail is connected to the bed frame by a pair of gear drive mechanisms, each of the gear drive mechanisms including a first gear mounted to a respective support arm and a second gear mounted at or adjacent the bed frame.

4. The bed according to claim 3, wherein each of the support arms is pivotally mounted about a respective second gear about a first axis of rotation and about a second axis of rotation, the second axes of rotation rotating about the first axes of rotation when the first gears are driven about the second gears.

5. The bed according to claim 4, wherein each of the first and second gears comprises a helical gear.

6. The bed according to claim 1, wherein the siderail is configured to move downwardly and inwardly under the bed frame simultaneously.

7. The bed according to claim 1, wherein the upper and lower horizontal rails rotate from a spaced apart generally vertical orientation when the siderail is in its deployed position to a compact generally horizontal orientation when the siderail is in its stowed position.

8. A bed having a bed frame and a siderail mounted at the bed frame for deployment from a stowed position to a deployed position wherein the siderail extends along the bed frame, the bed frame having a longitudinal central axis extending from a head end of the bed frame to a foot end of the bed frame, the siderail comprising:

an upper rail;

a lower rail; and a pair of support arms pivotally connected to the upper rail and the lower rail, the upper rail, the lower rail, and the support arms being configured as a four-bar linkage wherein the upper and lower rails are arranged to collapse when the support arms are moved relative to the bed frame, and each of the support arms being pivotally mounted for pivotal movement relative to the bed frame about a first pivot axis and about a second pivot axis, and the second pivot axes rotating about the first pivot axes when the siderail is pivoted relative to the bed frame, wherein when the upper rail is moved relative to the lower rail, the upper and lower rails move from their deployed position to a collapsed and rotated configuration wherein the upper rail and the lower rail are adjacent each other and generally lie in a common plane generally parallel to and below the bed frame.

9. The bed according to claim 8, wherein the support arms pivot about the first and second axes simultaneously.

10. The bed according to claim 8, wherein each of the first pivot axes is generally orthogonal to a respective second pivot axis.

11. The bed according to claim 8, wherein the support arms are pivotally mounted at or adjacent the bed frame by gear mechanisms.

12. The bed according to claim 11, wherein the siderail simultaneously pivots about the first and second pivot axes when the siderail moves relative to the bed frame.

13. The bed according to claim 11, wherein the gear mechanisms includes a first gear mounted to each of the support arms and a pair of second gears mounted at the bed frame.

14. The bed according to claim 13, wherein each of said support arms is pivotally mounted by a first pivot shaft defining the first pivot axis and by a second pivot shaft defining the second pivot axis, the first gears being mounted about the second gears by the first pivot shafts.

15. The bed according to claim 13, wherein the first gears are pivotally mounted about the second gears by first and second pivot shafts, and each of the second pivot axes pivoting about a respective first pivot axis when the first gears are driven about the second gears.

16. A patient support having a frame and a siderail connected at or adjacent the frame for deployment from a stowed position to a deployed position wherein the siderail extends along side the frame, the siderail comprising:

a rail;

a pair of support arms mounted for pivotal movement relative to the frame, each of the support arms pivotally connected to the rail about an upper pivot axis and being pivotally connected at the frame about a first pivot axis generally perpendicular to a respective upper pivot axis and about a second pivot axis, and the rail and the arms generally lying in a common plane, with the common plane being generally vertical when in the deployed position, and when the rail is moved and the arms pivot relative to the frame the second pivot axes rotate about the first pivot axes and the rail and the arms collapse into the common plane which rotates and extends under the frame when in the stowed position.

17. The patient support according to claim 16, wherein the siderail has a range of motion and the siderail is configured to move inward relative to the frame over at least a portion of the range of motion.

18. The patient support according to claim 17, wherein the siderail is configured to move simultaneously downward and inward relative to the frame over at least a portion of the range of portion.

19. The patient support according to claim 16, wherein each of the support arms includes a first gear, the frame supporting a pair of second gears, the first gears pivotally mounted about the second gears about the first pivot axes, and the first gears being driven about the second gears when the siderail is moved relative to the frame.

20. The patient support according to claim 19, wherein each of the first gears is pivotally mounted about a respective second gear by a pivot shaft, and each of the first gears being pivotally mounted to a respective pivot shaft.

21. A patient support comprising:

a frame defining a generally horizontal plane for supporting a patient support surface; and a siderail supported at the frame, the siderail having an upper rail and a lower rail, the upper rail and the lower rail being spaced apart when in a deployed position and being interconnected by at least two arms, each arm pivotally connected at the frame and to the upper rail and to the lower rail wherein the rails and the support arms form a four bar linkage, wherein when the upper rail is moved relative to the lower rail, the upper and lower rails move from their spaced apart configuration to a collapsed and rotated configuration wherein the upper rail, the lower rail, and the support arms are adjacent each other and generally lie in a common plane below the horizontal plane of the frame.

22. The patient support according to claim 21, further comprising a plurality of spindles extending between the lower rail and the upper rail between the support arms, the spindles being pivotally mounted to the upper rail at one end thereof and pivotally mounted to the lower rail at an opposed end thereof.

23. The patient support according to claim 21, wherein each of the support arms is pivotally mounted at the frame about a first pivot shaft, the frame having a generally central longitudinal axis extending from a head end of the frame to a foot end of the frame, and each of the first pivot shafts having a pivot axis being generally parallel to the central longitudinal axis.

24. The patient support according to claim 23, wherein each of the support arms is pivotally mounted at the frame by a second pivot shaft, each of the second pivot shafts being generally orthogonal to a respective first pivot shaft.

* * * * *